US007858283B2

(12) United States Patent
Ishigami et al.

(10) Patent No.: US 7,858,283 B2
(45) Date of Patent: Dec. 28, 2010

(54) MAGNETIC CARRIER AND TWO-COMPONENT DEVELOPER

(75) Inventors: Koh Ishigami, Mishima (JP); Hiroyuki Fujikawa, Yokohama (JP); Kunihiko Nakamura, Gotemba (JP); Nozomu Komatsu, Mishima (JP); Chika Inoue, Berlin (DE); Tomoko Endo, Odawara (JP); Yoshinobu Baba, Yokohama (JP); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/691,040

(22) Filed: Jan. 21, 2010

(65) Prior Publication Data

US 2010/0136473 A1 Jun. 3, 2010

Related U.S. Application Data

(63) Continuation of application No. PCT/JP2009/064089, filed on Aug. 4, 2009.

(30) Foreign Application Priority Data

Aug. 4, 2008 (JP) ..... 2008-201074

(51) Int. Cl.
*G03G 9/113* (2006.01)
*G03G 9/08* (2006.01)

(52) U.S. Cl. ..... 430/110.3; 430/111.32; 430/111.35

(58) Field of Classification Search ..... 430/111.35, 430/111.31, 111.32, 111.33, 110.3
See application file for complete search history.

(56) References Cited

U.S. PATENT DOCUMENTS

| | | | | |
|---|---|---|---|---|
| 5,573,880 | A | 11/1996 | Mayama et al. | |
| 6,010,811 | A | 1/2000 | Baba et al. | |
| 6,159,648 | A | 12/2000 | Baba et al. | |
| 6,165,663 | A | 12/2000 | Baba et al. | |
| 6,653,036 | B1 | 11/2003 | Tanikawa et al. | 430/106.2 |
| 2006/0269862 | A1 * | 11/2006 | Kobayashi et al. | 430/111.31 |
| 2007/0048649 | A1 | 3/2007 | Kobayashi et al. | 430/111.31 |
| 2008/0152396 | A1 | 6/2008 | Yamamoto et al. | 399/286 |
| 2010/0119967 | A1 * | 5/2010 | Inoue et al. | 430/110.3 |
| 2010/0119968 | A1 * | 5/2010 | Komatsu et al. | 430/111.3 |

FOREIGN PATENT DOCUMENTS

| | | |
|---|---|---|
| JP | 04-093954 | 3/1992 |
| JP | 08-160671 | 6/1996 |
| JP | 2002-214844 | 7/2002 |
| JP | 2006-337578 | 12/2006 |
| JP | 2006-337579 | 12/2006 |
| JP | 2007-057943 | 3/2007 |
| JP | 2008-122938 | 5/2008 |

OTHER PUBLICATIONS

International Search Report issued in the corresponding International Application No. PCT/JP2009/064089 dated Nov. 10, 2009.

* cited by examiner

*Primary Examiner*—Janis L Dote
(74) *Attorney, Agent, or Firm*—Fitzpatrick, Cella, Harper & Scinto

(57) ABSTRACT

A magnetic carrier which has magnetic carrier particles each having at least porous magnetic core particles and a resin, in which, in a backscattered electron image of the magnetic carrier particles, photographed with a scanning electron microscope as taken at an accelerating voltage of 2.0 kV, magnetic carrier particles having area proportion $S_1$ found from a specific expression (1) of from 0.5 area % or more to 8.0 area % or less are in a proportion of 8.0% by number or more in the magnetic carrier, an average proportion $Av_1$ of the total area of portions having a high luminance which come from a metal oxide on the magnetic carrier particles to the total projected area of the magnetic carrier particles is from 0.5 area % or more to 8.0 area % or less, and an average proportion $Av_2$ found from a specific expression (2) is 10.0 area % or less.

11 Claims, 10 Drawing Sheets

MAGNETIC CARRIER AND TWO-COMPONENT DEVELOPER

This application is a continuation of International Application No. PCT/JP2009/064089, filed Aug. 4, 2009, which claims the benefit of Japanese Patent Application No. 2008-201074, filed Aug. 4, 2008.

BACKGROUND OF THE INVENTION

1. Field of the Invention

This invention relates to a magnetic carrier contained in a developer used in electrophotography and electrostatic recording, and a two-component developer having this magnetic carrier and a toner.

2. Description of the Related Art

Developing systems of electrophotography include a one-component developing system, which makes use of a toner only, and a two-component developing system, which makes use of a toner and a magnetic carrier in blend. In the two-component developing system, a magnetic carrier that is a charge-providing member and a toner are blended and used as a two-component developer. The two-component developer provides so many opportunities of contact between the charge-providing member magnetic carrier and the toner as to promise stable triboelectric charge characteristics, and is admitted to be advantageous to the maintenance of high image quality. Also, the magnetic carrier supplies the toner to developing zones, and its supply can be large and is readily controllable. Accordingly, it is often used in, in particular, high-speed machines. In order to keep electrophotographic developing systems applied to print on-demand (POD), which attracts notice in recent years, it is important for the systems to be adaptable to three basic factors, i.e., high speed, high image quality and low running cost. Further, taking account of the application of two-component developers to the POD market, two-component developers are desired which enable reproduction of images which are free of any image defects in images reproduced in print, high in quality level and free of any variations in color tone and density over a long period of time.

Japanese Patent Laid-open Application No. H04-93954 discloses a proposal of a magnetic carrier having surface unevenness coming from fine crystal particles of the surfaces of spherical ferrite particles, in order to keep any image density variations from occurring because of long-term service. This is a magnetic carrier the cores of which have been so coated with a resin that their hills (or protrusions) may come bare to the surfaces, and which can be small in environmental dependency and be small in image density variations even in long-term service. However, this magnetic carrier has apparent density which is so as high as 2.66 g/cm$^3$ that the carrier may heavily be stressed in a high-speed development process which is adaptable to the POD. Also, because of its coat resin layers designed to be small in thickness, it has come about that the magnetic carrier becomes low in electrical resistance because of scrape-off of the coat resin. Still also, the coat resin binds directly with spherical ferrite cores, and hence the coat resin and the cores may have an insufficient adherence between them, so that the coat resin may come to come off to make the magnetic carrier have a low electrical resistance. In such a case, especially when the two-component developer is left to stand for a long term in a high-temperature and high-humidity environment after long-term service, it may cause fog or great image density variations. In addition, a phenomenon that electric charges are injected from a developing sleeve into an electrostatic latent image bearing member through the magnetic carrier may come about to disturb latent images on the electrostatic latent image bearing member to make halftone areas coarse.

Accordingly, a magnetic material dispersed resin carrier is proposed, in which a magnetic material has been dispersed in a resin in order to more make the carrier lower in specific gravity and lower in magnetic force. Japanese Patent Laid-open Application No. H08-160671 discloses a proposal of a magnetic material dispersed resin carrier which is high in electrical resistance and low in magnetic force. Such a carrier can achieve improvement in sufficiently high image quality and high minuteness and in higher durability as it has a lower specific gravity and a lower magnetic force. However, it may make the toner have a low developing performance. The factor of a lowering of developing performance is that a low electrode effect results because the carrier becomes higher in electrical resistance. As the result, the toner at the rear end of a halftone area may come scraped off at the boundary between a halftone image area and a solid image area to make white lines, to cause image defects in which edges of solid image areas stand emphasized (hereinafter "blank areas").

As a replacement for such a magnetic material dispersed resin carrier, Japanese Patent Laid-open Application No. 2006-337579 (Japanese Patent No. 4001606) also discloses a proposal of a resin-filled ferrite carrier having a void of from 10% to 60% and filled in its voids with a resin. Japanese Patent Laid-open Application No. 2007-57943 further discloses a proposal of a carrier the porous ferrite core material of which is filled in its voids with a resin and the structure of which has been specified.

In these proposals, porous ferrite cores are filled in their voids with a resin to make the magnetic carrier have a low specific gravity and a low magnetic force. Making the magnetic carrier have a low specific gravity and a low magnetic force brings an improvement in its durability and enables achievement of high image quality. However, it may make the toner have an inferior developing performance. The factor of a lowering of developing performance is that a low electrode effect results because the magnetic carrier becomes higher in electrical resistance. As the result, like the above, the toner at the rear end of a halftone area may come scraped off at the boundary between a halftone area and a solid area to make white lines, to cause image defects in which edges of solid areas stand emphasized (hereinafter "blank areas"). Also, in order to compensate any deficiency in developing performance, the Vpp (peak-to-peak voltage) of a development bias that is an alternating bias voltage may be set high, where the deficiency in developing performance can be compensated. In this case, however, a phenomenon of faulty images may occur in which ring-like or spot-like patterns appear on recording sheets. In addition, in general, upon flying of the toner from magnetic carrier particle surfaces in the process of development, electric charges having a polarity reverse to that of the toner are generated on the magnetic carrier particle surfaces. This is called counter charges. As the magnetic carrier becomes higher in electrical resistance, counter charges having come accumulated on the magnetic carrier particles become difficult to move to the developer carrying member side. Hence, any counter charges remaining on the magnetic carrier particle surfaces and the electric charges of the toner may attract each other to produce a large adhesion, so that the toner may become difficult to fly from the magnetic carrier particles, resulting in a low image density.

Thus, how to improve the stability and stress resistance of the two-component developer has been studied, but a two-component developer is long-awaited which can satisfy developing performance and running stability and can provide, over a long period of time, high-quality images free of any image defects.

SUMMARY OF THE INVENTION

An object of the present invention is to provide a magnetic carrier and a two-component developer which have resolved the above problems.

Another object of the present invention is to provide a magnetic carrier and a two-component developer which enable formation of high-quality images over a long period of time.

Still another object of the present invention is to provide a magnetic carrier and a two-component developer which can achieve stable developing performance and may cause less variation in image density, over a long period of time, and can keep blank areas and carrier sticking from occurring and keep fog from occurring even after long-term storage in a high-temperature and high-humidity environment.

The present invention provides a magnetic carrier which has magnetic carrier particles, each magnetic carrier particle having at least a porous magnetic core particle and a resin, wherein; in a backscattered electron image of the magnetic carrier particles, photographed with a scanning electron microscope as taken at an accelerating voltage of 2.0 kV; magnetic carrier particles having area proportion $S_1$ of from 0.5 area % or more to 8.0 area % or less are in a proportion of 80% by number or more in the magnetic carrier; the area proportion $S_1$ being found from the following expression (1): $S_1$=(the total area of portions having a high luminance which come from a metal oxide on one particle of the magnetic carrier particles/the total projected area of that particle)×100 (1); in the magnetic carrier, an average proportion $Av_1$ of the total area of portions having a high luminance which come from the metal oxide on the magnetic carrier particles to the total projected area of the magnetic carrier particles is from 0.5 area % or more to 8.0 area % or less; and in the magnetic carrier, an average proportion $Av_2$ found from the following expression (2) is 10.0 area % or less: $Av_2$=(the total area of portions having a high luminance which come from the metal oxide on the magnetic carrier particles and being portions the domains for which each have an area of 6.672 $\mu m^2$ or more/the total area of portions having a high luminance which come from the metal oxide of the magnetic carrier particles)×100 (2).

The present invention also provides a two-component developer which contains at least a magnetic carrier and a toner; the magnetic carrier being the above magnetic carrier.

The use of the magnetic carrier and two-component developer of the present invention enables image defects to be kept from occurring and enables high-quality images to be obtained over a long period of time.

Further features of the present invention will become apparent from the following description of exemplary embodiments with reference to the attached drawings.

BRIEF DESCRIPTION OF THE DRAWINGS

FIGS. 7A and 7B are schematic sectional views of an instrument for measuring specific resistance of the magnetic carrier of the present invention, its magnetic core particle and the like. FIG. 7A is a view showing a blank state before a sample is put into the instrument, and FIG. 7B is a view showing a state in which a sample has been put thereinto.

DESCRIPTION OF THE EMBODIMENTS

Figure 1:
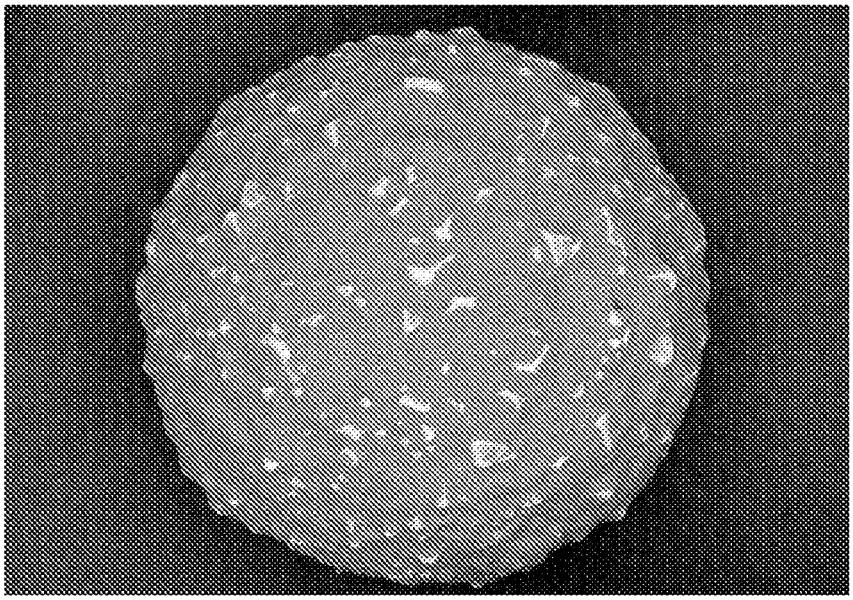
FIG. 1 shows an example of a projected image taken by chiefly making backscattered electrons visible, of a magnetic carrier particle in the magnetic carrier of the present invention.

Embodiments for practicing the present invention are described below in detail.

The magnetic carrier of the present invention is a magnetic carrier which has magnetic carrier particles, each magnetic carrier particle having at least a porous magnetic core particle and a resin, where, in a backscattered electron image of the magnetic carrier particles, photographed with a scanning electron microscope as taken at an accelerating voltage of 2.0 kV, magnetic carrier particles having area proportion $S_1$ of from 0.5 area % or more to 8.0 area % or less are in a proportion of 80% by number or more in the magnetic carrier; the area proportion $S_1$ being found from the following expression (1):

$S_1$=(the total area of portions having a high luminance which come from a metal oxide on one particle of the magnetic carrier particles/the total projected area of that particle)×100 (1);

in the magnetic carrier, an average proportion $Av_1$ of the total area of portions having a high luminance which come from the metal oxide on the magnetic carrier particles to the total projected area of the magnetic carrier particles is from 0.5 area % or more to 8.0 area % or less; and in the magnetic carrier, an average proportion $Av_2$ found from the following expression (2) is 10.0 area % or less:

$Av_2$=(the total area of portions having a high luminance which come from the metal oxide on the magnetic carrier particles and being portions the domains for which each have an area of 6.672 $\mu m^2$ or more/the total area of portions having a high luminance which come from the metal oxide of the magnetic carrier particles)×100 (2).

Such a magnetic carrier can achieve stable developing performance and may cause less variation in image density over a long period of time, and can keep blank areas and carrier sticking from occurring and keep fog from occurring even after long-term storage in a high-temperature and high-humidity environment.

In the magnetic carrier of the present invention, it is also preferable that an average proportion $Av_3$ found from the following expression (3) is 60.0 area % or more:

$Av_3$=(the total area of portions having a high luminance which come from the metal oxide on the magnetic carrier particles and being portions the domains for which each have an area of 2.780 $\mu m^2$ or less/the total area of portions having a high luminance which come from the metal oxide of the magnetic carrier particles)×100 (3).

The above effect can especially be remarkable when the average proportion $Av_3$ is 60.0 area % or more.

The reason why the magnetic carrier of the present invention brings out such a superior effect is uncertain, and the present inventors presume it as stated below.

The magnetic carrier of the present invention is one in which the portions having a high luminance which come from the metal oxide on the magnetic carrier particles are optimally distributed on the surfaces of magnetic carrier particles each having at least a conductive porous magnetic core particle and a resin. The area of the portions having a high luminance which come from the metal oxide in the present invention is, in an image taken by chiefly making backscattered electrons visible (FIG. 1), at a stated accelerating voltage of a scanning electron microscope, the area of portions having a high luminance (which look white and bright on the image), which are porous magnetic core particle portions observed in such a way that they stand bare to the surface of a magnetic carrier particle (that is, standing bare to the surface or standing covered with a very thin coat layer). The magnetic carrier of the present invention is one achievable of the above objects by specifying the proportion the portions having a high luminance which come from the metal oxide present holds on the magnetic carrier particle surface and specifying the area distribution, and frequency, of the portions having a high luminance which come from the metal oxide.

In the magnetic carrier of the present invention, the magnetic carrier particles having area proportion $S_1$ of from 0.5 area % or more to 8.0 area % or less are in a proportion of 80% by number or more in the magnetic carrier; the area proportion S1 being found from the following expression (1):

$S_1$=(the total area of portions having a high luminance which come from a metal oxide on one particle of the magnetic carrier particles/the total projected area of that particle)×100 (1).

In the case when the magnetic carrier particles satisfying the above expression (1) is used, a magnetic brush made low in electrical resistance acts as an electrode, and hence the "electrode effect" makes large the force of an electric field that acts on the toner. As the result, the toner can readily fly to come improved in developing performance, as so presumed. Also, the area of the portions having a high luminance which come from the metal oxide stands controlled appropriately, and hence any counter charges remaining on the surfaces of magnetic carrier particles after the flying of the toner can quickly be attenuated, and the toner is more improved in developing performance. As long as the magnetic carrier particles satisfying the above expression (1) are in a proportion of 80% by number or more in the magnetic carrier, the above effect can sufficiently be obtained.

In the magnetic carrier of the present invention, the average proportion $Av_1$ of the total area of the portions having a high luminance which come from the metal oxide on the magnetic carrier particles to the total projected area of the magnetic carrier particles is from 0.5 area % or more to 8.0 area % or less, and may preferably be from 2.0 area % or more to 5.5 area % or less. That the average proportion $Av_1$ is within the above range enables the counter charges to be quickly attenuated, and the toner is improved in developing performance.

If the average proportion $Av_1$ is smaller than 0.5 area %, the counter charges may come accumulated on the magnetic carrier particles to make the electrostatic adhesion large between the toner and the magnetic carrier particles, and hence the image density may decrease.

If on the other hand the average proportion $Av_1$ is larger than 8.0 area % to the total projected area of the magnetic carrier particles, electric charges may come injected into the electrostatic latent image bearing member through the portions having a high luminance which come from the metal oxide, so that the electrostatic latent images may be disturbed to make images coarse in halftone areas.

In addition, in the magnetic carrier of the present invention, the average proportion $Av_2$ found from the following expression (2) is 10.0 area % or less:

$Av_2$=(the total area of portions having a high luminance which come from the metal oxide on the magnetic carrier particles and being portions the domains for which each have an area of 6.672 $\mu m^2$ or more/the total area of portions having a high luminance which come from the metal oxide of the magnetic carrier particles)×100 (2).

Such a magnetic carrier that has the value of $Av_2$ within this range can keep triboelectric charge quantity from lowering even where it has been left to stand after long-term service in a high-temperature and high-humidity environment. On the magnetic carrier particle surfaces, the portions having a high luminance which come from the metal oxide which are present in the form of broad domains are made small in number. This can keep triboelectric charging from loosening between the toner and the carrier. Hence, such a magnetic carrier can keep triboelectric charge quantity from lowering when used for a long term in a high-temperature and high-humidity environment and then left to stand, as so presumed. From this fact as well, it is most preferable that the portions having a high luminance which come from the metal oxide and being 6.672 $\mu m^2$ or more in domain area are not present.

If the average proportion $Av_2$ is more than 10.0 area %, the triboelectric charge quantity may lower to tend to cause faulty images such as fog when used for a long term in a high-temperature and high-humidity environment and then left to stand there.

In the magnetic carrier of the present invention, it is also preferable that the average proportion $Av_3$ found from the following expression (3) is 60.0 area % or more:

$Av_3$=(the total area of portions having a high luminance which come from the metal oxide on the magnetic carrier particles and being portions the domains for which each have an area of 2.780 $\mu m^2$ or less/the total area of portions having a high luminance which come from the metal oxide of the magnetic carrier particles)×100 (3).

In the case when the above $Av_3$ is 60.0 area % or more (that is, the portions having a high luminance which come from the metal oxide which are present in the form of narrow domains are made large in area proportion), the toner can have a superior developing performance, may cause less variation in image density, and can provide images free of image defects such as blank area and carrier sticking. It is most preferable that the portions having a high luminance which come from the metal oxide and being 2.780 $\mu m^2$ or less in domain area are 100 area % in proportion.

In the magnetic carrier the $Av_3$ of which is 60.0 area % or more, the portions having a high luminance which come from the metal oxide can surely have contact points between magnetic carrier particles themselves that form the magnetic brush on a developer carrying member. Inasmuch as the magnetic carrier particles have contact points between themselves at the portions having a high luminance which come from the low-resistant metal oxide, conducting paths from the magnetic carrier particle surfaces on the electrostatic latent image bearing member side to the developer carrying member are formed by the magnetic brush. Hence, during development as well, the conducting paths from the magnetic carrier particle surfaces to the developer carrying member are secured, so that the counter charges having come generated on the magnetic carrier particle surfaces can be attenuated at once.

It is also preferable that the portions having a high luminance which come from the metal oxide as those on the projected plane of a backscattered electron image taken at an accelerating voltage of 2.0 kV have an average area value of from 0.45 $\mu m^2$ or more to 1.40 $\mu m^2$ or less, and much preferably of from 0.70 $\mu m^2$ or more to 1.00 $\mu m^2$ or less. Where the portions having a high luminance which come from the metal oxide as those on the projected plane of a backscattered electron image taken at an accelerating voltage of 2.0 kV have average area value within this range, the counter charges having come generated on the magnetic carrier particle surfaces can be attenuated at once, and the toner is more improved in developing performance.

Here, the portions having a high luminance which come from the metal oxide as those on the projected plane of a backscattered electron image as photographed with a scanning electron microscope at the stated accelerating voltage refer to portions observed as portions having a high luminance (which look white and bright on the image) in the image taken by chiefly making backscattered electrons visible (FIG. 1). The scanning electron microscope is an instrument that makes visible the surface or compositional information of a sample by irradiating the sample with accelerated electron rays and detecting secondary electrons or backscattered electrons coming emitted from the sample. In observation with the scanning electron microscope, the amount of backscattered electrons coming emitted from the sample is known to be larger for heavier elements. For example, in the case of a sample in which an organic compound and iron stand distributed on the plane, the amount of emission of backscattered electrons from the iron is large, and hence iron portions look bright (high in luminance, or white) on the image. On the other hand, the amount of emission of backscattered electrons from the organic compound, which is made up of light elements, is not large, and hence its portions look dark (low in luminance, or black) on the image.

On the surfaces of the magnetic carrier particles, there are resin portions formed of an organic compound and the portions having a high luminance which come from the metal oxide. The portions having a high luminance which come from the metal oxide are in such a state that the surface of the metal oxide is laid bare or the metal oxide is thin covered with the resin, and are portions where the magnetic carrier particles have a low electrical resistance on their surfaces. In the backscattered electron image of the magnetic carrier particles in the present invention, the portions that are in the state that the surface of the metal oxide is laid bare or the metal oxide is thin covered with the resin look bright and, conversely, the portions where the resin is thick present look dark. Thus, these are obtained as a projected image having a great difference in contrast on the image.

Figure 2:
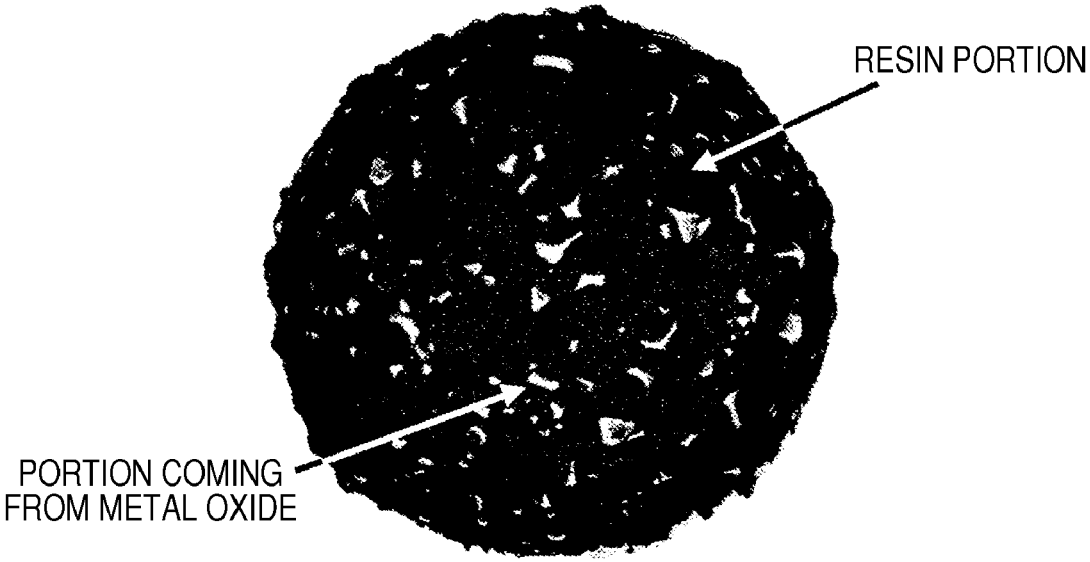
FIG. 2 is a diagrammatic view illustrating the surface state of the magnetic carrier particle shown in FIG. 1.

FIG. 2 diagrammatically shows distribution of i) the portions having a high luminance where the surface of the metal oxide at the magnetic carrier particle surface shown in FIG. 1 stands laid bare or stands thin covered with the resin and ii) the portions where the resin is thick present. White portions are the portions where the surface of the metal oxide stands laid bare or stands thin covered with the resin, and black portions correspond to the portions where the resin is thick present.

Figure 3:
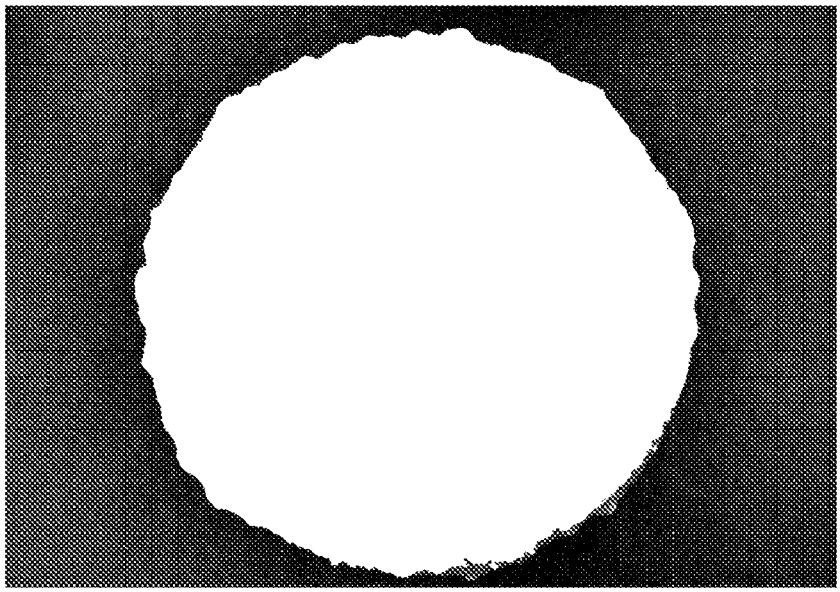
FIG. 3 is an example showing a state in which the magnetic carrier particle shown in FIG. 1 is image-processed to extract the magnetic carrier particle.
Figure 4:
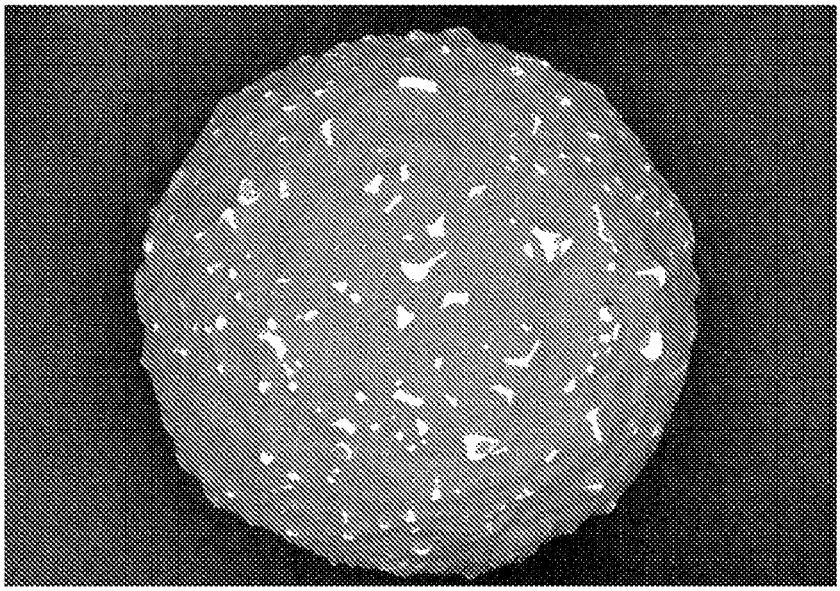
FIG. 4 is an example showing a state in which the magnetic carrier particle shown in FIG. 1 is image-processed to extract the portions coming from a metal oxide on the surface of the magnetic carrier particle.

In the present invention, a magnetic carrier particle is extracted from the projected image of the magnetic carrier in FIG. 1, and the projected area of the magnetic carrier particle is found. A particle image standing blank in white in FIG. 3 shows a particle image extracted as a magnetic carrier particle image from the projected image in FIG. 1. Subsequently, from the projected image in FIG. 1, the portions having a high luminance which come from the metal oxide are extracted (FIG. 4). In FIG. 4, places standing blank in white represent the portions having a high luminance which come from the metal oxide. The area of the magnetic carrier particle and the area of the portions having a high luminance which come from the metal oxide are each found by image processing. Next, the proportion of the area of the portions having a high luminance which come from the metal oxide, held in the projected area of the magnetic carrier particles, and the area distribution of the portions having a high luminance which come from the metal oxide are calculated. (Conditions for observation by the scanning electron microscope, conditions for photographing and the procedure of image processing are described later in detail.) Also, in practice, whether the portions shining in white are i) the portions having a high luminance which come from the metal oxide, ii) the surfaces of the metal oxide standing laid bare or iii) the metal oxide portions standing thin covered with the resin can be ascertained with an elementary analyzer attached to the scanning electron microscope.

In the magnetic carrier of the present invention, it is also preferable that the average proportion $Av_1$ of the total area of the portions having a high luminance which come from the metal oxide on the magnetic carrier particles to the total projected area of the magnetic carrier particles in the backscattered electron image as photographed with the scanning electron microscope at an accelerating voltage of 2.0 kV and an average proportion $Av_4$ of the total area of the portions having a high luminance which come from the metal oxide on the magnetic carrier particles to the total projected area of the magnetic carrier particles in the backscattered electron image as photographed with the scanning electron microscope at an accelerating voltage of 4.0 kV satisfy the relationship of the following expression (4):

$$1.00 \leqq Av_4/Av_1 \leqq 1.30 \quad (4).$$

Where they satisfy the relationship of the expression (4), variations in charge quantity due to long-term service can be smaller.

Figure 5:
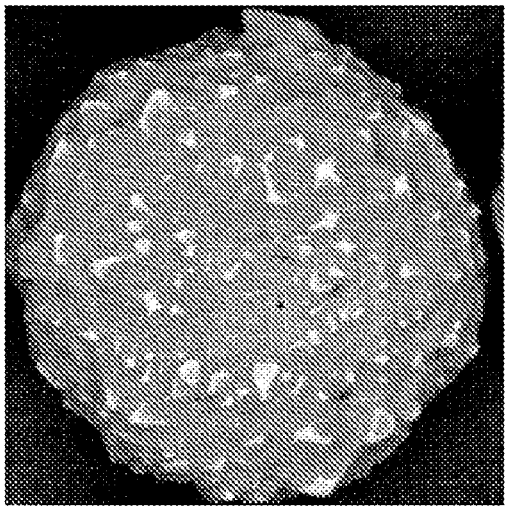
FIG. 5 is an example presenting a projected image taken by chiefly making backscattered electrons visible which have been emitted from a magnetic carrier particle in the present invention, under conditions of an accelerating voltage of 2.0 kV.
Figure 6:
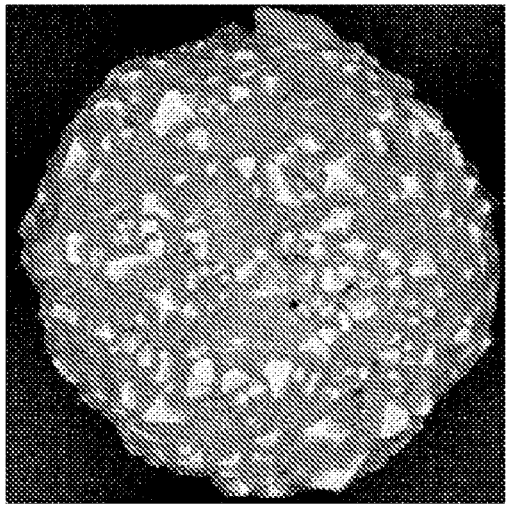
FIG. 6 is an example presenting a projected image taken by chiefly making backscattered electrons visible which have been from a magnetic carrier particle in the present invention, under conditions of an accelerating voltage of 4.0 kV.

The accelerating voltage of the scanning electron microscope may be changed from 2.0 kV to 4.0 kV, and this enables observation of backscattered electrons coming emitted from deeper portions (interiors) of the sample to be observed. As can be seen from comparison between an image (FIG. 5) taken by chiefly making backscattered electrons visible, at the accelerating voltage of 2.0 kV, and an image (FIG. 6) taken by chiefly making backscattered electrons visible, at the accelerating voltage of 4.0 kV, observation may be made under conditions different in accelerating voltage to thereby take the state of presence, or the distribution, of metal oxide portions thin covered with the resin in the depth direction of the magnetic carrier particles, and the difference in shape of the porous magnetic core particles.

Satisfying the relationship of the expression (4) means that the metal oxide porous magnetic core particles less changes in their shape from the surfaces up to interiors of the magnetic carrier particles. In this case, the portions having a high luminance which come from the metal oxide on the magnetic carrier particles may less change in their area or area distribution even if surface layers of the magnetic carrier particles have been scraped off up to the vicinity of a deepest portion to which the electrons accelerated at the accelerating voltage of 4.0 kV may come. That is, it follows that the resin the magnetic carrier has is present up to deeper portions of porous magnetic core particles in the direction toward their centers. Thus, the resin and the porous magnetic core particles can come into contact with each other in a large area, and hence the resin is kept from coming off the porous magnetic core particle surfaces. Hence, even as a result of long-term service, the surfaces of the magnetic carrier particles may less change in state to make their triboelectric charge-providing ability less vary.

In the porous magnetic core particles of the magnetic carrier of the present invention, an electric-field intensity on the verge of breakdown is from 300 V/cm or more to 1,500 V/cm or less as measured by a specific-resistance measuring method described later. Where the electric-field intensity on the verge of breakdown of the porous magnetic core particles is from 300 V/cm or more to 1,500 V/cm or less, the magnetic carrier can be one promising a developing performance high enough to enable development at a low Vpp, and at the same time can remedy image defects such as blank area.

Usually, upon flying of the toner from the magnetic carrier particles at the time of development, the counter charges are generated on the magnetic carrier particle surfaces. Accumulation of such counter charges makes electrostatic adhesion large between the toner and the magnetic carrier particles to cause a decrease in image density. Further, the counter charges act as a force that draws back the toner having once participated in development on the electrostatic latent image bearing member, to the magnetic carrier side, and hence may more cause blank areas. Accordingly, the counter charges having come generated on the magnetic carrier particle surfaces must quickly be attenuated.

The porous magnetic core particles of the magnetic carrier of the present invention brings out a higher developing performance in spite of a high triboelectric charge quantity when the electric-field intensity on the verge of breakdown is from 300 V/cm or more to 1,500 V/cm or less as measured by a specific-resistance measuring method described later. This makes the effect of remedying blank areas more remarkable. The breakdown in the present invention will be explained later in detail. The "breakdown" is defined as "the flowing of excess current when an electric field is applied at a certain or higher intensity". The porous magnetic core particles are considered to have come low in resistance at a stretch upon application of an electric field at a certain or higher intensity. That is, it is presumed that, even at the time of development, where a high development electric field is applied, the magnetic carrier having the porous magnetic core particles of the present invention comes low in resistance temporarily and transitionally at the time of development. Also, once the development is completed in the development zone and the magnetic carrier having the porous magnetic core particles comes separated from the development zone, its resistance returns to previous one, and hence it does not come about the charge-providing ability of the carrier itself is damaged. Hence, the counter charges can smoothly be leaked to the developer carrying member through the magnetic carrier particles having come low in resistance. Thus, the counter charges can quickly be attenuated without damaging the charge-providing ability to toner of the carrier itself and while utilizing the toner having a high triboelectric charge quantity, enjoying a high developing performance, so that the blank areas have been remedied, as so considered.

It is preferable for the porous magnetic core particles of the magnetic carrier of the present invention not to break down at an electric-field intensity of up to 300 V/cm and to break down at an electric-field intensity of more than 1,500 V/cm. This is much preferable because a superior developing performance can be achieved and the image defects such as blank area can be prevented.

The breakdown is explained here. The specific resistance is measured with an instrument schematically shown in FIGS. 7A and 7B. As the instrument, an electrometer (e.g., KEITHLEY 6517A, manufactured by Keithley Instruments Inc.) may be used, where its electrode area is set to be 2.4 $cm^2$, and the thickness of the magnetic carrier, about 1.0 mm. Maximum applied voltage is set at 1,000 V, and automatic ranging function of the electrometer is utilized to perform screening where voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), 128 V ($2^7$ V), 256 V ($2^8$ V), 512 V ($2^9$ V) and 1,000 V (about $2^{10}$ V) are applied for 1 second for each. In that course, the electrometer judges whether or not the voltage is applicable up to 1,000 V at maximum. If any excess current flows, "VOLTAGE SOURCE OPERATE" blinks. Where "VOLTAGE SOURCE OPERATE" has blinked, the voltage is lowered to screen any applicable voltage, where the electrometer decides the maximum value of applied voltages automatically. After decision of the maximum value of applied voltages, the measurement of voltage immediately before the breakdown and the measurement of electric-field intensity immediately before the breakdown are made. The maximum value of applied voltages thus decided is divided into five (5) values, and each voltage is applied for 30 seconds, where the resistance value is measured from the current value thus measured. A method of measurement is described later in detail.

In the magnetic carrier of the present invention, the porous magnetic core particles may also preferably have a specific resistance at 300 V/cm of from $1.0\times10^6$ Ω·cm or more to $5.0\times10^8$ Ω·cm or less. Inasmuch as the porous magnetic core particles have a specific resistance of from $1.0\times10^6$ Ω·cm or more to $5.0\times10^8$ Ω·cm or less, they can, as the magnetic carrier, prevent development leak and also make the toner improved in developing performance. Further, together with the improvement in developing performance, such porous magnetic core particles can better keep the image defects such as blank area from occurring.

The specific resistance of the porous magnetic core particles may be controlled by adjusting firing conditions, in particular, oxygen concentration of a baking atmosphere, in porous magnetic core particles production steps described later.

The porous magnetic core particles are those having pores which extend from their particle surfaces to interiors. Where such core particles are used, as methods for controlling the state of presence of the resin at the magnetic carrier particle surfaces and the portions having a high luminance which come from the metal oxide, the following methods are available: (1) To make control by changing the composition or fill level of the resin to be included in the pores of the porous magnetic core particles and/or changing how to fill, coating resin composition, resin coating level and/or how to coat. (2) To carry out filling and coating treatment a plurality of times by using filling resin solutions and coating resin solutions which both differ in solid-matter concentration. (3) To control the viscosity of resin solutions during treatment. (4) To control mutual grinding between particles themselves by controlling conditions for agitating respective particles in apparatus used in respective steps. Any of these methods may also be used in combination.

Further, after the coating treatment, the surfaces of the magnetic carrier particles may be subjected to treatment. This also enables control of the state of presence of the resin and the portions having a high luminance which come from the metal oxide of the porous magnetic core particles. For example, while a rotary container having an agitating blade in its interior, such as a DRUM MIXER (manufactured by Sugiyama Heavy Industrial Co., Ltd.) is rotated, the magnetic carrier particles having been coated with the resin is heat-treated therein, during which the magnetic carrier particles are brought to mutual grinding between particles to make the surfaces of core particles bare in part. Such heat treatment in the DRUM MIXER may preferably be carried out at a temperature of 100° C. or more for 0.5 hour or more.

The porous magnetic core particles facilitate, in view of structure, easy control of the state of presence of the resin on the magnetic carrier particle surfaces. As a method for controlling the voltage of breakdown of the porous magnetic core particles, a method is available in which their internal structure is controlled by controlling raw-material composition, raw-material particle diameter, pre-treatment conditions, firing conditions and/or post-treatment conditions.

As the porous magnetic core particles, it is preferable to use ferrite particles as porous magnetic ferrite core particles.

The ferrite particles are a sintered body represented by the following formula:

$$(M1_2O)_u(M2O)_v(M3_2O_3)_w(M4O_2)_x(M5_2O_5)_y(Fe_2O_3)_z$$

wherein M1 is a monovalent metal, M2 is a divalent metal, M3 is a trivalent metal, M4 is a tetravalent metal and M5 is a pentavalent metal; and, where $u+v+w+x+y+z=1.0$, u, v, w, x and y are each $0\leqq(u,v,w,x,y)\leqq0.8$, and z is $0.2<z<1.0$.

In the formula, as the M1 to M5, they each represent at least one kind of metallic element selected from the group consisting of Li, Fe, Zn, Ni, Mn, Mg, Co, Cu, Ba, Sr, Ca, Si, V, Bi, In, Ta, Zr, B, Mo, Na, Sn, Ti, Cr, Al, Sc, Y, La, Ce, Pr, Nd, Sm, Eu, Gd, Tb, Dy, Ho, Er, Tm, Yb and Lu. For example, it may include magnetic Li type ferrites [e.g., $(Li_2O)_a(Fe_2O_3)_b$ ($0.0<a<0.4$, $0.6\leqq b<1.0$, and $a+b=1$), Mn type ferrites [e.g., $(MnO)_a(Fe_2O_3)_b$ ($0.0<a<0.5$, $0.5\leqq b<1.0$, and $a+b=1$); Mn—Mg type ferrites [e.g., $(MnO)_a(MgO)_b(Fe_2O_3)_c$ ($0.0<a<0.5$, $0.0<b<0.5$, $0.5\leqq c<1.0$, and $a+b+c=1$)]; Mn—Mg—Sr type ferrites [e.g., $(MnO)_a(MgO)_b(SrO)_u(Fe_2O_3)_d$ ($0.0<a<0.5$, $0.0<b<0.5$, $0.0<c<0.5$, $0.5\leqq d<1.0$, and $a+b+c+d=1$)]; and Cu—Zn type ferrites [e.g., $(CuO)_a(ZnO)_b(Fe_2O_3)_c$ ($0.0<a<0.5$, $0.0<b<0.5$, $0.5\leqq c<1.0$, and $a+b+c=1$)]. The above ferrites show chief elements, and may include those containing any other trace element(s).

The Mn type ferrites, the Mn—Mg type ferrites and the Mn—Mg—Sr type ferrites, which contain the Mn element, are preferred from the viewpoint of advantages that the rate of growth of crystals can readily be controlled.

The porous magnetic core particles may have a volume distribution base 50% particle diameter (D50) of from 18.0 μm or more to 68.0 μm or less. This is preferable from the viewpoint of prevention of carrier sticking and toner-spent resistance. The porous magnetic core particles having such particle diameter may be filled with a resin and coated with a resin, where their volume distribution base 50% particle diameter (D50) comes to be approximately from 20.0 μm or more to 70.0 μm or less.

The porous magnetic core particles may preferably have an intensity of magnetization at 1,000/4π (kA/m) of from 50 $Am^2/kg$ or more to 75 $Am^2/kg$ or less, in order for them to finally bring out the performance as the magnetic carrier. As the magnetic carrier, it can improve the dot reproducibility that influences image quality of halftone areas, can prevent carrier sticking and can prevent toner-spent to obtain stable images.

The porous magnetic core particles may preferably have a true specific gravity of from 4.2 $g/cm^3$ or more to 5.9 $g/cm^3$ or less in order for them to finally provide a true specific gravity favorable as the magnetic carrier.

Production steps where the ferrite particles are used as the porous magnetic core particles are described below.

Step 1 (Weighing and Mixing Step):

Ferrite raw materials are weighed out and mixed. The ferrite raw materials may include, e.g., the following: Particles of metallic elements selected from Li, Fe, Zn, Ni, Mn, Mg, Co, Cu, Sr and Ca, oxides of the metallic elements, hydroxides of the metallic elements, oxalates of the metallic elements, and carbonates of the metallic elements. An apparatus for mixing may include a ball mill, a satellite mill, Giotto mill and a vibration mill. In particular, the ball mill is preferred from the viewpoint of mixing performance.

Step 2 (Provisional Baking Step):

The ferrite raw materials thus mixed are provisionally baked at a baking temperature in the range of from 700° C. or more to 1,000° C. or less for from 0.5 hour or more to 5.0 hours or less in the atmosphere to make the raw materials into ferrite. For the baking, the following furnace may be used, for example: A burner type baking furnace, a rotary type baking furnace, or an electric furnace.

Step 3 (Grinding Step):

The provisionally baked ferrite produced in the step 2 is ground by means of a grinder. The grinder may include a crusher, a hammer mill, a ball mill, a bead mill, a satellite mill and Giotto mill.

A finely ground product of the provisionally baked ferrite may have a volume base 50% particle diameter (D50) of from 0.5 μm or more to 5.0 μm or less. In order for the ferrite finely ground product to have the above particle diameter, in, e.g., the ball mill or bead mill, it is preferable to control materials and particle diameter of balls or beads to be used and operating time. There are no particular limitations on the particle diameter of balls or beads as long as the desired particle diameter and size distribution are obtained. For example, as the balls, those having a diameter of from 5 mm or more to 60 mm may preferably be used. Also, as the beads, those having a diameter of from 0.03 mm or more to less than 5 mm may preferably be used.

The ball mill or bead mill may also be of a wet process rather than a dry process, which former can achieve a higher grinding efficiency because the ground product does not fly up in the mill. Thus, the wet process is preferred to the dry process.

Step 4 (Granulation Step):

To the ground product of the provisionally baked ferrite, water and a binder, and optionally as a pore controlling agent a blowing agent, fine resin particles or sodium carbonate are added. As the binder, polyvinyl alcohol may be used, for example.

The ferrite slurry obtained is dried and granulated by using an atomizing drying machine and in a heating atmosphere of from 100° C. or more to 200° C. or less. As the atomizing drying machine, there are no particular limitations thereon as long as the desired particle diameter of porous magnetic core particles can be attained. A spray dryer may be used, for example.

Step 5 (Main Baking Step):

Next, the granulated product is baked at from 800° C. or more to 1,400° C. or less for from 1 hour or more to 24 hours or less.

The void volume of the interiors of the porous magnetic core particles may be controlled by setting baking temperature and baking time appropriately. Making the baking temperature higher and the baking time longer makes the baking proceed, so that the void volume of the interiors of the porous magnetic core particles becomes smaller. Baking atmosphere may also be controlled, whereby the specific resistance of the porous magnetic core particles can be controlled in the preferable range. For example, oxygen concentration may be set low or a reducing atmosphere (in the presence of hydrogen) may be set up, whereby the specific resistance of the porous magnetic core particles can be made low.

Step 6 (Screening Step):

The particles thus baked are disintegrated, and thereafter may optionally be classified, or sifted with a sieve, to remove coarse particles or fine particles.

The magnetic carrier particles in the present invention may further preferably be magnetic carrier particles the porous magnetic core particles of which have been filled with a resin in at least part of their voids.

The porous magnetic core particles may have a low physical strength, depending on the void volume of their interiors. Accordingly, in order to improve the physical strength required as the magnetic carrier particles, it is preferable for the porous magnetic core particles to be filled with a resin in at least part of their voids. The resin with which the magnetic carrier particles in the present invention are to be filled may preferably be in an amount of from 6% by mass or more to 25% by mass or less, based on the mass of the porous magnetic core particles. As long as there is not much non-uniformity in resin content for each magnetic carrier particle, the porous magnetic core particles may be filled with the resin only in part of their voids in the interiors, or may be filled with the resin only in their voids at the particle surfaces and in the vicinity thereof to leave some voids in the interiors, or may completely be filled with the resin up to their voids in the interiors.

There are no particular limitations on how to fill specifically. As a method of filling the porous magnetic core particles with the resin in their voids, a method is available in which the porous magnetic core particles are impregnated with a resin solution by a coating method such as dipping, spraying, brushing or fluidized bed coating and thereafter solvent is evaporated off. As a preferable method of filling the porous magnetic core particles with the resin in their voids, a method is available in which the resin is diluted with a solvent and this is incorporated into the voids of the porous magnetic core particles. The solvent used here may be any of those capable of dissolving the resin. In the case of a resin soluble in organic solvent, the organic solvent may include toluene, xylene, cellosolve butyl acetate, methyl ethyl ketone, methyl isobutyl ketone, and methanol. Also, in the case of a water-soluble resin or an emulsion type resin, water may be used as the solvent.

There are no particular limitations on the resin with which the porous magnetic core particles are to be filled in their voids, and either of a thermoplastic resin and a thermosetting resin may be used. It may preferably be one having a high affinity for the porous magnetic core particles. The use of a resin having a high affinity makes it easy to simultaneously cover the porous magnetic core particle surfaces as well with a resin for coating when the porous magnetic core particles are filled in their voids with the resin for filling. As the resin for filling, silicone resins or modified silicone resins are preferred as having a high affinity for the porous magnetic core particles.

For example, as commercially available products, the resin for filling may include the following: As straight silicone resins, KR271, KR255 and KR152, available from Shin-Etsu Chemical Co., Ltd; and SR2400, SR2405, SR2410 and SR2411, available from Dow Corning Toray Silicone Co., Ltd. As modified silicone resins, KR206 (alkyd modified), KR5208 (acryl modified), ES1001N (epoxy modified) and KR305 (urethane modified), available from Shin-Etsu Chemical Co., Ltd; and SR2115 (epoxy modified) and SR2110 (alkyd modified), available from Dow Corning Toray Silicone Co., Ltd.

Such porous magnetic core particles only filled with the resin may also be used as the magnetic carrier. In such a case, the porous magnetic core particles may preferably be filled with it in the state the resin solution contains a charge control agent, a charge control resin or the like, in order to improve charge-providing performance to the toner.

The charge control resin may preferably be a nitrogen-containing resin in order to improve negative charge-providing performance to the toner. For positive charge-providing performance, it may preferably be a sulfur-containing resin. The charge control agent may preferably be, like the charge control resin, a nitrogen-containing compound in order to improve negative charge-providing performance to the toner. For positive charge-providing performance, it may preferably be a sulfur-containing compound. The charge control agent or the charge control resin may be added in an amount of from 0.5 part by mass or more to 50.0 parts by mass or less, based on 100 parts by mass of the resin for filling. This is preferable in order to control the charge quantity.

The magnetic carrier of the present invention may be one in which the porous magnetic core particles has been filled in their voids with the resin for filling and thereafter the magnetic carrier particles obtained are coated on their surfaces with a resin for coating. This is much preferable in order to control the area or area distribution of the portions having a high luminance which come from the metal oxide on the magnetic carrier particle surfaces. Coating the magnetic carrier particles on their surfaces with the resin is also preferable from the points of releasability of toner from the magnetic carrier particle surfaces, staining of toner or external additives against the magnetic carrier particle surfaces, charge-providing ability to toner, and control of resistance of the magnetic carrier.

There are no particular limitations on how to coat the magnetic carrier particles on their surfaces with the resin. A method is available in which the magnetic carrier particles are coated by a coating method such as dipping, spraying, brushing, dry-process coating or fluidized bed coating. In particular, the dipping is preferred as enabling the porous magnetic core particles to be appropriately laid bare to the surfaces.

The resin for coating may be in an amount of from 0.1 part by mass or more to 5.0 parts by mass or less, based on 100 parts by mass of the particles before coating. This is preferable because the portions having a high luminance which come from the metal oxide can appropriately be made present on the particle surfaces. The resin for coating may be of one kind, or may be used in the form of a mixture of various ones. The resin for coating may be the same as, or different from, the resin used for filling, and may be either of a thermoplastic resin and a thermosetting resin. The thermoplastic resin may also be mixed with a curing agent so as to be cured when used. In particular, it is preferable to use a resin having higher release properties.

As the resin used for coating, silicone resin is particularly preferred. As the silicone resin, any conventionally known silicone resin may be used. For example, as commercially available products, it may include the following: As straight silicone resins, KR271, KR255 and KR152, available from Shin-Etsu Chemical Co., Ltd; and SR2400, SR2405, SR2410 and SR2411, available from Dow Corning Toray Silicone Co., Ltd. As modified silicone resins, KR206 (alkyd modified), KR5208 (acryl modified), ES1001N (epoxy modified) and KR305 (urethane modified), available from Shin-Etsu Chemical Co., Ltd; and SR2115 (epoxy modified) and SR2110 (alkyd modified), available from Dow Corning Toray Silicone Co., Ltd.

The resin for coating may further be incorporated with particles having conductivity or particles having charge controllability, or a charge control agent, a charge control resin, a coupling agent of various types, or the like in order to control charging performance.

The particles having conductivity may include carbon black, magnetite, graphite, zinc oxide and tin oxide. Such particles may be added in an amount of from 0.1 part by mass or more to 10.0 parts by mass or less, based on 100 parts by mass of the coating resin. This is preferable in order to control the resistance of the magnetic carrier.

The particles having charge controllability may include particles of organometallic complexes, particles of organometallic salts, particles of chelate compounds, particles of monoazo metallic complexes, particles of acetylacetone metallic complexes, particles of hydroxycarboxylic acid metallic complexes, particles of polycarboxylic acid metallic complexes, particles of polyol metallic complexes, particles of polymethyl methacrylate resin, particles of polystyrene resin, particles of melamine resins, particles of phenolic resins, particles of nylon resins, particles of silica, particles of titanium oxide and particles of aluminum oxide. The particles having charge controllability may be added in an amount of from 0.5 part by mass or more to 50.0 parts by mass or less, based on 100 parts by mass of the coating resin. This is preferable in order to control triboelectric charge quantity.

The charge control agent may include Nigrosine dyes, metallic salts of naphthenic acid or higher fatty acids, alkoxylated amines, quaternary ammonium salts, azo type metallic complexes, and metallic salts of salicylic acid or metallic complexes thereof. The charge control agent may preferably be a nitrogen-containing compound in order to improve negative charge-providing performance. For positive charge-providing performance, it may preferably be a sulfur-containing compound. The charge control agent may be added in an amount of from 0.5 part by mass or more to 50.0 parts by mass or less, based on 100 parts by mass of the coating resin. This is preferable in order to make it well dispersible and control the charge quantity.

The charge control resin may be, as what is preferable for negative charge-providing performance, a resin containing an amino group or a resin into which a quaternary ammonium group has been introduced. The charge control resin may be added in an amount of from 0.5 part by mass or more to 30.0 parts by mass or less, based on 100 parts by mass of the coating resin. This is preferable in order for the resin to have both release effect and charge-providing performance.

The coupling agent may preferably be a nitrogen-containing coupling agent in order to improve negative charge-providing performance. The coupling agent may be added in an amount of from 0.5 part by mass or more to 50.0 parts by mass or less, based on 100 parts by mass of the coating resin. This is preferable in order to control the charge quantity.

The magnetic carrier of the present invention may preferably have a volume distribution base 50% particle diameter (D50) of from 20.0 μm or more to 70.0 μm or less, in view of advantages that it can keep carrier sticking and toner-spent from occurring and can stably be used even in long-term service.

The magnetic carrier of the present invention may have an intensity of magnetization at $1{,}000/4\pi$ (kA/m) of from 40 $Am^2/kg$ or more to 65 $Am^2/kg$ or less. This is preferable in order to improve dot reproducibility, prevent carrier sticking and also prevent toner-spent to obtain stable images.

The magnetic carrier of the present invention may have a true specific gravity of from 3.2 $g/cm^3$ or more to 5.0 $g/cm^3$ or less. This is preferable in order to prevent toner-spent to maintain formation of stable images over a long period of time. It may much preferably have a true specific gravity of from 3.4 $g/cm^3$ or more to 4.2 $g/cm^3$ or less, where it can well keep carrier sticking from occurring and can improve its durability.

The toner used in the two-component developer of the present invention is described next. The toner may preferably have an average circularity of from 0.940 or more to 1.000 or less. Where the toner has average circularity within this range, the carrier and the toner have good releasability between them. Here, the average circularity is what is based on circularity distribution of particles having a circle-equivalent diameter of from 1.985 μm or more to less than 39.69 μm where circularities measured with a flow type particle image analyzer having an image processing resolution of 512×512 pixels (0.37 μm×0.37 μm per pixel) in one visual field are divided into 800 in the range of circularities of from 0.200 or more to 1.000 or less to make analysis.

The use of the toner having average circularity within the above range and the magnetic carrier of the present invention in combination enables good control of the fluidity required as the developer. As the result, the toner is improved in rise of charge quantity, and, also when the developer is replenished with the toner, the toner is quickly electrostatically charged and can keep fog-at-replenishment or the like from occurring after long-term service. Also, as the result that the fluidity has appropriately been controlled, the two-component developer can have a good transport performance on the developer carrying member, the toner can well come released from the magnetic carrier and the toner can readily participate in development.

In the toner used in the present invention, it is also preferable that particles having a circle-equivalent diameter of from 0.500 μm or more to less than 1.985 μm as measured with a flow type particle image analyzer having an image processing resolution of 512×512 pixels (0.37 μm×0.37 μm per pixel) (hereinafter also "small-particle toner") are in a proportion of 30% by number or less. Such small-particle toner may preferably be in a proportion of 20% by number or less, and much preferably 10% by number or less. Where the small-particle toner are in a proportion of 30% by number or less, the carrier and the toner can well be blended in the developer container and also the small-particle toner may less adhere to the magnetic carrier particles. Hence, charge stability at the time of toner replenishment can be retained over a long period of time.

Its use in combination with the magnetic carrier of the present invention can vastly lessen any stress acting between the toner and the magnetic carrier particles in the developing assembly, and hence the small-particle toner can be more kept from adhering to the magnetic carrier particles. Accordingly, the charge stability at the time of toner replenishment can be retained over a long period of time, and the image defects such as blank area can be kept from occurring.

Further, the toner used in the present invention may preferably have a weight average particle diameter (D4) of from 3.0 μm or more to 8.0 μm or less. If the toner has a weight-average particle diameter of more than 8.0 μm, the toner and the magnetic carrier may have so high releasability between them that the developer may slip on the developer carrying member to tend to cause faulty transport. If on the other hand the toner has a weight-average particle diameter of less than 3.0 μm, the toner and the magnetic carrier may have so high adhesion between them as to cause a lowering of developing performance.

As the toner of the present invention, one having toner particles containing a binder resin and a colorant is used.

In order to achieve both storage stability and low-temperature fixing performance of the toner, the binder resin may preferably have a peak molecular weight (Mp) of from 2,000 or more to 50,000 or less, a number average molecular weight (Mn) of from 1,500 or more to 30,000 or less and a weight average molecular weight (Mw) of from 2,000 or more to 1,000,000 or less in its molecular weight distribution measured by gel permeation chromatography (GPC). It may preferably have a glass transition temperature (Tg) of from 40° C. or more to 80° C. or less.

As the colorant the toner contains, usable are any of known color pigments for magenta toner, dyes for magenta toner, color pigments for cyan toner, dyes for cyan toner, color pigments for yellow toner, dyes for yellow toner, black pigments, and those toned in black by using yellow pigments, magenta pigments and cyan pigments. It does not matter to use a pigment alone, but it is preferable from the viewpoint of image quality of full color images to use a dye and a pigment in combination so as to improve their vividness. The colorant may preferably be used in an amount of from 0.1 part by mass or more to 30 parts by mass or less, much preferably from 0.5 part by mass or more to 20 parts by mass or less, and most preferably from 3 parts by mass or more to 15 parts by mass or less, based on 100 parts by mass of the binder resin.

The toner may be incorporated with a wax, which may preferably be used in an amount of from 0.5 part by mass or more to 20 parts by mass or less, and much preferably from 2 parts by mass or more to 8 parts by mass or less, based on 100 parts by mass of the binder resin. The wax may also preferably be from 45° C. or more to 140° C. or less in peak temperature of its maximum endothermic peak. This is preferable because the toner can achieve both storage stability and hot-offset resistance.

The toner may optionally be also incorporated with a charge control agent. As the charge control agent that may be contained in the toner, any known one may be used. In particular, an aromatic carboxylic acid metal compound is preferred, which is colorless, makes the toner chargeable at a high speed and can stably retain a constant charge quantity. The charge control agent may preferably be added in an amount of from 0.2 part by mass or more to 10 parts by mass or less, based on 100 parts by mass of the binder resin.

The toner used in the present invention may preferably further contain, as an external additive, inorganic fine particles having at least one maximum value of particle size distribution in the range of from 50 nm or more to 300 nm or less in number distribution base particle size distribution, which serve as spacer particles for improving releasability between the toner and the carrier particles. In order to better keep the inorganic fine particles from liberating from toner particles while making them function as spacer particles, it is much preferable that inorganic fine particles having at least one maximum value in the range of from 80 nm or more to 150 nm or less are externally added.

To the toner, other external additive may further be added in addition to the above inorganic fine particles in order to improve its fluidity. Such an external additive may preferably be an inorganic fine powder of silica, titanium oxide or aluminum oxide. It is preferable for the inorganic fine powder to have been made hydrophobic with a hydrophobic-treating agent such as a silane compound, a silicone oil or a mixture of these. The external additive may preferably be one having at least one maximum value of particle size distribution in the range of from 20 nm or more to 50 nm or less in number distribution base particle size distribution.

The inorganic fine particles and the other external additive may preferably be in a total content of from 0.3 part by mass or more to 5.0 parts by mass or less, and much preferably from 0.8 part by mass or more to 4.0 parts by mass or less, based on 100 parts by mass of the toner particles. Of these, the inorganic fine particles may preferably be in a content of from 0.1 part by mass or more to 2.5 parts by mass or less, and much preferably from 0.5 part by mass or more to 2.0 parts by mass or less. As long as the inorganic fine particles are in a content within this range, they are more remarkable as the spacer particles.

It is also preferable for the inorganic fine particles and the other external additive to have been made hydrophobic with a hydrophobic-treating agent such as a silane compound, a silicone oil or a mixture of these.

Such hydrophobic treatment may preferably be carried out by adding to particles to be treated the hydrophobic-treating agent in an amount of from 1% by mass or more to 30% by mass or less, and much preferably from 3% by mass or more to 7% by mass or less, based on the particles to be treated.

There are no particular limitations on the extent to which the inorganic fine particles and the other external additive are made hydrophobic. For example, they may preferably have a degree of hydrophobicity of 40 or more to 98 or less after the treatment. The degree of hydrophobicity is what indicates wettability of a sample to methanol, and is an index of hydrophobicity.

The toner particles, the inorganic fine particles and the other external additive may be mixed by using a known mixing machine such as HENSCHEL-MIXER.

The toner in the present invention may be obtained by a kneading pulverization process, a dissolution suspension process, a suspension polymerization process, an emulsion agglomeration polymerization process or an association polymerization process, without any particular limitations on how to produce it.

A procedure for producing the toner by the pulverization process is described below.

In the step of mixing raw materials, as materials making up toner particles, the binder resin, the colorant, the wax and optionally other components such as the charge control agent, for example, are weighed out in stated quantities and are compounded and mixed. As examples of a mixer therefor, it includes DOUBLECON MIXER, a V-type mixer, a drum type mixer, SUPER MIXER, HENSCHEL-MIXER, NAUTA MIXER and MECHANO HYBRID (manufactured by Mitsui Mining & Smelting Co., Ltd.).

Next, the materials thus mixed are melt-kneaded to disperse the colorant and so forth in the binder resin.

In this melt kneading step, a batch-wise kneader such as a pressure kneader or BANBURY MIXER, or a continuous type kneader may be used. Single-screw or twin-screw extruders are prevailing because of an advantage of enabling continuous production. For example, usable are a KTK type twin-screw extruder (manufactured by Kobe Steel, Ltd.), a TEM type twin-screw extruder (manufactured by Toshiba Machine Co., Ltd.), PCM KNEADER (manufactured by Ikegai Corp.), a twin-screw extruder (manufactured by KCK Co.), a co-kneader (manufactured by Coperion Buss Ag.), and KNEADEX (manufactured by Mitsui Mining & Smelting Co., Ltd.).

Further, a colored resin composition obtained by the melt kneading may be rolled out by means of a twin-roll mill, followed by cooling through a cooling step by using water or the like.

Then, the cooled kneaded product obtained is pulverized in the pulverization step into a product having the desired particle diameter. In the pulverization step, the cooled kneaded product is coarsely ground by means of a grinding machine such as a crusher, a hammer mill or a feather mill, and is thereafter further finely pulverized by means of, e.g., CRIPTRON SYSTEM (manufactured by Kawasaki Heavy Industries, Ltd.), SUPER ROTOR (manufactured by Nisshin Engineering Inc.), TURBO MILL (manufactured by Turbo Kogyo Co., Ltd.) or a fine grinding machine of an air jet system.

Thereafter, the pulverized product obtained may optionally be classified by using a classifier such as ELBOW JET (manufactured by Nittetsu Mining Co., Ltd.), which is of an inertial classification system), TURBOPLEX (manufactured by Hosokawa Micron Corporation), which is of a centrifugal classification system, TSP SEPARATOR (manufactured by Hosokawa Micron Corporation), or FACULTY (manufactured by Hosokawa Micron Corporation); or a sifting machine. Thus, the toner particles are obtained.

Figure 8:
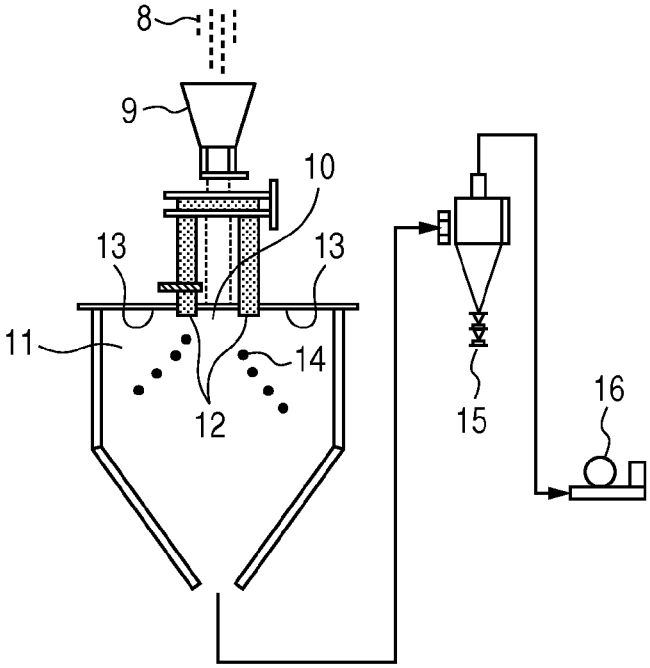
FIG. 8 is a diagrammatic view of a surface modifying apparatus usable in the present invention.

After the pulverization, the product obtained may also optionally be subjected to surface modification treatment such as treatment for making spherical, by using Hybridization system (manufactured by Nara Machinery Co., Ltd.) or Mechanofusion system (manufactured by Hosokawa Micron Corporation). For example, a surface-modifying apparatus may also be used which is as shown in FIG. 8.

Using an auto-feeder 9, toner particles 8 are fed to the interior 11 of the surface-modifying apparatus through a feed nozzle 10. Air in the interior 11 of the surface-modifying apparatus is kept sucked by means of a blower 16, and hence the toner particles 8 fed thereinto through the feed nozzle 10 are dispersed in the machine. The toner particles 8 having been dispersed in the machine are instantaneously heated by hot air flowed thereinto from a hot-air flow-in opening 12 to become surface-modified. In the present invention, the hot air is generated by a heater, to which, however, the apparatus is not particularly limited as long as hot air sufficient for the surface modification of the toner particles can be generated. Toner particles 14 having been surface-modified are instantaneously cooled by cold air flowed in from a cold-air flow-in opening 13. In the present invention, liquid nitrogen is used as the cold air, to which, however, means therefor is not particularly limited as long as the toner particles 14 having been surface-modified can instantaneously be cooled. The toner particles 14 having been surface-modified are sucked by means of the blower 16, and then collected by means of a cyclone 15.

The two-component developer may be used as an initial-stage developer, or may be used as a replenishing developer to be fed to the developing assembly after running.

When used as the initial-stage developer, the toner and the magnetic carrier may preferably be in such a blend proportion that the toner is in an amount of from 2 parts by mass or more to 35 parts by mass or less, and much preferably from 4 parts by mass or more to 25 parts by mass or less, based on 100 parts by mass of the magnetic carrier. Setting their proportion within this range can achieve high image density and can make the toner less scatter. When used as the replenishing developer, a blend proportion that the toner is in an amount of from 2 parts by mass or more to 50 parts by mass or less, based on 1 part by mass of the magnetic carrier, is preferable from the viewpoint of improvement in running performance of the developer.

How to measure various physical properties of the above magnetic carrier and toner is described below.

Area Proportion of Portions Coming from Metal Oxide on Magnetic Carrier Particle Surfaces:

The area % of the portions coming from the metal oxide on the surfaces of the magnetic carrier particles used in the present invention may be found by observation of backscattered electrons on a scanning electron microscope and by subsequent image processing.

The area proportion of the portions coming from the metal oxide on the surfaces of the magnetic carrier particles used in the present invention is measure with a scanning electron microscope (SEM) S-4800 (manufactured by Hitachi Ltd.). The area proportion of the portions coming from the metal oxide are calculated from image-processed data of images taken by chiefly making backscattered electrons visible, at an accelerating voltage of 2.0 kV.

Stated specifically, on a sample stand for observation with the electron microscope, carrier particles are so fastened with a carbon tape as to be in a single layer, and, without making any vacuum deposition using platinum, observed on the scanning electron microscope S-4800 (manufactured by Hitachi Ltd.) under the following conditions. The observation is made after flashing has been operated.

Signal name: SE (U, LA80).

Accelerating voltage: 2,000 volts.

Emission current: 10,000 nA.

Working distance: 6,000 μm.

Lens mode: High.

Condenser lens: 5 in NA.

Scan speed: Slow 4 (40 seconds).

Magnification: 600.

Data size: 1,280×960 pixels.

Color mode: Gray scale.

Figure 9:
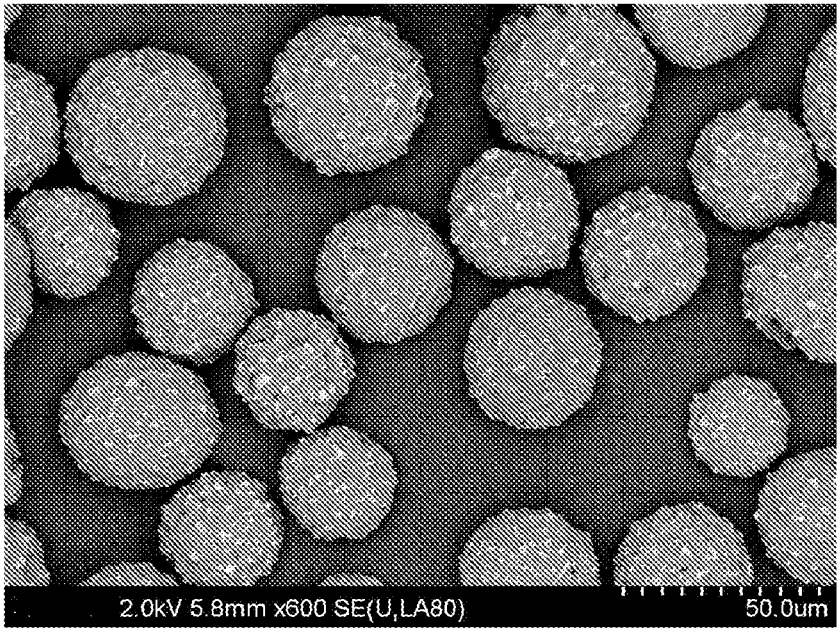
FIG. 9 is an example of a projection formed by chiefly making backscattered electrons visible at 600 magnifications, of magnetic carrier particles in the magnetic carrier of the present invention.

The backscattered electron image is controlled on control software of the scanning electron microscope S-4800 to have 'contrast: 5 and brightness: −5', and processed by setting Capture Speed and Accumulate, setting 'Slow 4' to '40 seconds' to make a gray scale image of 1,280×960 pixels in image size and having 8 bit 256 gradations to obtain a projected image of the magnetic carrier (FIG. 9). From the scale on the image, the length of 1 pixel comes to 0.1667 μm, and the area of 1 pixel, 0.0278 $\mu m^2$.

Subsequently, using the projected image obtained on the basis of backscattered electrons, the area proportion (area %) of the portions coming from the metal oxide is calculated on 50 magnetic carrier particles. How to pick up the 50 magnetic carrier particles to be analyzed is described later in detail. The area % of the portions coming from the metal oxide is calculated by using image processing software IMAGE-PRO PLUS 5.1J (available from Media Cybernetics, Inc.).

Figure 10:
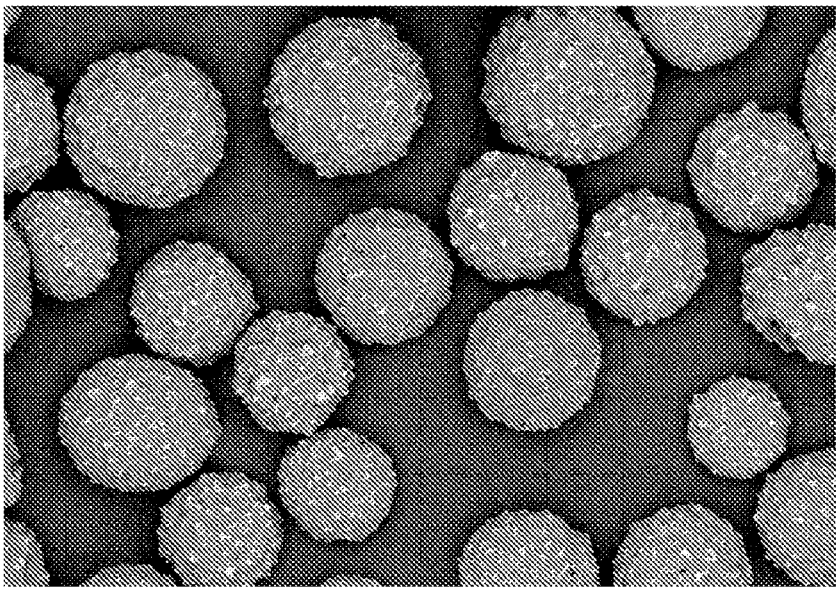
FIG. 10 is an example showing how after pre-processing of image processing the projection is which has been formed by chiefly making backscattered electrons visible, of magnetic carrier particles in the magnetic carrier of the present invention.

First, alphanumeric data at the bottom of the image in FIG. 9 are unnecessary for image processing, and this unnecessary part is deleted to cut out the image into a size of 1,280×895 (FIG. 10).

Figure 11:
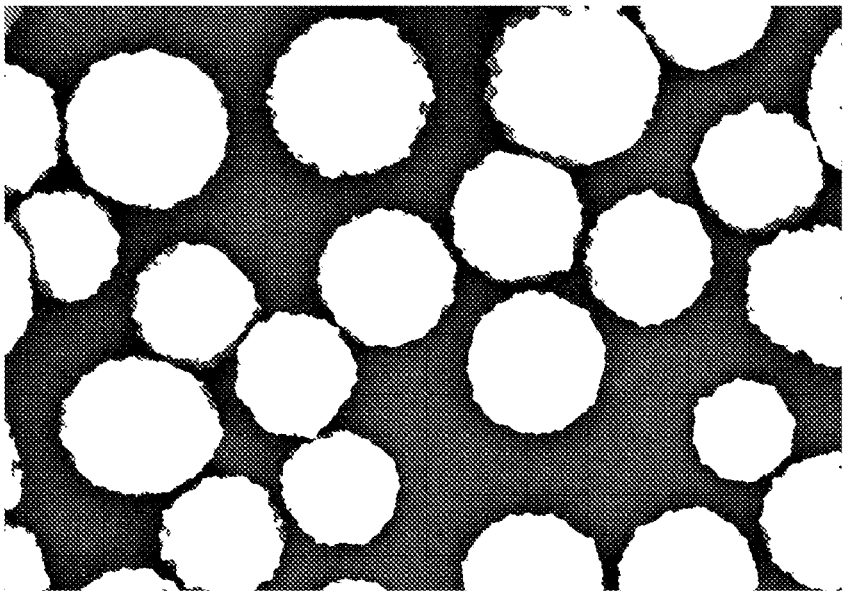
FIG. 11 is an example of a view showing a state in which magnetic carrier particles have been extracted from the projection formed by chiefly making backscattered electrons visible, of magnetic carrier particles in the magnetic carrier of the present invention.
Figure 12:
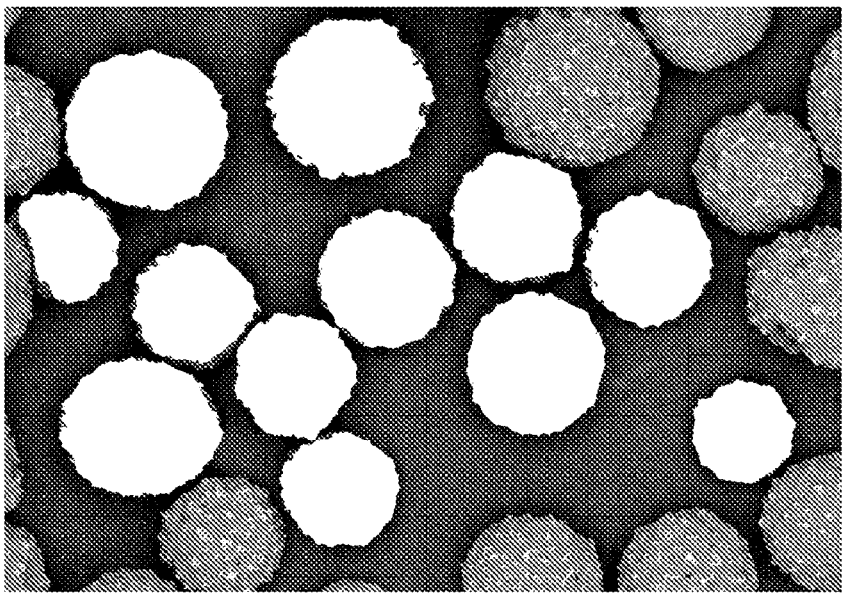
FIG. 12 is an example of a view showing a state in which magnetic carrier particles present in image peripheral areas have been removed from the magnetic carrier particles extracted from the projection formed by chiefly making backscattered electrons visible, of magnetic carrier particles in the magnetic carrier of the present invention.
Figure 13:
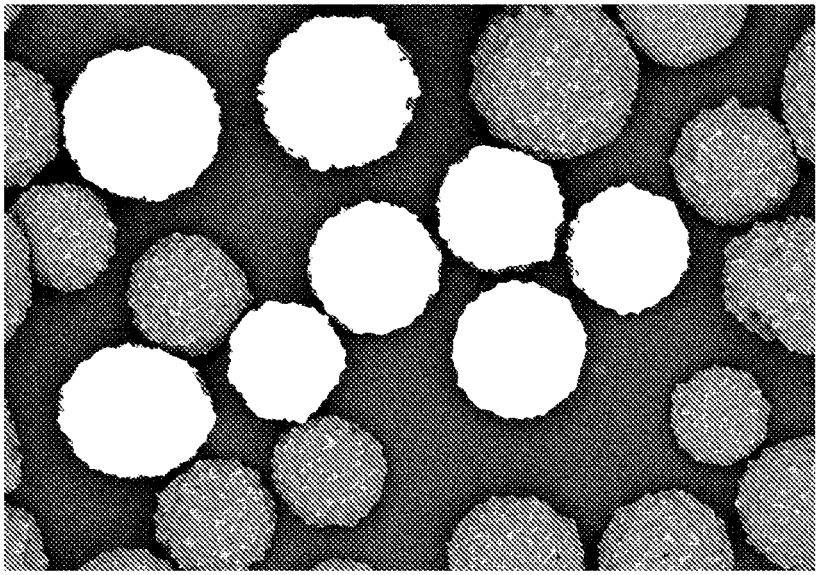
FIG. 13 is an example of a view showing a state in which particles to be image-processed have further been narrowed down according to particle diameter, from the magnetic carrier particles extracted as shown in FIG. 10.

Next, a particle image of magnetic carrier particles is extracted, and the size of the magnetic carrier particle image extracted is counted. Stated specifically, first, in order to extract some magnetic carrier particles to be analyzed, separate the magnetic carrier particles from the background part. Choose "Measurement"–"Count/Size" of Image-Pro Plus 5.1J. On "Intensity Range Selection" of "Count/Size", set the intensity range to a range of 50 to 255, and remove the low-luminance carbon tape part coming out as the background, to extract magnetic carrier particles (FIG. 11). Where magnetic carrier particles are fastened by a method other than that making use of the carbon tape, the background does not necessarily come out as a low-intensity region, or there can not be nothing about the possibility of partly giving intensity substantially equal to that of the magnetic carrier particles. However, the boundary between the magnetic carrier particles and the background is distinguishable with ease on the observation image of backscattered electrons. In performing extraction, choose 4-Connect in Object Options of the "Count/Size", input a numeral 5 for Smoothing, and put a check mark for Fill Holes to exclude from calculation any particles positioned on all boundaries (perimeters) of the image or overlapping with other particles. Next, choose Area and Ferret's Diameter (Average) on the menu of Measure of the "Count/Size", and set Filter Ranges to 300 pixels in minimum and 10,000,000 pixels in maximum (FIG. 12). As to Ferret's Diameter, set Filter Ranges so as to be in the range of ±25% of the measured value of magnetic carrier's volume distribution base 50% particle diameter (D50) described later, to extract magnetic carrier particles to be image-analyzed (FIG. 13). Chose one particle from the group of particles extracted to find the size of the part coming from that particle (the number of pixels) (ja).

Figure 14:
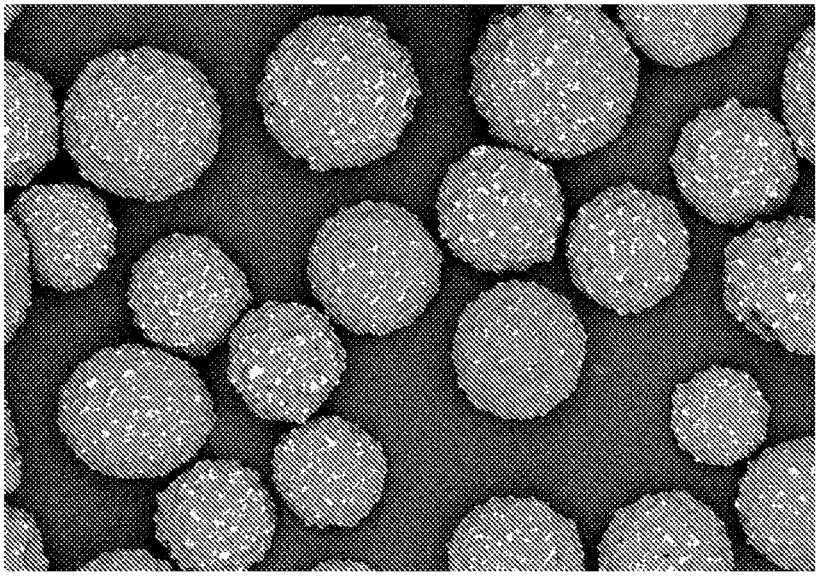
FIG. 14 is an example of a view illustrating a state in which the metal oxide on the magnetic carrier particles in the present invention has been extracted.

Next, on "Intensity Range Selection" of "Count/Size" of Image-Pro Plus 5.1J, set Intensity Ranges to a range of 140 to 255 to extract the portions having a high luminance on the magnetic carrier particles (FIG. 14). Set Filter Ranges for Area to 100 pixels in minimum and 10,000 pixels in maximum.

Then, about the particles chosen in finding the "ja", find the size of the portions coming from the metal oxide on the magnetic carrier particles (the number of pixels) (ma). In each magnetic carrier particle, the portions coming from the metal oxide are dotted in a certain size, and the "ma" is the total area of such portions. Each of the portions thus dotted is termed "domain" in the present invention.

Then, the area proportion $S_1$ according to the present invention is found by (ma/ja)×100.

Next, for the respective particles in the group of particles thus extracted, perform the like processing until the number of magnetic carrier particles chosen comes to 50. If the number of particles in one visual field comes less than 50, repeat the like operation about a projected image of magnetic carrier particles in other visual field(s).

The average proportion $Av_1$ according to the present invention is an average value found by the measurement, which may be calculated by the following expression, using a total value Ma of the "ma" measured on the 50 particles and a total value Ja of the "ja" measured on the 50 particles.

$$Av_1=(Ma/Ja)\times 100.$$

Area Distribution Based on Total Area of Portions Coming from Metal Oxide:

Area distribution of the portions coming from the metal oxide based on total area of the portions coming from the metal oxide may be found by observation of backscattered electrons on the scanning electron microscope, by image processing thereof, and by subsequent statistical processing.

In the same way as in finding the area % of the portions coming from the metal oxide, observation is made on 50 magnetic carrier particles to extract from the image the portions coming from the metal oxide in the magnetic carrier. The sizes of respective domains for the portions coming from the metal oxide which have been extracted about the part of 50 particles are found, and are proportionally divided into channels at intervals of 20 pixels. Here, the area of one pixel is 0.0278 $\mu m^2$. The middle value of each channel is taken as the representative value, and average proportion $Av_2$ (area %) of domain area standing distributed at 6.672 $\mu m^2$ or more and average proportion $Av_3$ (area %) of domain area standing distributed at 2.780 $\mu m^2$ or less are calculated.

Average Area of Portions Coming from Metal Oxide:

The above Ma is divided by the total number of the domains in the magnetic carrier 50 particles to calculate the average area of the portions coming from the metal oxide.

Rate of Change in Area of Portions Coming from Metal Oxide:

The average proportion $Av_4$ of the total area of the portions having a high luminance which come from the metal oxide on the magnetic carrier particles to the total projected area of the magnetic carrier particles in the backscattered electron image as photographed with the scanning electron microscope at an accelerating voltage of 4.0 kV is calculated in the same way as the above $Av_4$ except that, in the measurement of $Av_4$ only the accelerating voltage is changed to 4.0 kV.

Then, the rate of change in area of the portions coming from the metal oxide which change depends on differences in acceleration condition is calculated by using the following expression:

Rate of change in area of portions coming from metal oxide, depending on differences in acceleration condition=$Av_4/Av_4$.

Figure 7A:
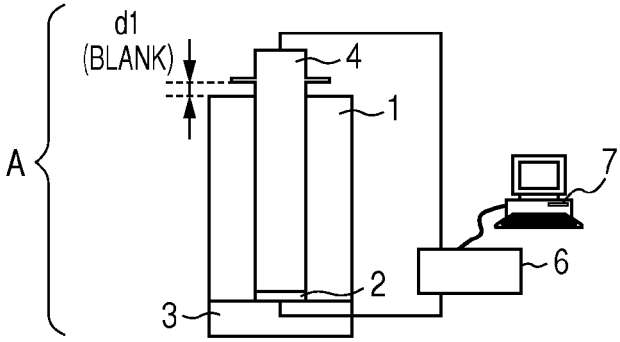
Figure 7B:
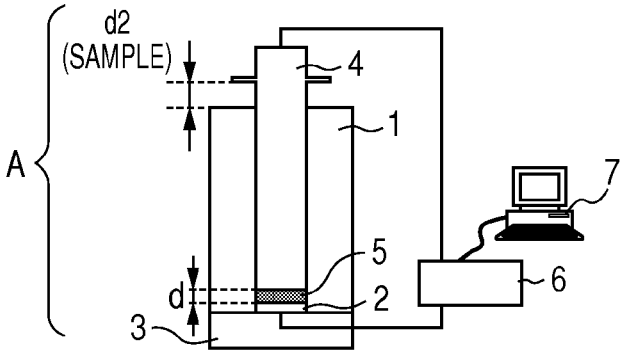

Measurement of Electric-Field Intensity on the Verge of Breakdown of Magnetic Carrier Particles and Porous Magnetic Core Particles and Specific Resistance:

The electric-field intensity on the verge of breakdown of the magnetic carrier particles and porous magnetic core particles and the specific resistance are measured with a measuring instrument shown in FIGS. 7A and 7B. In their measurement for the porous magnetic core particles, measurement is made by using a sample standing before resin filling and/or resin coating.

A resistance measuring cell A is constituted of a cylindrical PTFE resin container 1 in which a hole of 2.4 $cm^2$ in cross-sectional area is made, a lower electrode (made of stainless steel) 2, a supporting pedestal (made of PTFE resin) 3 and an upper electrode (made of stainless steel) 4. The cylindrical PTFE resin container 1 is put on the supporting pedestal 3, a sample (magnetic carrier or porous magnetic core particles) 5 is so put into it as to be in a thickness of about 1 mm, and the upper electrode 4 is placed on the sample 5 put into it, where the thickness of the sample is measured. Where, as shown in FIG. 7A, a gap formed when there is no sample is represented by d1 and, as shown in FIG. 7B, a gap formed when the sample has been so put into the container as to be in a thickness of about 1 mm is represented by d2, thickness d is calculated by using the following expression:

$$D=d2-d1.$$

At this point, it is important to appropriately change the amount of the sample in such a way that the sample may be in a thickness of 0.95 mm or more to 1.04 mm.

Then, a DC voltage is applied across the electrodes, and electric current flowing at that point may be measured to find the electric-field intensity on the verge of breakdown of the magnetic carrier particles and porous magnetic core particles and the specific resistance. In the measurement, an electrometer 6 (e.g., KEITHLEY 6517A, manufactured by Keithley Instruments Inc.) and a controlling computer 7 are used.

In the controlling computer 7, software (LABVIEW) produced by National Instruments Corporation has been installed. This software is used to perform measurement firstly and up to data processing. As conditions for measurement, an actually measured value d is so inputted that contact area S between the sample and the electrodes is 2.4 $cm^2$ and the sample is from 0.95 mm or more to 1.04 mm or less in thickness. Also, the load to the upper electrode is set at 120 g, and maximum applied voltage, 1,000 V.

As conditions for voltage application, an IEEE-488 interface is used for making control between the controlling computer and the electrometer, and automatic ranging function of the electrometer is utilized to perform screening where voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), 128 V ($2^7$ V), 256 V ($2^8$ V), 512 V ($2^9$ V) and 1,000 V are applied for 1 second for each. In that course, the electrometer judges whether or not the voltage is applicable up to 1,000 V/cm at the maximum (e.g., as electric-field intensity, 10,000 V/cm in the case of a sample thickness of 1.00 mm). If any excess current flows, "VOLTAGE SOURCE OPERATE" blinks. In such a case, the instrument lowers the voltage to further screen any applicable voltage to automatically decide the maximum value of applied voltages. Thereafter, main measurement is performed. The maximum voltage value obtained is divided into five (5) values, and the resultant voltages are retained for 30 seconds for each step, where, from the electric-current values found thereafter, resistance values are measured. For example, where the maximum applied voltage is 1,000 V, voltages are applied in such an order that the voltage is raised and thereafter dropped at intervals of 200 V that is ⅕ of the maximum applied voltage, i.e., 200 V (1st step), 400 V (2nd step), 600 V (3rd step), 800 V (4th step), 1,000 V (5th step), 1,000 V (6th step), 800 V (7th step), 600 V (8th step), 400 V (9th step) and 200 V (10th step), which are retained for seconds in the respective steps, where, from the electric-current values found thereafter, resistance values are measured.

An example of measurement for the porous magnetic core particles is given here. In making the measurement, the screening is performed first, where voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V) and 128 V ($2^7$ V) are applied for 1 second for each, whereupon the display of "VOLTAGE SOURCE OPERATE" turns on up to 64 V, and the display of "VOLTAGE SOURCE OPERATE" blinks at 128 V. Next, in such a way that it blinks at 90.5 V ($2^{6.5}$ V), turns on at 68.6 V ($2^{6.1}$ V) and blinks at 73.5 V ($2^{6.2}$ V), voltages applicable in maximum are converged. As the result, the maximum applied voltage is decided to be 69.8 V. Then, voltages are applied in the order of 14.0 V (1st step), which is the value of 1/5 of 69.8 V, 27.9 V (2nd step), which is the value of 2/5, 41.9 V (3rd step), which is the value of 3/5, 55.8 V (4th step), which is the value of 4/5, 69.8 V (5th step), which is the value of 5/5, 69.8 V (6th step), 55.8 V (7th step), 41.9 V (8th step), 27.9 V (9th step) and 14.0 V (10th step). Electric-current values found there are process on the computer to calculate the electric-field intensity and specific resistance from sample thickness 0.97 mm and electrode area, and the results obtained are plotted on a graph. In that case, five points are plotted at which the voltage is dropped from the maximum applied voltage. Here, in the measurement at each step, when "VOLTAGE SOURCE OPERATE" blinks where any excess current flows, the resistance value is displayed as 0 on measurement. This phenomenon is defined as "breakdown". This phenomenon that "VOLTAGE SOURCE OPERATE" blinks is defined as the electric-field intensity on the verge of breakdown. Thus, the point at which "VOLTAGE SOURCE OPERATE" blinks and also maximum electric-field intensity of the above profile is plotted is defined as the electric-field intensity on the verge of breakdown. Note, however, that, where the resistance value does not come to 0 and the voltage can be plotted, even though "VOLTAGE SOURCE OPERATE" blinks when the maximum applied voltage comes applied, the point where it comes is taken as the electric-field intensity on the verge of breakdown.

$$\text{Specific resistance}(\Omega\cdot\text{cm})=[\text{applied voltage (V)}/\text{measured electric current(A)}]\times S(\text{cm}^2)/d(\text{cm}).$$

$$\text{Electric-field intensity(V/cm)}=\text{applied voltage (V)}/d\ (\text{cm}).$$

Figure 15:
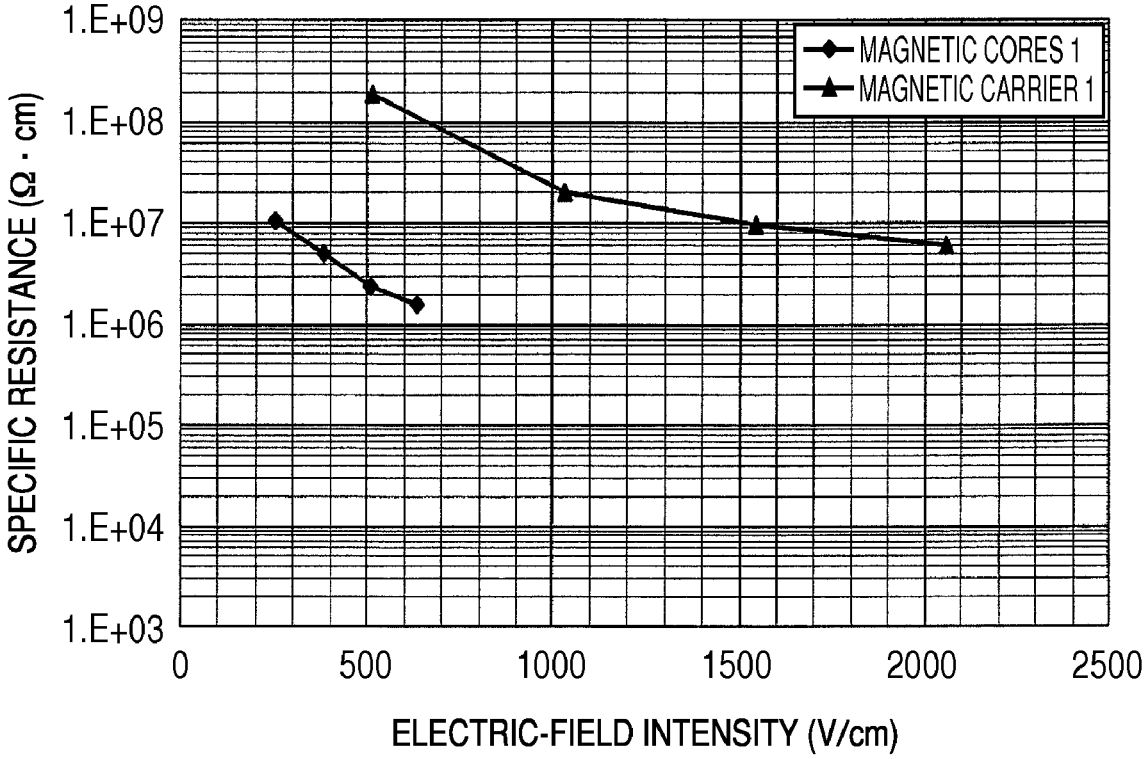
FIG. 15 is an example of a graph showing the results of measurement of specific resistance. It shows results obtained by measuring the magnetic carrier of Example 1 and magnetic core particle used therefor.
Figure 16:
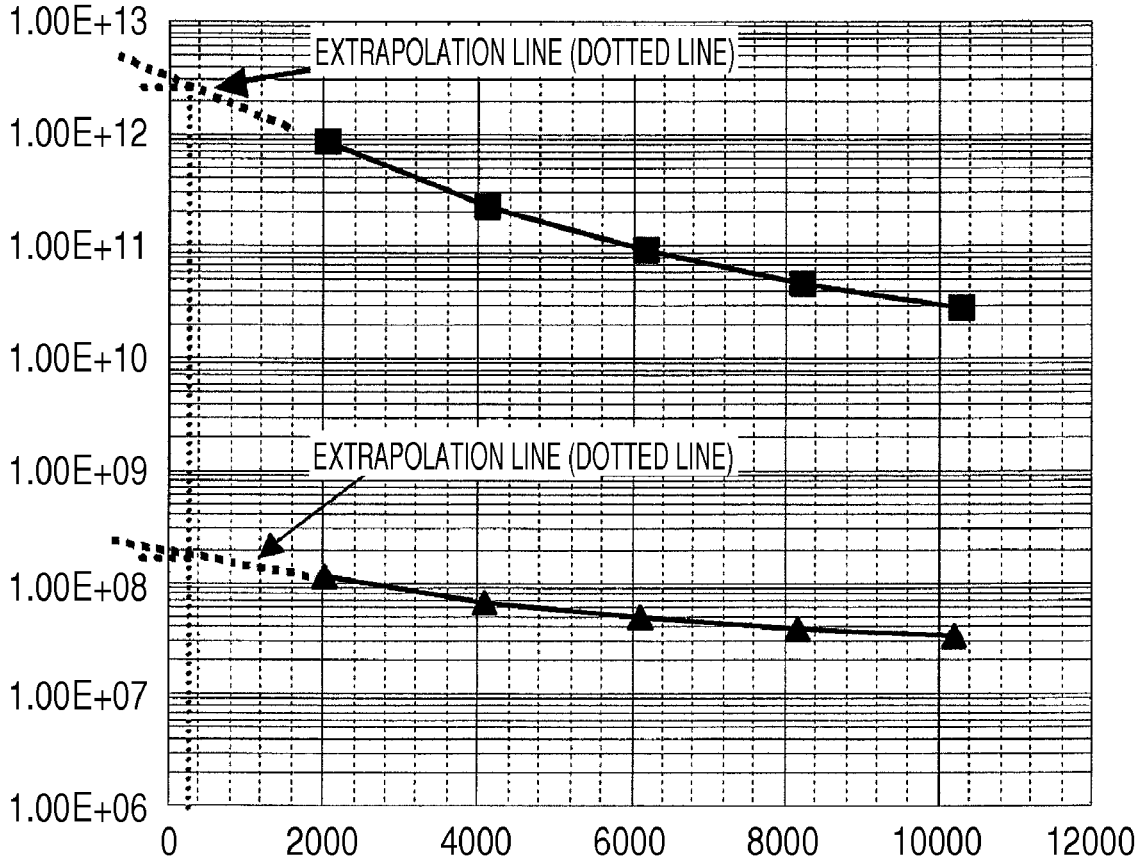
FIG. 16 is a graph presenting how to extrapolate electric-field intensity.
Figure 17:
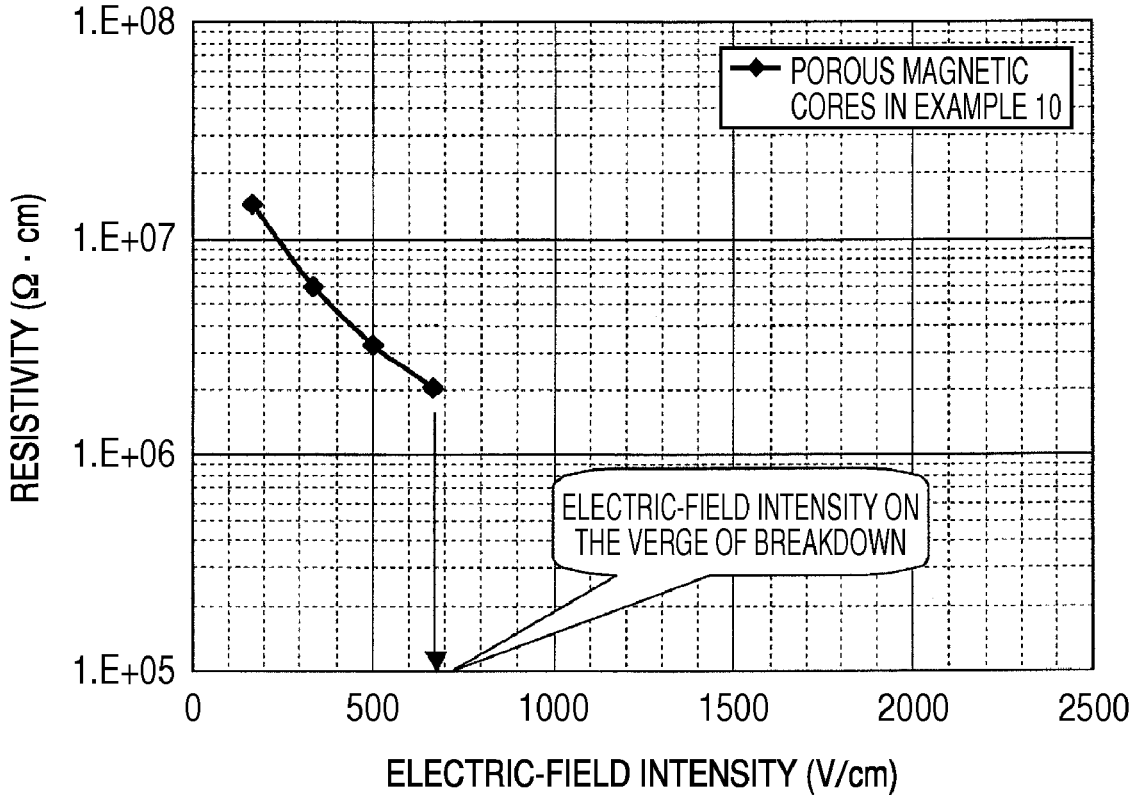
FIG. 17 is a graph illustrating "electric-field intensity on the verge of breakdown".

As to the specific resistance of the porous magnetic core particles at the electric-field intensity of 300 V/cm, the specific resistance at electric-field intensity of 300 V/cm on the graph is read from the graph. Results obtained by plotting made on a magnetic carrier used in Example 1 of the present invention are shown in FIG. 15. In this measurement on porous magnetic core particles, the specific resistance at 300 V/cm may be read. In this data, the electric-field intensity on the verge of breakdown is about 630 V. However, there are some porous magnetic core particles in which any point of intersection is present at 300 V/cm. An example of measurement on porous magnetic core particles which have not any point of measurement at 300 V/cm is shown in FIG. 16. Among points of measurement, two points are picked up which show the lowest electric-field intensity, and a straight line connecting these two points is drawn by extrapolation (shown by a dotted line in FIG. 16), and its point of intersection with the vertical line at the electric-field intensity of 300 V/cm is taken as the specific resistance at the electric-field intensity of 300 V/cm. Thus, about the carrier cores of the example of measurement as shown in FIG. 16, the specific resistance at the electric-field intensity of 300 V/cm is read as $2.0\times10^8$ Ω·cm.

How to Measure Volume Distribution Base 50% Particle Diameter (D50) of Magnetic Carrier Particles and Magnetic Core Particles:

Particle size distribution is measured with a laser diffraction-scattering particle size distribution measuring instrument "MICROTRACK MT3300EX" (manufactured by Nikkiso Co. Ltd.). In the measurement of the volume distribution base 50% particle diameter (D50) of the magnetic carrier particles and magnetic core particles, "One-shot Drying Sample Conditioner TURBOTRAC" (manufactured by Nikkiso Co. Ltd.) is attached, which is a sample feeder for dry-process measurement. As feed conditions of TURBOTRAC, a dust collector is used as a vacuum source, setting air flow at about 33 liters/second and pressure at about 17 kPa. Control is automatically made on software. As particle diameter, 50% particle diameter (D50) is found, which is the volume-base cumulative value. Control and analysis are made using attached software (Version 10.3.3-202D).

Measurement conditions are so set that Set Zero time is 10 seconds, measurement time is 10 seconds, number of time for measurement is one time, particle diffraction index is 1.81, particle shape is non-sphere, measurement upper limit is 1,408 μm and measurement lower limit is 0.243 μm. The measurement is made in a normal-temperature and normal-humidity environment (23° C./50% RH).

Measurement of Average Circularity of Toner:

The average circularity of the toner is measured with a flow type particle image analyzer "FPIA-3000 MODEL" (manufactured by Sysmex Corporation) on the basis of conditions of measurement and analysis made in operating corrections.

A specific way of measurement is as follows: First, about 20 ml of ion-exchanged water, from which impurity solid matter and the like have beforehand been removed, is put into a container made of glass. To this water, about 0.2 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to about 3-fold by mass. Further, about 0.02 g of a measuring sample is added, followed by dispersion treatment for 2 minutes by means of an ultrasonic dispersion machine to prepare a liquid dispersion for measurement. In that course, the dispersion system is appropriately so cooled that the liquid dispersion may have a temperature of 10° C. or more to 40° C. or less. As the ultrasonic dispersion machine, a desk-top ultrasonic washer dispersion machine of 50 kHz in oscillation frequency and 150 W in electric output (e.g., "VS-150", manufactured by Velvo-Clear Co.) is used. Into its water tank, a stated amount of ion-exchanged water is put, and about 2 ml of the above CONTAMINON N is fed into this water tank.

In the measurement, the flow type particle image analyzer is used, having a standard objective lens (10 magnifications), and Particle Sheath "PSE-900A" (available from Sysmex Corporation) is used as a sheath solution. The liquid dispersion having been controlled according to the above procedure is introduced into the flow type particle analyzer, where 3,000 toner particles are counted in an HPE measuring mode and in a total count mode. Then, the binary-coded threshold value at the time of particle analysis is set to 85%, and the diameters of particles to be analyzed are limited to circle-equivalent diameter of from 1.985 μm or more to less than 39.69 μm, where the average circularity of toner particles is determined.

In measuring the circularity, before the measurement is started, autofocus control is performed using standard latex particles (e.g., "RESEARCH AND TEST PARTICLES Latex Microsphere Suspensions 5200A", available from Duke Scientific Corporation, diluted with ion-exchanged water). Thereafter, the autofocus control may preferably be performed at intervals of 2 hours after the measurement has been started.

In Examples of the present invention, a flow type particle image analyzer was used on which correction was operated by Sysmex Corporation and for which a correction certificate issued by Sysmex Corporation was issued. Measurement was made under the measurement and analysis conditions set when the correction certificate was received, except that the diameters of particles to be analyzed were limited to the circle-equivalent diameter of from 1.985 μm or more to less than 39.69 μm.

Measurement of Proportion of Particles Having Circle-Equivalent Diameter of from 0.500 μm or More to Less Than 1.985 μm (Small Particles):

The proportion of particles having a circle-equivalent diameter of from 0.500 μm or more to less than 1.985 μm (small particles) of the toner is measured with a flow type particle image analyzer "FPIA-3000 MODEL" (manufactured by Sysmex Corporation) on the basis of conditions of measurement and analysis made in operating corrections.

The principle of measurement with the flow type particle image analyzer "FPIA-3000 MODEL" (manufactured by Sysmex Corporation) is that particles flowing therein are photographed as still images and the images are analyzed. The sample fed to a sample chamber is sent into a flat sheath flow cell by the aid of a sample suction syringe. The sample having been sent into the flat sheath flow cell forms a flat flow in the state it is inserted in sheath solution. The sample passing through the interior of the flat sheath flow cell is kept irradiated with strobe light at intervals of 1/60 second, thus the particles flowing therethrough can be photographed as still images. Also, because of the flat flow, the particles kept flowing can be photographed in a focused state. Particle images are photographed with a CCD camera, and the images photographed are image-processed at an image processing resolution of 512×512 in one visual field and 0.37 μm×0.37 μm per pixel, and the contour of each particle image is extracted, where the projected area and peripheral length of the particle image are measured.

Next, projected area S and peripheral length L are found. The projected area S and peripheral length L are used to determine circle-equivalent diameter. The circle-equivalent diameter refers to the diameter of a circle having the same area as the projected area of the particle image.

As a specific way of measurement, 0.02 g of a surface active agent, preferably an alkylbenzene sulfonate, is added as a dispersant to 20 ml of ion-exchanged water, and thereafter 0.02 g of a measuring sample is added, followed by dispersion treatment for 2 minutes by means of a desk-top ultrasonic washer dispersion machine of 50 kHz in oscillation frequency and 150 W in electric output (e.g., "VS-150", manufactured by Velvo-Clear Co.) to prepare a liquid dispersion for measurement. In that course, the dispersion system is appropriately so cooled that the liquid dispersion may have a temperature of 10° C. or more to 40° C. or less.

In the measurement, the flow type particle image analyzer is used, having a standard objective lens (10 magnifications; numerical aperture: 0.40), and Particle Sheath "PSE-900A" (available from Sysmex Corporation) is used as a sheath solution. The liquid dispersion having been controlled according to the above procedure is introduced into the flow type particle analyzer, where 3,000 toner particles are counted in an HPE measuring mode and in a total count mode. Also, the binary-coded threshold value at the time of particle analysis is set to 85%, and the diameters of particles to be analyzed may be specified to thereby calculate the number proportion of particles included in the range specified. To find the proportion of particles having a circle-equivalent diameter of from 0.500 μm or more to less than 1.985 μm (small particles), the range of circle-equivalent diameters of particles to be analyzed is limited to from 0.500 μm or more to less than 1.985 μm, and the number proportion (%) of particles included in that range is calculated.

In measuring the same, before the measurement is started, autofocus control is performed using standard latex particles (e.g., Latex Microsphere Suspensions 5200A, available from Duke Scientific Corporation, diluted with ion-exchanged water). Thereafter, the autofocus control may preferably be performed at intervals of 2 hours after the measurement has been started.

In Examples of the present invention, a flow type particle image analyzer was used on which correction was operated by Sysmex Corporation and for which a correction certificate issued by Sysmex Corporation was issued. Measurement was made under the measurement and analysis conditions set when the correction certificate was received, except that the diameters of particles to be analyzed were limited to the circle-equivalent diameter of from 0.500 μm or more to less than 1.985 μm.

Measurement of Weight Average Particle Diameter (D4) of Toner:

The weight average particle diameter (D4) of the toner is measured by using a precision particle size distribution measuring instrument "COULTER COUNTER MULTISIZER 3" (registered trademark; manufactured by Beckman Coulter, Inc.), which has an aperture tube of 100 μm in size and employing the aperture impedance method, and software "Beckman Coulter Multisizer 3 Version 3.51" (produced by Beckman Coulter, Inc.), which is attached to Multisizer 3 for its exclusive use in order to set the conditions for measurement and analyze the data of measurement. The measurement is made through 25,000 channels as effective measuring channels in number, and the data of measurement are analyzed to make calculation.

As an aqueous electrolytic solution used for the measurement, a solution may be used which is prepared by dissolving guaranteed sodium chloride in ion-exchanged water in a concentration of about 1% by mass, e.g., "ISOTON II" (available from Beckman Coulter, Inc.).

Before the measurement and analysis are made, the software for exclusive use is set in the following way. On a "Change of Standard Measuring Method (SOM)" screen of the software for exclusive use, the total number of counts of a control mode is set to 50,000 particles. The number of time of measurement is set to one time and, as Kd value, the value is set which has been obtained using "Standard Particles, 10.0 μm" (available from Beckman Coulter, Inc.). Threshold value and noise level are automatically set by pressing "Threshold Value/Noise Level Measuring Button". Then, current is set to 1,600 μA, gain to 2, and electrolytic solution to ISOTON II, where "Flash for Aperture Tube after Measurement" is checked.

On a "Setting of Conversion from Pulse to Particle Diameter" screen of the software for exclusive use, the bin distance is set to logarithmic particle diameter, the particle diameter bin to 256 particle diameter bins, and the particle diameter range to from 2 μm or more to 60 μm or less.

A specific way of measurement is as follows:

(1) About 200 ml of the aqueous electrolytic solution is put into a 250 ml round-bottomed beaker made of glass for exclusive use in Multisizer 3, and this is set on a sample stand, where stirring with a stirrer rod is carried out at 24 revolutions/second in the counterclockwise direction. Then, a "Flash of Aperture" function of the software for exclusive use is operated to beforehand remove any dirt and air bubbles in the aperture tube.

(2) About 30 ml of the aqueous electrolytic solution is put into a 100 ml flat-bottomed beaker made of glass. To this water, about 0.3 ml of a dilute solution is added as a dispersant, which has been prepared by diluting "CONTAMINON N" (an aqueous 10% by mass solution of a pH 7 neutral detergent for washing precision measuring instruments which is composed of a nonionic surface-active agent, an anionic surface-active agent and an organic builder and is available from Wako Pure Chemical Industries, Ltd.) with ion-exchanged water to 3-fold by mass.

(3) An ultrasonic dispersion machine of 120 W in electric output "Ultrasonic Dispersion system TETORA 150" (manufactured by Nikkaki Bios Co.) is readied, having two oscillators of 50 kHz in oscillation frequency which are built therein in the state their phases are shifted by 180 degrees. Into its water tank, a stated amount of ion-exchanged water is put, and about 2 ml of CONTAMINON N is added to the water in this water tank.

(4) The beaker of the above (2) is set to a beaker fixing hole of the ultrasonic dispersion machine, and the ultrasonic dispersion machine is set working. Then, the height position of the beaker is so adjusted that the state of resonance of the aqueous electrolytic solution surface in the beaker may become highest.

(5) In the state the aqueous electrolytic solution in the beaker of the above (4) is irradiated with ultrasonic waves, about 10 mg of the toner is little by little added to the aqueous electrolytic solution and is dispersed therein. Then, such ultrasonic dispersion treatment is further continued for 60 seconds. In carrying out the ultrasonic dispersion treatment, the water temperature of the water tank is appropriately so controlled as to be 10° C. or more to 40° C. or less.

(6) To the round-bottomed beaker of the above (1), placed inside the sample stand, the aqueous electrolytic solution in which the toner has been dispersed in the above (5) is added by the drop using a pipette, and the measuring concentration is so adjusted as to be about 5%. Then the measurement is made until the measuring particles come to 50,000 particles in number.

(7) The data of measurement are analyzed by using the above software attached to the measuring instrument for its exclusive use, to calculate the weight average particle diameter (D4). Here, "Average Diameter" on an "Analysis/Volume Statistic Value (Arithmetic Mean)" screen when set to graph/% by volume in the software for exclusive use is the weight average particle diameter (D4).

How to Measure Peak Molecular Weight (Mp), Number Average Molecular Weight (Mn) and Weight Average Molecular Weight (Mw) of Resin:

These molecular weights of the resin are measured by gel permeation chromatography (GPC) in the following way.

The resin is dissolved in tetrahydrofuran (THF) at room temperature over a period of 24 hours. Then, the solution obtained is filtered with a solvent-resistant membrane filter "MAISHORIDISK" (available from Tosoh Corporation) of 0.2 μm in pore diameter to make up a sample solution. Here, the sample solution is so controlled that the component soluble in THF is in a concentration of about 0.8% by mass. Using this sample solution, the measurement is made under the following conditions.

Instrument: HLC8120 GPC (detector: RI) (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: Tetrahydrofuran (THF).

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (e.g., trade name "TSK Standard Polystyrene F-850, F-450, F-288, F-128, F-80, F-40, F-20, F-10, F-4, F-2, F-1, A-5000, A-2500, A-1000, A-500"; available from Tosoh Corporation).

How to Measure Peak Temperature of Maximum Endothermic Peak of Wax and Glass Transition Temperature Tg Of Binder Resin:

The peak temperature of a maximum endothermic peak of the wax is measured according to ASTM D3418-82, using a differential scanning calorimetry analyzer "Q1000" (manufactured by TA Instruments Japan Ltd.). The temperature at the detecting portion of the instrument is corrected on the basis of melting points of indium and zinc, and the amount of heat is corrected on the basis of heat of fusion of indium.

Stated specifically, the wax is precisely weighed out in an amount of about 10 mg, and this is put into a pan made of aluminum and an empty pan made of aluminum is used as reference. Measurement is made at a heating rate of 10° C./min within the measurement temperature range of from 30° C. to 200° C. Here, in the measurement, the wax is first heated to 200° C., then cooled to 30° C. and thereafter heated again. In the course of this second-time heating, a maximum endothermic peak of a DSC curve in the temperature range of from 30° C. to 200° C. is regarded as the maximum endothermic peak of the wax in the present invention.

As to the glass transition temperature (Tg) of the binder resin, the binder resin is precisely weighed out in an amount of about 10 mg, and measurement is made in the same way as that for the measurement of the peak temperature of the maximum endothermic peak of the wax. In that case, changes in specific heat are found within the range of temperature of from 40° C. or more to 100° C. or less. The point at which the middle-point line between the base lines of a differential thermal curve before and after the appearance of the changes in specific heat thus found and the differential thermal curve intersect is regarded as the glass transition temperature Tg of the binder resin.

Measurement of Maximum Value of Number Distribution Base Particle Diameter of Inorganic Fine Particles:

The number distribution base particle diameter of the inorganic fine particles is measured by the following procedure.

The toner is observed on its backscattered electron image at an accelerating voltage of 2.0 kV by using a scanning electron microscope S-4800 (manufactured by Hitachi Ltd.) and in the state of making no vacuum deposition. The backscattered electron image is observed at 50,000 magnifications. The emission level of backscattered electrons depends on the atomic numbers of materials constituting the sample, from the fact of which there can be a contrast between the inorganic fine particles and an organic material such as toner base particles. Particles standing more highlighted (looking white) than the toner base particles may be judged to be the inorganic fine particles. Then, 500 fine particles of 5 nm ore more in particle diameter are extracted at random. The lengths and breadths of the particles extracted are measured with a digitizer, and individual average values of the lengths and breadths are taken as particle diameters of the fine particles. In a particle size distribution of 500 particles thus extracted (a histogram is used which is of columns grouped by means of class intervals of 10 nm, such as 5 to 15 nm, 15 to 25 nm, 25 to 35 nm and so on in column width), a histogram is drawn by particle diameters at meddle value of the columns, and an average particle diameter is calculated therefrom. The particle diameter that comes maximal in the range of from 50 nm or more to 300 nm or less is taken as the maximum value.

How to Measure Number Average Particle Diameter Of External Additive (Inorganic Fine Particles and Fine Silica Particles:

Measured with a scanning electron microscope S-4700 (manufactured by Hitachi Ltd.). A photograph of particles is taken which are magnified 500,000 times, and this photograph taken is enlarged two times, and particle lengths are measured from the FE-SEM photographic image. With regard to spherical particles, their diameters are taken as particle diameters of the same particles, and, with regard to oval particles, their maximum diameters (length diameters). Particle lengths are measured on 100 inorganic fine particles, and an average value thereof is found to calculate the number average particle diameter.

How to Measure Intensity of Magnetization of Magnetic Carrier:

The intensity of magnetization of the magnetic carrier and magnetic core particles may be measured with a vibrating magnetic-field type magnetic-property measuring instrument (Vibrating Sample Magnetometer) or a direct-current magnetization characteristics recording instrument (B—H Tracer). In Examples given later, it is measured with a vibration magnetic-field type magnetic-property measuring instrument BHV-35 (manufactured by Riken Denshi Co., Ltd.) by the following procedure.

A cylindrical plastic container is filled with the magnetic carrier or magnetic core particles in the state it has well densely been filled with particles. Actual mass of the sample with which the container has been filled is measured. Thereafter, the sample in the plastic container is bonded with an instantaneous adhesive so that the sample may not move.

The axis of external magnetic field at 5,000/4π (kA/m) and the axis of magnetic moment are corrected by using a standard sample.

Sweep rate is set at 5 min/loop, and the intensity of magnetization is measured from the loop of magnetic moment under application of an external magnetic field of 1,000/4π (kA/m). The value thus obtained is divided by the mass of the sample to find the intensity of magnetization ($Am^2/kg$) of the magnetic carrier and magnetic core particles.

Measurement of True Density of Magnetic Carrier And Magnetic Core Particles:

The true density of the magnetic carrier and magnetic core particles is measured with a dry automatic densitometer ACCUPYC 1330 (manufactured by Shimadzu Corporation). First, a sample having been left for 24 hours in an environment of 23° C./50% RH is precisely weight in an amount of 5 g. This is put into a measuring cell (10 $cm^3$), and then inserted to a main-body sample chamber. Measurement may be made by automatic measurement by starting the measurement after sample mass is inputted to the main body.

As a measurement condition for the automatic measurement, a condition in which, after the interior of the sample chamber is purged 10 times with helium gas having been controlled at 20.000 psig ($2.392\times10^2$ kPa), the change in pressure in the interior of the sample chamber comes to be 0.005 psig/min ($3.447\times10^{-2}$ kPa/min) is regarded as an equilibrium condition. Its interior is purged with the helium gas until it comes into the equilibrium condition. The pressure in the interior of the main-body sample chamber at the time of equilibrium condition is measured. The sample volume can be calculated from the change in pressure at the time of having reached such equilibrium condition (the Boyle low). Since the sample volume can be calculated, the true specific gravity of the sample may be calculated by using the following expression.

True specific gravity ($g/cm^3$) of sample=sample mass (g)/sample volume ($cm^3$).

An average value of the values measured repeatedly five times by this automatic measurement is taken as the true specific gravity ($g/cm^3$) of the magnetic carrier and magnetic core particles.

How to Measure Apparent Density of Magnetic Carrier and Magnetic Core Particles:

The apparent density of the magnetic carrier and magnetic core particles is determined by using the magnetic carrier and magnetic core particles in place of magnetic powder, according to JIS Z2504 (a test method for apparent density of magnetic powder).

EXAMPLES

The present invention is specifically described below by giving working examples. The present invention is by no means limited to these working examples.

Production Example of Porous Magnetic Core Particles 1

Step 1 (Weighing and Mixing Step):

| | |
|---|---|
| $Fe_2O_3$ | 60.1% by mass |
| $MnCO_3$ | 34.5% by mass |
| $Mg(OH)_2$ | 4.5% by mass |
| $SrCO_3$ | 0.9% by mass |

The above ferrite raw materials were weighed out. Thereafter, these were ground and mixed for 2 hours by means of a dry-process ball mill making use of zirconia balls (10 mm in diameter).

Step 2 (Provisional Baking Step):

After these were ground and mixed, the mixture obtained was baked at a temperature of 950° C. for 2 hours in the atmosphere by using a burner type baking furnace to produce provisionally baked ferrite.

Step 3 (Grinding Step):

The provisionally baked ferrite was ground to a size of about 0.5 mm by means of a crusher, and thereafter, with addition of 30 parts by mass of water based on 100 parts by mass of the provisionally baked ferrite, the ground product was further ground for 4 hours by means of a wet-process bead mill making use of zirconia beads of 1.0 mm in diameter to obtain ferrite slurry.

Step 4 (Granulation Step):

To the ferrite slurry, 2.0 parts by mass of polyvinyl alcohol based on 100 parts by mass of the provisionally baked ferrite was added as a binder, and this ferrite slurry was granulated into spherical particles by means of a spray dryer (manufactured by Ohkawara Kakohki Co., Ltd.).

Step 5 (Main Baking Step):

The granulated product was baked at a temperature of 1,050° C. for 4 hours while being kept in an atmosphere of nitrogen (oxygen concentration: 0.02% by volume) in an electric furnace in order to control baking atmosphere.

Step 6 (Screening Step):

Particles having come to agglomerate were disintegrated, followed by sifting with a sieve of 250 μm in mesh opening to remove coarse particles to obtain Porous Magnetic Core Particles 1. Physical properties of Porous Magnetic Core Particles 1 are shown in Table 1.

Production Example of Porous Magnetic Core Particles 2

Porous Magnetic Core Particles 2 was produced in the same way as in Production Example of Porous Magnetic Core Particles 1 except that, in the step 5 (main baking step) of Production Example of Porous Magnetic Core Particles 1, the granulated product was baked at 1,100° C. for 4 hours at an oxygen concentration of 0.10% by volume. Physical properties of Porous Magnetic Core Particles 2 are shown in Table 1.

Production Example of Porous Magnetic Core Particles 3

Porous Magnetic Core Particles 3 was produced in the same way as in Production Example of Porous Magnetic Core Particles 1 except that, in the step 5 (main baking step) of Production Example of Porous Magnetic Core Particles 1, the granulated product was baked at 1,100° C. for 4 hours at an oxygen concentration of 0.02% by volume. Physical properties of Porous Magnetic Core Particles 3 are shown in Table 1.

Production Example of Porous Magnetic Core Particles 4

Porous Magnetic Core Particles 4 was produced in the same way as in Production Example of Porous Magnetic Core Particles 1 except that, in the step 5 (main baking step) of Production Example of Porous Magnetic Core Particles 1, the granulated product was baked at 1,150° C. for 4 hours. Physical properties of Porous Magnetic Core Particles 4 are shown in Table 1.

Production Example of Porous Magnetic Core Particles 5

In the step 1 (weighing and mixing step) of Production Example of Porous Magnetic Core Particles 1, ferrite raw materials were so weighed out as to be formulated below:

| | |
|---|---|
| $Fe_2O_3$ | 68.0% by mass |
| $MnCO_3$ | 29.9% by mass |
| $Mg(OH)_2$ | 2.1% by mass |

Thereafter, these were ground and mixed for 2 hours by means of a dry-process ball mill making use of zirconia balls (10 mm in diameter). Also, in the step 5 (main baking step), the granulated product was baked at 1,100° C. for 4 hours at an oxygen concentration of less than 0.01% by volume. Except these, Porous Magnetic Core Particles 5 was produced in the same way as in Production Example of Porous Magnetic Core Particles 1. Physical properties of Porous Magnetic Core Particles 5 are shown in Table 1.

Production Example of Porous Magnetic Core Particles 6

Porous Magnetic Core Particles 6 was produced in the same way as in Production Example of Porous Magnetic Core Particles 1 except that, in the step 5 (main baking step) of Production Example of Porous Magnetic Core Particles 1, the granulated product was baked at 1,150° C. for 4 hours at an oxygen concentration of 0.3% by volume. Physical properties of Porous Magnetic Core Particles 6 are shown in Table 1.

Production Example of Magnetic Core Particles 7

Step 1:

| | |
|---|---|
| $Fe_2O_3$ | 70.8% by mass |
| CuO | 16.0% by mass |
| ZnO | 13.2% by mass |

The above ferrite raw materials were weighed out. Thereafter, these were ground and mixed for 2 hours by means of a dry-process ball mill making use of zirconia balls (10 mm in diameter).

Step 2:

After these were ground and mixed, the mixture obtained was baked at a temperature of 950° C. for 2 hours in the atmosphere to produce provisionally baked ferrite.

Step 3:

The provisionally baked ferrite was ground to a size of about 0.5 mm by means of a crusher, and thereafter, with addition of 30 parts by mass of water based on 100 parts by mass of the provisionally baked ferrite, the ground product was further ground for 2 hours by means of a wet-process ball mill making use of stainless steel balls (10 mm in diameter). The slurry obtained was further ground for 4 hours by means of a wet-process bead mill making use of stainless steel beads (1.0 mm in diameter) to obtain ferrite slurry.

Step 4:

To the ferrite slurry, 0.5 part by mass of polyvinyl alcohol based on 100 parts by mass of the provisionally baked ferrite was added as a binder, and this ferrite slurry was granulated into spherical particles by means of a spray dryer (manufactured by Ohkawara Kakohki Co., Ltd.).

Step 5:

The granulated product was baked at a temperature of 1,300° C. for 4 hours in the atmosphere.

Step 6:

Particles having come to agglomerate were disintegrated, followed by sifting with a sieve of 250 μm in mesh opening to remove coarse particles to obtain Magnetic Core Particles 7. Physical properties of Magnetic Core Particles 7 are shown in Table 1.

Production Example of Magnetic-material Dispersed Core Particles 8

To fine magnetite particles (number-average particle diameter: 0.3 μm) and fine hematite particles (number-average particle diameter: 0.6 μm), 4.0% by mass each of a silane coupling agent 3-(2-aminoethylaminopropyl) trimethoxysilane was added, and these were mixed and agitated at a high speed in a container at a temperature of 100° C. or more to carry out lipophilic treatment of both the fine particles.

| | |
|---|---|
| Phenol | 10 parts by mass |
| Formaldehyde solution (aqueous 37% by mass formaldehyde solution) | 6 parts by mass |

-continued

| | |
|---|---|
| Above treated fine magnetite particles | 76 parts by mass |
| Above treated fine hematite particles | 8 parts by mass |

The above materials and 5 parts by mass of 28% by mass ammonia water and 10 parts by mass of water were put into a flask, and, with agitation and mixing, these were heated to 85° C. over a period of 30 minutes and held thereat to carry out polymerization reaction for 4 hours to effect curing. Thereafter, the reaction system was cooled to 30° C., and water was further added thereto. Thereafter, the supernatant liquid was removed, and then the precipitate formed was washed with water, followed by air drying. Subsequently, this was dried at a temperature of 60° C. under reduced pressure (5 hPa or less) to obtain Magnetic-material Dispersed Core Particles 8 with the magnetic fine particles standing dispersed therein. Physical properties of Magnetic-material Dispersed Core Particles 8 are shown in Table 1.

Production Example of Magnetic Core Particles 9

Magnetic Core Particles 9 was produced in the same way as in Production Example of Magnetic Core Particles 7 except that, in the step 3 of Production Example of Magnetic Core Particles 7, the time for the grounding making use of stainless steel balls (10 mm in diameter) was changed to 1 hour and subsequently the time for the grounding by means of a wet-process bead mill making use of stainless steel beads (1.0 mm in diameter) was changed to 6 hours. Physical properties of Magnetic Core Particles 9 are shown in Table 1.

Production Example of Magnetic Core Particles 10

Magnetic Core Particles 10 was produced in the same way as in Production Example of Porous Magnetic Core Particles 5 except that, in the step 4 (granulation step) of Production Example of Porous Magnetic Core Particles 5, the amount of the polyvinyl alcohol was changed to 0.3 part by mass and, in the step 5, the baking temperature and the oxygen concentration were changed to 1,300° C. and less than 0.01% by volume, respectively. Physical properties of Magnetic Core Particles 10 are shown in Table 1.

Production Example of Magnetic Core Particles 11

Magnetic Core Particles 11 was produced in the same way as in Production Example of Magnetic Core Particles 7 except that, in the step 3 of Production Example of Magnetic Core Particles 7, after the crushing to a size of about 0.5 mm by means of a crusher, with addition of 30 parts by mass of water based on 100 parts by mass of the provisionally baked ferrite, the grinding was further carried out for 4 hours by means of a wet-process bead mill making use of stainless steel beads (1.0 mm in diameter) to obtain ferrite slurry. Physical properties of Magnetic Core Particles 11 are shown in Table 1.

Production Example of Porous Magnetic Core Particles 12

Step 1 (Weighing and Mixing Step):

| | |
|---|---|
| $Fe_2O_3$ | 61.6% by mass |
| $MnCO_3$ | 31.6% by mass |
| $Mg(OH)_2$ | 5.7% by mass |
| $SrCO_3$ | 0.7% by mass |

The above ferrite raw materials were weighed out. Thereafter, these were ground and mixed for 5 hours by means of a wet-process ball mill making use of zirconia balls (10 mm in diameter).

Step 2 (Provisional Baking Step):

After these were ground and mixed, the mixture obtained was baked at a temperature of 950° C. for 2 hours in the atmosphere by using a burner type baking furnace to produce provisionally baked ferrite.

Step 3 (Grinding Step):

The provisionally baked ferrite was ground to a size of about 0.5 mm by means of a crusher, and thereafter, with addition of 30 parts by mass of water based on 100 parts by mass of the provisionally baked ferrite, the ground product was further ground for 1 hour by means of a wet-process bead mill making use of stainless steel beads (3 mm in diameter). The slurry obtained was ground for 4 hours by means of a wet-process bead mill making use of stainless steel beads (1.0 mm in diameter) to obtain ferrite slurry.

Step 4 (Granulation Step):

To the ferrite slurry, 1.0 part by mass of polyvinyl alcohol based on 100 parts by mass of the provisionally baked ferrite was added as a binder, and this ferrite slurry was granulated into spherical particles of 35 μm in diameter by means of a spray dryer (manufactured by Ohkawara Kakohki Co., Ltd.).

Step 5 (Main Baking Step):

The granulated product was baked at a temperature of 1,100° C. for 4 hours while being kept at an oxygen concentration of 0.5% by volume in an electric furnace in order to control baking atmosphere.

Step 6 (Screening Step):

Particles having come to agglomerate were disintegrated, followed by sifting with a sieve of 250 μm in mesh opening to remove coarse particles to obtain Porous Magnetic Core Particles 12. Physical properties of Porous Magnetic Core Particles 12 are shown in Table 1.

Production Example of Magnetic Core Particles 13

Step 1:

| | |
|---|---|
| $Fe_2O_3$ | 70.8% by mass |
| CuO | 12.8% by mass |
| ZnO | 16.4% by mass |

The above ferrite raw materials were weighed out. Thereafter, these were ground and mixed for 2 hours by means of a dry-process ball mill making use of zirconia balls (10 mm in diameter).

Step 2:

After these were ground and mixed, the mixture obtained was baked at a temperature of 950° C. for 2 hours in the atmosphere to produce provisionally baked ferrite.

Step 3:

The provisionally baked ferrite was ground to a size of about 0.5 mm by means of a crusher, and thereafter, with addition of 30 parts by mass of water based on 100 parts by mass of the provisionally baked ferrite, the ground product was further ground for 2 hours by means of a wet-process ball mill making use of stainless steel balls (10 mm in diameter). The slurry obtained was further ground for 4 hours by means of a wet-process bead mill making use of stainless steel beads (1.0 mm in diameter) to obtain ferrite slurry.

Step 4:

To the ferrite slurry, 0.5 part by mass of polyvinyl alcohol based on 100 parts by mass of the provisionally baked ferrite was added as a binder, and this ferrite slurry was granulated into spherical particles of 80 μm in diameter by means of a spray dryer (manufactured by Ohkawara Kakohki Co., Ltd.).

Step 5:

The granulated product was baked at a temperature of 1,300° C. for 4 hours in the atmosphere.

Step 6:

Particles having come to agglomerate were disintegrated, followed by sifting with a sieve of 250 μm in mesh opening to remove coarse particles to obtain Magnetic Core Particles 13. Physical properties of Magnetic Core Particles 13 are shown in Table 1.

TABLE 1

Physical Properties of Core Particles

| Core particles (CP) | Core particle composition | D50 (μm) | Specific resistance at 300 V/cm (Ω · cm) | Electric-field intensity on the verge of breakdown (V/cm) | True density (g/cm³) | Apparent specific gravity (g/cm³) |
|---|---|---|---|---|---|---|
| Porous Magnetic CP 1 | $(MnO)_{0.40}(MgO)_{0.10}(SrO)_{0.01}(Fe_2O_3)_{0.49}$ | 38.5 | $8.0 \times 10^6$ | 782 | 4.8 | 1.3 |
| Porous Magnetic CP 2 | $(MnO)_{0.40}(MgO)_{0.10}(SrO)_{0.01}(Fe_2O_3)_{0.49}$ | 35.7 | $7.5 \times 10^7$ | 1,220 | 4.8 | 1.5 |
| Porous Magnetic CP 3 | $(MnO)_{0.40}(MgO)_{0.10}(SrO)_{0.01}(Fe_2O_3)_{0.49}$ | 36.5 | $6.5 \times 10^6$ | 740 | 4.8 | 1.5 |
| Porous Magnetic CP 4 | $(MnO)_{0.40}(MgO)_{0.10}(SrO)_{0.01}(Fe_2O_3)_{0.49}$ | 37.7 | $1.2 \times 10^6$ | 388 | 4.9 | 1.7 |
| Porous Magnetic CP 5 | $(MnO)_{0.36}(MgO)_{0.05}(Fe_2O_3)_{0.59}$ | 36.4 | $5.5 \times 10^6$ | 340 | 4.8 | 1.7 |
| Porous Magnetic CP 6 | $(MnO)_{0.40}(MgO)_{0.10}(SrO)_{0.01}(Fe_2O_3)_{0.49}$ | 36.6 | $4.5 \times 10^8$ | 1,522 | 4.8 | 1.7 |

TABLE 1-continued

| Physical Properties of Core Particles | | | | | | |
|---|---|---|---|---|---|---|
| Core particles (CP) | Core particle composition | D50 (μm) | Specific resistance at 300 V/cm (Ω · cm) | Electric-field intensity on the verge of breakdown (V/cm) | True density (g/cm$^3$) | Apparent specific gravity (g/cm$^3$) |
| Mag. CP 7 | $(CuO)_{0.25}(ZnO)_{0.20}(Fe_2O_3)_{0.55}$ | 36.5 | $1.8 \times 10^8$ | Not BD* | 5.0 | 2.7 |
| Magnetic-material Dispersed CP 8 | — | 32.5 | $2.5 \times 10^{12}$ | Not BD* | 3.5 | 0.7 |
| Mag. CP 9 | $(CuO)_{0.25}(ZnO)_{0.20}(Fe_2O_3)_{0.55}$ | 42.3 | $1.2 \times 10^9$ | Not BD* | 5.0 | 2.6 |
| Mag. CP 10 | $(MnO)_{0.36}(MgO)_{0.05}(Fe_2O_3)_{0.59}$ | 37.7 | $8.8 \times 10^5$ | Not BD* | 4.9 | 2.5 |
| Mag. CP 11 | $(MnO)_{0.40}(MgO)_{0.10}(SrO)_{0.01}(Fe_2O_3)_{0.49}$ | 39.1 | $1.3 \times 10^9$ | Not BD* | 5.0 | 2.7 |
| Porous Mag. CP 12 | $(MnO)_{0.36}(MgO)_{0.13}(SrO)_{0.01}(Fe_2O_3)_{0.50}$ | 37.5 | $7.0 \times 10^7$ | 1,110 | 4.9 | 1.6 |
| Mag. CP 13 | $(CuO)_{0.25}(ZnO)_{0.20}(Fe_2O_3)_{0.55}$ | 75.0 | $1.8 \times 10^8$ | Not BD* | 5.0 | 2.7 |

(*break down)

Preparation of Resin Solutions A to E

Materials shown respectively in Table 2 were mixed to obtain Resin Solutions A to E.

Preparation of Resin Solution F

Materials shown in Table 2 were dispersed by means of a sand mill making use of glass beads of 3 mm in diameter as media particles. Thereafter, the beads were separated by using a sieve to prepare Resin Solution F.

TABLE 2

| Resin Solution | | | | | |
|---|---|---|---|---|---|
| | Silicone* resin solution | Charge control agent | | Carbon black DBP oil absorption | |
| Resin Solution | (SR2411) solid matter concentration 20% (pbm) | Type | Amount (pbm) | (ml/100 g) 137, pH 7.0 (pbm) | Toluene (pbm) |
| A | 100.0 | — | — | — | — |
| B | 100.0 | γ-aminopropyl-triethoxysilane | 2.0 | — | 8.0 |
| C | 100.0 | γ-aminopropyl-triethoxysilane | 4.0 | — | 16.0 |
| D | 100.0 | γ-aminopropyl-triethoxysilane | 10.0 | — | 40.0 |
| E | 100.0 | γ-aminopropyl-triethoxysilane | 20.0 | — | 80.0 |
| F | 100.0 | — | — | 0.4 | 1.4 |

pbm: parts by mass

*Silicone resin solution (SR2411, available from Dow Corning Toray Silicone Co., Ltd.) contains 80% of organic solvent.

Production Example of Filled Core Particles 1

100 parts by mass of Porous Magnetic Core Particles 1 was put into a mixing agitator (a universal agitating mixer NDMV MODEL, manufactured by Dulton Company Limited), and then heated to a temperature of 50° C. under reduced pressure. Resin Solution B was added by the drop thereto in an amount corresponding to 15 parts by mass as a filling resin component, based on 100 parts by mass of Porous Magnetic Core Particles 1, and these were further agitated at a temperature of 50° C. for 1 hour. Thereafter, the temperature was raised to 80° C. to remove the solvent. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 2 hours in an atmosphere of nitrogen, followed by classification with a mesh of 70 μm in opening to obtain Filled Core Particles 1 (resin fill level: 15.0 parts by mass).

Production Example of Filled Core Particles 2

100 parts by mass of Porous Magnetic Core Particles 4 was put into a mixing agitator (a universal agitating mixer NDMV MODEL, manufactured by Dulton Company Limited), and then heated to a temperature of 70° C. Resin Solution A was added by the drop thereto in an amount corresponding to 10 parts by mass as a filling resin component, based on 100 parts by mass of Porous Magnetic Core Particles 4, and these were agitated at a temperature of 70° C. for 3 hours while removing the solvent. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 2 hours in an atmosphere of nitrogen, followed by classification with a mesh of 70 μm in opening to obtain Filled Core Particles 2 (resin fill level: 10 parts by mass).

Production Examples of Filled Core Particles 3 to 6 & 8

Filled Core Particles 3 to 6 and 8 were produced in the same way as in Production Example of Filled Core Particles 1 except that the stated porous magnetic core particles and resin solutions were used according to what are shown in Table 3.

Production Examples of Filled Core Particles 7

Filled Core Particles 7 was produced in the same way as in Production Example of Filled Core Particles 2 except that Porous Magnetic Core Particles 6 was used according to what is shown in Table 3.

Production Example of Filled Core Particles 9

100 parts by mass of Porous Magnetic Core Particles 12 was put into a drying machine (single-spindle indirect heat type dryer SOLIDAIRE, manufactured by Hosokawa Micron Corporation). Keeping it at a temperature of 75° C. and with agitation, Resin Solution B was added by the drop thereto in an amount corresponding to 20 parts by mass as a filling resin component. Thereafter, the temperature was raised to 200° C., and was kept thereat for 2 hours. The product obtained was classified with a mesh of 70 μm in opening to obtain Filled Core Particles 9.

TABLE 3

| | | Filling resin | |
|---|---|---|---|
| Filled cores | Core particles | Resin solution | Fill level (pbm) |
| Filled Core Particles 1 | Porous Magnetic Core Particles 1 | B | 15 |
| Filled Core Particles 2 | Porous Magnetic Core Particles 4 | A | 10 |
| Filled Core Particles 3 | Porous Magnetic Core Particles 3 | B | 10 |
| Filled Core Particles 4 | Porous Magnetic Core Particles 1 | B | 17 |
| Filled Core Particles 5 | Porous Magnetic Core Particles 1 | B | 20 |
| Filled Core Particles 6 | Porous Magnetic Core Particles 2 | B | 12 |
| Filled Core Particles 7 | Porous Magnetic Core Particles 6 | A | 10 |
| Filled Core Particles 8 | Porous Magnetic Core Particles 5 | B | 10 |
| Filled Core Particles 9 | Porous Magnetic Core Particles 12 | B | 20 |

pbm: parts by mass

Production Example of Magnetic Carrier 1

100 parts by mass of Filled Core Particles 1 was put into a mixing machine (NAUTA MIXER VN MODEL, manufactured by Hosokawa Micron Corporation), which was then controlled to a temperature of 70° C. under reduced pressure, with agitation under conditions of a speed of revolution of 100 $min^{-1}$ and a speed of rotation of 3.5 $min^{-1}$, of the screw. Resin Solution C was so diluted with toluene as to be in a solid-matter concentration of 10% by mass, and this resin solution was so put into the mixer as to be in an amount of 0.5 part by mass as a coating resin component, based on 100 parts by mass of Filled Core Particles 1. The removal of solvent and the coating of core particles with resin were carried out over a period of 2 hours. Thereafter, the temperature was raised to 180° C., where the agitation was continued for 2 hours, and thereafter the temperature was dropped to 70° C. The material obtained was moved to a mixing agitator (a universal agitating mixer NDMV MODEL, manufactured by Dulton Company Limited). Then, using Resin Solution C, the resin solution was so put thereinto as to be in an amount of 0.5 part by mass as a coating resin component, based on 100 parts by mass of the raw-material Filled Core Particles 1, where the removal of solvent and the coating of core particles with resin were carried out over a period of 2 hours. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 1. Production conditions for Magnetic Carrier 1 obtained are shown in Table 4, and physical properties thereof, in Table 5.

Production Example of Magnetic Carrier 2

Magnetic Carrier 2 was obtained in the same way as Magnetic Carrier 1 except that, in the first-stage coating step making use of the mixing machine NAUTA MIXER VN MODEL (manufactured by Hosokawa Micron Corporation), Resin Solution C was so diluted with toluene as to be in a solid-matter concentration of 10% by mass and this was so put into the mixer as to be in an amount of 1.5 parts by mass as a coating resin component, based on 100 parts by mass of Filled Core Particles 1, and that, in the second-stage coating step making use of the mixing agitator, universal agitating mixer NDMV MODEL (manufactured by Dulton Company Limited), Resin Solution C was so put thereinto as to be in an amount of 1.0 part by mass as a coating resin component, based on 100 parts by mass of Filled Core Particles 1. Production conditions for Magnetic Carrier 2 are shown in Table 4, and physical properties thereof, in Table 5.

Production Example of Magnetic Carrier 3

Magnetic Carrier 3 was obtained in the same way as Magnetic Carrier 1 except that Filled Core Particles 2 was used as the filled core particles and, in the first-stage coating step making use of the mixing machine NAUTA MIXER VN MODEL (manufactured by Hosokawa Micron Corporation), Resin Solution B in place of Resin Solution C was so diluted with toluene as to be in a solid-matter concentration of 10% by mass and this was so put into the mixer as to be in an amount of 1.5 parts by mass as a coating resin component, based on 100 parts by mass of Filled Core Particles 2, and that, in the second-stage coating step making use of the mixing agitator, universal agitating mixer NDMV MODEL (manufactured by Dulton Company Limited), Resin Solution B was so put thereinto as to be in an amount of 1.5 parts by mass as a coating resin component, based on 100 parts by mass of Filled Core Particles 2. Production conditions for Magnetic Carrier 3 are shown in Table 4, and physical properties thereof, in Table 5.

Production Example of Magnetic Carrier 4

Magnetic Carrier 4 was obtained in the same way as Magnetic Carrier 1 except that Filled Core Particles 3 was used as the filled core particles and, in the first-stage coating step making use of the mixing machine NAUTA MIXER VN MODEL (manufactured by Hosokawa Micron Corporation), agitation was carried out under conditions of a speed of revolution of 70 $min^{-1}$ and a speed of rotation of 1.5 $min^{-1}$, of the screw, Resin Solution C was so diluted with toluene as to be in a solid-matter concentration of 15% by mass and this was so put into the mixer as to be in an amount of 0.5 part by mass as a coating resin component, based on 100 parts by mass of Filled Core Particles 3, and that, in the second-stage coating step making use of the mixing agitator, universal agitating mixer NDMV MODEL (manufactured by Dulton Company Limited), Resin Solution C was so put thereinto as to be in an amount of 0.5 part by mass as a coating resin component, based on 100 parts by mass of Filled Core Particles 3 and, in the mixing machine having a spiral blade in a rotatable mixing container (a DRUM MIXER UD-AT MODEL, manufactured by Sugiyama Heavy Industrial Co., Ltd.), the heat treatment was carried out at a temperature of 200° C. for 6 hours in an atmosphere of nitrogen. Production conditions for Magnetic Carrier 4 are shown in Table 4, and physical properties thereof, in Table 5.

Production Example of Magnetic Carrier 5

100 parts by mass of Filled Core Particles 4 was put into a mixing machine (NAUTA MIXER VN MODEL, manufactured by Hosokawa Micron Corporation), which was then controlled to a temperature of 70° C. under reduced pressure, with agitation under conditions of a speed of revolution of 100 $min^{-1}$ and a speed of rotation of 3.5 $min^{-1}$, of the screw. Resin Solution C was so diluted with toluene as to be in a solid-matter concentration of 10% by mass, and this resin solution was so put into the mixer as to be in an amount of 0.5 part by mass as a coating resin component, based on 100 parts by mass of Filled Core Particles 4. The removal of solvent and the coating of core particles with resin were carried out over a period of hours. The material obtained was moved to a mixing agitator (a universal agitating mixer NDMV MODEL, manufactured by Dulton Company Limited). Then, using Resin Solution C, the resin solution was so put thereinto as to be in an amount of 0.25 part by mass as a coating resin component, based on 100 parts by mass of the raw-material Filled Core Particles 4, where the removal of solvent and the coating of core particles with resin were carried out over a period of 2 hours. Further, using Resin Solution C, the resin solution was so put into the mixing agitator (a universal agitating mixer NDMV MODEL, manufactured by Dulton Company Limited) as to be in an amount of 0.25 part by mass as a coating resin component, based on 100 parts by mass of the raw-material Filled Core Particles 4, where the removal of solvent and the coating of core particles with resin were likewise carried out over a period of 2 hours. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 5. Production conditions for Magnetic Carrier 5 are shown in Table 4, and physical properties thereof, in Table 5.

Production Example of Magnetic Carriers 6 to 8

Filled Core Particles 5 to 7, respectively, were used, the coating of core particles with resin were not carried out, and the agitation was carried out at room temperature for 4 hours by means of the mixing machine (NAUTA MIXER VN MODEL, manufactured by Hosokawa Micron Corporation) under conditions of a speed of revolution of 80 $min^{-1}$ and a speed of rotation of 3.5 $min^{-1}$, of the screw, followed by classification with a mesh of 70 μm in opening to obtain Magnetic Carriers 6 to 8. Production conditions for Magnetic Carriers 6 to 8 are shown in Table 4, and physical properties thereof, in Table 5.

Production Example of Magnetic Carrier 9

100 parts by mass of Filled Core Particles 8 was put into a mixing agitator (a universal agitating mixer NDMV MODEL, manufactured by Dulton Company Limited), and agitated with heating to a temperature of 70° C. under reduced pressure. Subsequently, Resin Solution C was so diluted with toluene as to be in a solid-matter concentration of 5% by mass, and this was so put into the mixer as to be in an amount of 0.5 part by mass as a coating resin component, based on 100 parts by mass of Filled Core Particles 8. The removal of solvent and the coating of core particles with resin were carried out over a period of 6 hours. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 9. Production conditions for Magnetic Carrier 9 are shown in Table 4, and physical properties thereof, in Table 5.

Production Example of Magnetic Carrier 10

100 parts by mass of Magnetic Core Particles 10 was put into a mixing agitator (a universal agitating mixer NDMV MODEL, manufactured by Dulton Company Limited), and agitated with heating to a temperature of 70° C. under reduced pressure. Subsequently, Resin Solution C was so concentrated as to be in a solid-matter concentration of 30% by mass, and this was added by the drop over a period of 6 hours as to be in an amount of 1.0 part by mass as a coating resin component, based on 100 parts by mass of Magnetic Core Particles 10, where the removal of solvent and the coating of core particles with resin were carried out. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 12 hours in an atmosphere of nitrogen, followed by classification with a mesh of 70 μm in opening to obtain Magnetic Carrier 10. Production conditions for Magnetic Carrier 10 are shown in Table 4, and physical properties thereof, in Table 5.

Production Example of Magnetic Carrier 11

100 parts by mass of Magnetic-material Dispersed Core Particles 8 was put into a mixing machine (NAUTA MIXER VN MODEL, manufactured by Hosokawa Micron Corporation), and heated to a temperature of 70° C. under reduced pressure, with agitation under conditions of a speed of revolution of 100 $min^{-1}$ and a speed of rotation of 2.0 $min^{-1}$, of the screw. Subsequently, Resin Solution B was so diluted as to be in a solid-matter concentration of 5% by mass, and this was so added as to be in an amount of 0.5 part by mass as a coating resin component, based on 100 parts by mass of Magnetic-material Dispersed Core Particles 8, which was so added by the drop over a period of 6 hours, where the removal of solvent and the coating of core particles with resin were carried out. Subsequently, the material obtained was moved to a mixing agitator (a universal agitating mixer NDMV MODEL, manufactured by Dulton Company Limited). Then, using Resin Solution B, the resin solution was so put thereinto as to be in an amount of 0.3 part by mass as a coating resin component, based on 100 parts by mass of the raw-material Magnetic-material Dispersed Core Particles 8, where the removal of solvent and the coating of core particles with resin were carried out over a period of 2 hours. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 11. Production conditions for Magnetic Carrier 11 are shown in Table 4, and physical properties thereof, in Table 5.

Production Example of Magnetic Carrier 12

100 parts by mass of Magnetic Core Particles 11 was put into a mixing agitator (a universal agitating mixer NDMV MODEL, manufactured by Dulton Company Limited), and agitated with heating to a temperature of 70° C. under reduced pressure. Subsequently, Resin Solution B was so added by the drop as to be in an amount of 0.5 part by mass as a coating resin component, based on 100 parts by mass of Magnetic Core Particles 11. This was added by the drop over a period of 6 hours, where the removal of solvent and the coating of core particles with resin were carried out. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 8 hours in an atmosphere of nitrogen, followed by classification with a mesh of 70 μm in opening to obtain Magnetic Carrier 12. Production conditions for Magnetic Carrier 12 are shown in Table 4, and physical properties thereof, in Table 5.

Production Example of Magnetic Carrier 13

100 parts by mass of Magnetic Core Particles 9 was put into a mixing machine (NAUTA MIXER VN MODEL, manufactured by Hosokawa Micron Corporation), and heated to a temperature of 70° C. with agitation under conditions of a speed of rotation of 100 $min^{-1}$ and a speed of revolution of 1.0 $min^{-1}$, of the screw. Subsequently, Resin Solution D which was so concentrated as to be in a solid-matter concentration of 30% by mass was so added by the drop as to be in an amount of 1.0 part by mass as a coating resin component, based on 100 parts by mass of Magnetic Core Particles 9, which was agitated for 2 hours, where the removal of solvent and the coating of core particles with resin were carried out. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 2 hours in an atmosphere of nitrogen, followed by classification with a mesh of 70 μm in opening to obtain Magnetic Carrier 13. Production conditions for Magnetic Carrier 13 are shown in Table 4, and physical properties thereof, in Table 5.

Production Example of Magnetic Carrier 14

100 parts by mass of Magnetic Core Particles 7 was put into a mixing machine (NAUTA MIXER VN MODEL, manufactured by Hosokawa Micron Corporation), and heated to a temperature of 70° C. with agitation under conditions of a speed of rotation of 100 $min^{-1}$ and a speed of revolution of 1.0 $min^{-1}$, of the screw. Subsequently, Resin Solution D was so added as to be in an amount of 0.8 part by mass as a coating resin component, based on 100 parts by mass of Magnetic Core Particles 7, which was agitated for 2 hours, where the removal of solvent and the coating of core particles with resin were carried out. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 2 hours in an atmosphere of nitrogen, followed by classification with a mesh of 70 μm in opening to obtain Magnetic Carrier 14. Production conditions for Magnetic Carrier 14 are shown in Table 4, and physical properties thereof, in Table 5.

Production Example of Magnetic Carrier 15

100 parts by mass of Magnetic Core Particles 7 was put into a mixing machine (NAUTA MIXER VN MODEL, manufactured by Hosokawa Micron Corporation), and heated to a temperature of 70° C. with agitation under conditions of a speed of rotation of 100 $min^{-1}$ and a speed of revolution of 3.5 $min^{-1}$, of the screw. Subsequently, Resin Solution E was added by the drop as to be in an amount of 0.5 part by mass as a coating resin component, based on 100 parts by mass of Magnetic Core Particles 7, where in 2 hours the removal of solvent and the coating of core particles with resin were carried out. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 8 hours in an atmosphere of nitrogen, followed by classification with a mesh of 70 μm in opening to obtain Magnetic Carrier 15. Production conditions for Magnetic Carrier 15 are shown in Table 4, and physical properties thereof, in Table 5.

Production Example of Magnetic Carrier 16

Using Resin Solution F, the coating of core particles with resin and the removal of solvent were so carried out in a fluidized bed heated to a temperature of 80° C. that the coating resin component was in an amount of 1.3 parts by mass based on 100 parts by mass of Filled Core Particles 9. Heat treatment was carried out at a temperature of 200° C. for 2 hours, followed by classification with a mesh of 70 μm in opening to obtain Magnetic Carrier 16. Production conditions for Magnetic Carrier 16 are shown in Table 4, and physical properties thereof, in Table 5.

Production Example of Magnetic Carrier 17

Using Resin Solution A, the coating of core particles with resin and the removal of solvent were so carried out in a fluidized bed heated to a temperature of 80° C. that the coating resin component was in an amount of 1.0 part by mass based on 100 parts by mass of Magnetic Core Particles 13. After the removal of coating solvent, agitation was continued at a temperature of 80° C. for 2 hours. Further, using Resin Solution A, the coating of core particles with resin and the removal of solvent were so carried out in a fluidized bed that the coating resin component was in an amount of 0.5 part by mass based on 100 parts by mass of Magnetic Core Particles 13. Heat treatment was carried out at a temperature of 200° C. for 2 hours, followed by classification with a mesh of 70 μm in opening to obtain Magnetic Carrier 17. Production conditions for Magnetic Carrier 17 are shown in Table 4, and physical properties thereof, in Table 5.

TABLE 4

| | | Coating steps | | | | | | | |
|---|---|---|---|---|---|---|---|---|---|
| | | Total | | Details of each stage | | | | | |
| Magnetic Carrier No. | Core particles (CP) | Coat level (pbm) | Resin solution | Coating 1st stage | Solid = matter conc. (ms. %) | Coating 2nd stage | Solid = matter conc. (ms. %) | Coating 3rd stage | Solid = matter conc. (ms. %) |
| 1 | Filled CP 1 | 1.0 | C | 0.5 | 10 | 0.5 | 20 | — | — |
| 2 | Filled CP 1 | 2.5 | C | 1.5 | 10 | 1.0 | 20 | — | — |
| 3 | Filled CP 2 | 3.0 | B | 1.5 | 10 | 1.5 | 20 | — | — |
| 4 | Filled CP 3 | 1.0 | C | 0.5 | 15 | 0.5 | 20 | — | — |
| 5 | Filled CP 4 | 1.0 | C | 0.5 | 10 | 0.25 | 20 | 0.25 | 20 |
| 6 | Filled CP 5 | — | — | — | — | — | — | — | — |
| 7 | Filled CP 6 | — | — | — | — | — | — | — | — |
| 8 | Filled CP 7 | — | — | — | — | — | — | — | — |
| 9 | Filled CP 8 | 0.5 | C | 0.5 | 5 | — | — | — | — |

TABLE 4-continued

| Magnetic Carrier No. | Core particles (CP) | Coating steps: Total: Coat level (pbm) | Total: Resin solution | Details of each stage: Coating 1st stage | Solid = matter conc. (ms. %) | Coating 2nd stage | Solid = matter conc. (ms. %) | Coating 3rd stage | Solid = matter conc. (ms. %) |
|---|---|---|---|---|---|---|---|---|---|
| 10 | Magnetic CP 10 | 1.0 | C | 1.0 | 30 | — | — | — | — |
| 11 | Magnetic-material Dispersed CP 8 | 0.8 | B | 0.5 | 5 | 0.3 | 20 | — | — |
| 12 | Magnetic CP 11 | 0.5 | B | 0.5 | 20 | — | — | — | — |
| 13 | Magnetic CP 9 | 1.0 | D | 1.0 | 30 | — | — | — | — |
| 14 | Magnetic CP 7 | 0.8 | D | 0.8 | 20 | — | — | — | — |
| 15 | Magnetic CP 7 | 0.5 | E | 0.5 | 20 | — | — | — | — |
| 16 | Filled CP 9 | 1.3 | F | 1.3 | 20 | — | — | — | — |
| 17 | Magnetic CP 13 | 1.5 | A | 1.0 | 20 | 0.5 | 20 | — | — |

TABLE 5

| Magnetic Carrier No. | Propn. of particles where portions coming from metal oxide are in proportion of 0.5-8.0 area % (no. %) | Based on carrier particles: Area proportion $Av_1$ of portions coming from metal oxide; accelerating voltage 2.0 kV (area %) | Area proportion $Av_4$ of portions coming from metal oxide; accelerating voltage 4.0 kV (area %) | $Av_4/Av_1$ | Based on portions coming from metal oxide: Area proportion $Av_2$ of portions coming from metal oxide of 6.672 $\mu m^2$ or more (area %) | Area proportion $Av_3$ of portions coming from metal oxide of 2.780 $\mu m^2$ or less (area %) | Area av. value of domains for portions having high luminance which come from metal oxide ($\mu m^2$) |
|---|---|---|---|---|---|---|---|
| 1 | 97.5 | 3.8 | 3.9 | 1.01 | 2.0 | 83.0 | 1.10 |
| 2 | 95.1 | 3.5 | 3.6 | 1.02 | 2.0 | 77.0 | 0.98 |
| 3 | 94.1 | 3.8 | 3.9 | 1.05 | 2.0 | 89.0 | 0.92 |
| 4 | 97.0 | 5.4 | 5.9 | 1.09 | 1.8 | 78.5 | 1.25 |
| 5 | 97.5 | 2.1 | 2.3 | 1.08 | 1.9 | 83.4 | 0.88 |
| 6 | 95.2 | 3.2 | 3.4 | 1.05 | 2.0 | 93.0 | 0.97 |
| 7 | 91.4 | 5.6 | 6.0 | 1.08 | 2.1 | 69.8 | 1.12 |
| 8 | 94.2 | 3.1 | 3.2 | 1.05 | 5.0 | 75.0 | 1.02 |
| 9 | 98.1 | 1.5 | 1.6 | 1.09 | 0.0 | 84.0 | 0.85 |
| 10 | 84.2 | 4.9 | 5.4 | 1.11 | 9.2 | 62.0 | 1.10 |
| 11 | 98.5 | 0.7 | 0.9 | 1.28 | 0.0 | 97.0 | 0.57 |
| 12 | 91.5 | 7.8 | 10.3 | 1.31 | 4.0 | 65.3 | 1.25 |
| 13 | 85.2 | 8.1 | 10.9 | 1.35 | 4.2 | 66.7 | 1.44 |
| 14 | 82.5 | 7.5 | 10.1 | 1.35 | 10.6 | 58.8 | 1.32 |
| 15 | 79.5 | 10.4 | 14.0 | 1.34 | 6.6 | 56.3 | 1.58 |
| 16 | 95.4 | 0.4 | 0.5 | 1.31 | 0.0 | 91.7 | 0.44 |
| 17 | 96.4 | 0.0 | 0.0 | — | 0.0 | 0.0 | 0.40 |

Production Example of Resin A (Hybrid Resin)

1.9 moles of styrene, 0.21 mole of 2-ethylhexyl acrylate, 0.15 mole of fumaric acid, 0.03 mole of a dimer of α-methylstyrene and 0.05 mole of dicumyl peroxide were put into a dropping funnel. Also, 7.0 moles of polyoxypropylene(2.2)-2,2-bis(4-hydroxyl-phenyl)propane, 3.0 moles of polyoxyethylene(2.2)-2,2-bis(4-hydroxyphenyl)propane, 3.0 moles of terephthalic acid, 2.0 moles of trimellitic anhydride, 5.0 moles of fumaric acid and 0.2 g of dibutyltin oxide were put into a 4-liter four-necked flask made of glass, and a thermometer, a stirring rod, a condenser and a nitrogen feed tube were attached thereto. This was placed in a mantle heater. Next, the inside atmosphere of the flask was displaced with nitrogen gas, followed by gradual heating with stirring. With stirring at a temperature of 145° C., the monomers and polymerization initiator for vinyl resin were added by the drop over a period of 5 hours from the above dropping funnel. Then, these were heated to 200° C. to carry out reaction at 200° C. for 4.0 hours to obtain a hybrid resin (Resin A). This Resin A had molecular weight as determined by GPC, of 64,000 in weight average molecular weight (Mw), 4,500 in number average molecular weight (Mn) and 7,000 in peak molecular weight (Mp).

Production Example of Inorganic Fine Particles (Sol-Gel Fine Silica Particles)

In the presence of methanol, water and ammonia and with heating to a temperature of 35° C., tetramethoxysilane was added by the drop to fine silica particles with stirring to obtain a suspension of the fine silica particles. Solvent displacement was effected, and, to the liquid dispersion obtained, hexamethyldisilazane was added as a hydrophobic-treating agent at room temperature. Thereafter, these were heated to 130° C. and reacted to carry out hydrophobic treatment of fine silica particle surfaces. The treated particles were passed through a sieve by a wet-process to remove coarse particles, followed by removal of the solvent and then drying to obtain Inorganic Fine Particles A (sol-gel fine silica particles). Primary particles of the above Inorganic Fine Particles A were 110 nm in number average particle diameter.

In the same way as the above but with appropriate changes of reaction temperature and stirring speed, Inorganic Fine Particles (sol-gel fine silica particles) B to E were produced which were 43 nm, 50 nm, 280 nm and 330 nm, respectively, in number average particle diameter.

(Toner Production Example 1) Production of Magenta Master Batch

| | |
|---|---|
| Resin A | 60 parts by mass |
| Magenta pigment (C.I. Pigment Red 57) | 20 parts by mass |
| Magenta pigment (C.I. Pigment Red 122) | 20 parts by mass |

The above materials were melt-kneaded by means of a kneader mixer to prepare a magenta master batch.

Production Example of Toner A

| | |
|---|---|
| Resin A | 88.3 parts by mass |
| Purified paraffin wax (maximum endothermic peak: 70° C.; Mw: 450; Mn: 320) | 5.0 parts by mass |
| Above magenta master batch (colorant content: 40% by mass) | 19.5 parts by mass |

Aluminum compound of 3,5-di-tert-butylsalicylic acid (negative charge control agent) 0.9 part by mass Materials formulated as above were mixed using HENSCHEL-MIXER (FM-75 MODEL, manufactured by Mitsui Miike Engineering Corporation). Thereafter, the mixture obtained was kneaded by means of a twin-screw kneader (PCM-30 MODEL, manufactured by Ikegai Corp.) set to a temperature of 160° C. The kneaded product obtained was cooled, and then crushed by means of a hammer mill to a size of 1 mm or less to obtain a crushed product. The crushed product obtained was then finely pulverized by means of a mechanical grinding machine (T-250 MODEL, manufactured by Turbo Kogyo Co., Ltd.). The finely pulverized product obtained was classified by using a particle designing apparatus (trade name: FACULTY) manufactured by Hosokawa Micron Corporation. The particles obtained were further subjected to heat treatment for making them spherical to obtain magenta toner particles.

To 100 parts by mass of the magenta toner particles obtained, 1.0 part by mass of Inorganic Fine Particles A (sol-gel fine silica particles) and 1.0 part by mass of hydrophobic fine silica powder having a number average primary particle diameter of 16 nm, having been surface-treated with 20% by mass of hexamethyldisilazane, were added and these were mixed using HENSCHEL-MIXER FM-75 MODEL, manufactured by Mitsui Miike Engineering Corporation), to obtain Toner A. In Toner A obtained, the particles having a circle-equivalent diameter of from 0.500 μm or more to less than 1.985 μm (small particles) were in a proportion of 2% by number. Also, the particles having a circle-equivalent diameter of from 1.985 μm or more to less than 39.69 μm had an average circularity of 0.978 and a weight average particle diameter (D4) of 7.2 μm.

From observation of the toner on an electron microscope and image processing, it was also ascertained that the toner had at least one maximum value at 110 nm in number distribution base particle size distribution. It was ascertained that the maximum value thus ascertained came from Inorganic Fine Particles A.

Production Example of Toner B

Toner B was obtained in the same way as in Production Example of Toner A except that the step of fine pulverization by means of a mechanical grinding machine (T-250 MODEL, manufactured by Turbo Kogyo Co., Ltd.) was repeated twice to finely pulverize the crushed product and that the heat treatment for making spherical was not carried out. In Toner B, the particles having a circle-equivalent diameter of from 0.500 μm or more to less than 1.985 μm (small particles) were in a proportion of 10% by number. Also, the particles having a circle-equivalent diameter of from 1.985 μm or more to less than 39.69 μm had an average circularity of 0.943 and a weight average particle diameter (D4) of 5.6 μm.

Production Example of Toner C

Toner C was obtained in the same way as in Production Example of Toner A except that the heat treatment for making spherical was not carried out. In Toner C, the particles having a circle-equivalent diameter of from 0.500 μm or more to less than 1.985 μm (small particles) were in a proportion of 6% by number. Also, the particles having a circle-equivalent diameter of from 1.985 μm or more to less than 39.69 μm had an average circularity of 0.936 and a weight average particle diameter (D4) of 6.2 μm.

Example 1

To 92 parts by mass of Magnetic Carrier 1, 8 parts by mass of Toner A was added, and these were put to shaking for 10 minutes by means of a V-type mixing machine to prepare a two-component developer. Using this two-component developer, the following evaluations were made. The results of evaluations are shown in Table 6.

A conversion machine of a digital copying machine iRC3580, manufactured by CANON INC., was used as an image forming apparatus. The above developer was put into its developing assembly at the cyan position, and images were formed in a normal-temperature and normal-humidity (temperature 23° C./humidity 50% RH) environment. An AC voltage of 2.0 kHz in frequency and 1.3 kV in Vpp and a DC voltage $V_{DC}$ were applied to the developing sleeve. The DC voltage $V_{DC}$ was controlled to 500 V under such a condition that the $V_{back}$ was fixed at 150 V. Color Laser Copier Paper (A4, 81.4 g/m$^2$, available from CANON INC.) was used as transfer materials. Under the above conditions, evaluations were made on the following evaluation items.

(1) Developing Performance:

FFH images (solid images) were formed on Color Laser Copier Paper, where, on the basis of a contrast potential of 300 V, developing performance was evaluated from the Vpp necessary to obtain image density of 1.30 or more to 1.60 or less as reflection density and from the reflection density obtained. The reflection density was measured with a spectral densitometer 500 Series (manufactured by X-Rite, Incorporated). In this evaluation, where the reflection density of the FFH images (solid images) did not reach 1.30 at 1.3 kVpp, the Vpp was made higher to increase the development level of the toner. Here, the FFH images (solid images) refer to a value which indicates 256 gradations by 16-adic number, regarding 00H as the 1st gradation (white background) and FFH as the 256th gradation (solid areas).

(Evaluation Criteria)

A: Image density is 1.30 or more to 1.60 or less at Vpp of 1.3 kV.

B: Image density is 1.30 or more to 1.60 or less at Vpp of 1.5 kV.

C: Image density is 1.30 or more to 1.60 or less at Vpp of 1.8 kV.

D: Image density is less than 1.30 at Vpp of 1.8 kV.

Next, a 100,000-sheet image reproduction test was conducted using an image having an area percentage of 5%. After the image reproduction test was finished, the developer was sampled to check what concentration the toner had in the developer. Concerning a developer having varied in toner concentration from the initial 8%, the developer container was replenished with the toner, or stopped being replenished with the toner to cause the toner to be used on by, e.g., reproducing images, to make control so that the toner concentration was kept at 8%. At the initial stage of the image reproduction test and at the initial stage of the image reproduction again performed after the control of toner concentration, evaluation was made on the following items.

(2) Evaluation on Image Defects (Blank Areas):

A chart was reproduced in which halftone horizontal zones (30H, 10 mm in width) and solid-image horizontal zones (FFH, 10 mm in width) were alternately arranged in the direction of transport of transfer sheet (i.e., images obtained by forming a halftone image of 10 mm in width over the whole region in the lengthwise direction of a photosensitive member, then forming a solid image of 10 mm in width over the whole region in the lengthwise direction thereof and repeating these). The images formed were read with a scanner (600 dpi), and were binary-coded. Luminance distribution (256 gradations) of the binary-coded images in the direction of transport was measured. Here, the 30H images refer to a value which indicates 256 gradations by 16-adic number, and are halftone images where 00H is regarded as a state of no image and FFH as a solid image. In the luminance distribution obtained on the binary-coded images, the area (the number of dots) of regions having lower luminance than the halftone (30H) and looking white (regions of from 00H to 30H) is taken as the degree of blank areas. Evaluation was made on the level of blank areas at the start of running and after running on 100,000 sheets.

(Evaluation Criteria)

A: 50 or less.

B: From 51 or more to 150 or less.

C: From 151 or more to 300 or less.

D: 301 or more.

(3) Image Quality (Coarse Images):

Halftone images (30H) were formed on one sheet of A4 size, and images formed at the start of running and after running on 100,000 sheets were evaluated by visual observation. The visual observation was made on any coarse images in the halftone images.

(Evaluation Criteria)

A: No coarse images.

B: Coarse images are slightly seen.

C: Coarse images are seen, but at a level of tolerance.

D: Coarse images are seriously seen.

(4) Carrier Sticking:

At the start of running and after running on 100,000 sheets, 00H images were reproduced, and a transparent pressure-sensitive tape was brought into close contact with the corresponding part on the photosensitive drum to make sampling, where the number of magnetic carrier particles having come to stick to the surface of the photosensitive drum in its area of 1 cm×1 cm was counted on an optical microscope.

(Evaluation Criteria)

A: 3 particles or less.

B: From 4 particles or more to 10 particles or less.

C: From 11 particles or more to 20 particles or less.

D: 21 particles or more.

(5) Leak Test (White Dots):

For a test on initial-stage leak, a developer having a toner concentration of 4% was additionally prepared in the same way as the developer used for the running test. With regard to that after running, the developer on which the evaluation after running was finished was used, and was stopped being replenished with the toner to cause the toner to be used on until the toner concentration came to 4%. Thereafter, the test was conducted in the following way.

Solid (FFH) images were continuously reproduced on 5 sheets of A4 plain paper, and the number of dots was counted which stood blank in white in a diameter of 1 mm or more on the images. Evaluation was made from the total number of dots on the 5 sheets.

(Evaluation Criteria)

A: 0 dot.

B: From 1 dot or more to less than 10 dots.

C: From 10 dots or more to less than 20 dots.

D: From 20 dots or more to less than 100 dots.

(6) Image Density Variations:

Image density and fog were measured with X-Rite color reflection densitometer (500 Series; manufactured by X-Rite, Incorporated). A difference in image density was found between that at the start of running and that after running on 100,000 sheets to make evaluation according to the following criteria.

(Evaluation Criteria)

A: From 0.00 or more to less than 0.05.

B: From 0.05 or more to less than 0.10.

C: From 0.10 or more to less than 0.20.

D: 0.20 or more.

Next, the copying machine having finished the 100,000-sheet image reproduction test was moved to a high-temperature and high-humidity (temperature 30° C./humidity 80% RH) environment, where a 50,000-sheet image reproduction test was further conducted using an image having an area percentage of 30%. After the 50,000-sheet image reproduction test was finished, about 1 g of the developer was sampled from the surface of the developer carrying member. Next, the developing assembly was returned to the interior of the copying machine and was left to stand three overnight as it was. After the leaving to stand three overnight, likewise about 1 g of the developer was sampled from the developing assembly. Thereafter, the developing assembly was returned to the interior of the copying machine to conduct a test on fog as described later.

(7) Charge Quantity Variations when Left in High-Temperature and High-Humidity Environment:

Charge quantity (Q1) of developer sampled immediately after the 50,000-sheet image reproduction test further conducted in a high-temperature and high-humidity (temperature 30° C./humidity 80% RH) environment and charge quantity (Q2) of developer sampled after the leaving to stand three overnight were measured to make evaluation by a difference in charge quantity between Q1 and Q2 (the level of decrease in charge quantity).

The charge quantity was measured with a suction separating charge quantity measuring instrument SEPASOFT STC-1-C1 MODEL (manufactured by Sankyo Pio-Teck Co., Ltd.) placed in a high-temperature and high-humidity (temperature 30° C./humidity 80% RH) environment. A mesh (wire gauze) of 20 μm in opening was placed at the bottom of a sample holder (Faraday gauze), and 0.1 g of the developer sampled was put thereon, where the holder was covered up. The mass of the whole sample holder at this point was measured, which is represented by W1 (g). Next, this sample holder was placed in the main body, and an air flow control valve was adjusted to set suction pressure at 2 kPa. In this state, the toner was sucked for 2 minutes so as to be removed by suction. The charge quantity at this point is represented by Q (μC). The mass of the whole sample holder standing after suction was also measured, which is represented by W2 (g). The Q found at this point comes reverse in polarity as triboelectric charge quantity of the toner because the charge of the carrier is measured. The absolute value of triboelectric charge quantity of this developer is calculated as shown by the following expression.

$$\text{Triboelectric charge quantity(mC/kg)}=Q/(W1-W2).$$

(Evaluation Criteria)

A: Less than 5.0 mC/kg.

B: From 5.0 mC/kg or more to less than 10.0 mC/kg.

C: From 10.0 mC/kg or more to less than 15.0 mC/kg.

D: 15.0 mC/kg or more.

(8) Fog:

At the start of running and after image reproduction on 100,000 sheets, a solid white image was reproduced on one sheet, setting the Vback at 150 V. Average reflectance Dr (%) of paper before image formation and reflectance Ds (%) of the solid white image were measured with a reflection densitometer (REFLECTOMETER MODEL TC-6DS, manufactured by Tokyo Denshoku Co., Ltd.). Fog (%)=Dr (%)−Ds (%) was calculated.

(Evaluation Criteria)

A: Less than 0.5%.

B: From 0.5% or more to less than 1.0%.

C: From 1.0% or more to less than 2.0%.

D: 2.0% or more.

(9) Fog after Leaving in High-Temperature and High-Humidity Environment:

After the image reproduction on further 50,000 sheets in a high-temperature and high-humidity environment (temperature 30° C./humidity 80% RH), the machine was left to stand in the high-temperature and high-humidity environment three overnight as it was, a solid white image was reproduced on one sheet, setting the Vback at 150 V. Evaluation was made by the same procedure and evaluation criteria as the item (8), the evaluation on any variations in fog as a result of running.

Examples 2 to 9 & Comparative Examples 1 to 8

In combination of the magnetic carriers and the toners as shown in Table 6, two-component developers were respectively prepared, and evaluations were made in the same way as in Example 1. Results of the respective evaluations are shown in Table 6.

TABLE 6

| | | | Developing performance | | | Leak test Initial | | Leak test After | | Coarse images | | Blank areas | | | | Fog | | | |
|---|---|---|---|---|---|---|---|---|---|---|---|---|---|---|---|---|---|---|---|
| | Toner | MagCar | Eval | Vpp | Ref. density | stage (number) | | 100k (number) | | Init | After 100k | Initial stage | | After 100k | | Initial stg | | After 100k | |
| Example: | | | | | | | | | | | | | | | | | | | |
| 1 | A | 1 | A | 1.3 | 1.55 | A | 0 | A | 0 | A | A | A | 25 | A | 35 | A | 0 | A | 0.2 |
| 2 | A | 2 | A | 1.3 | 1.50 | A | 0 | A | 0 | A | A | A | 28 | A | 33 | A | 0 | A | 0.3 |
| 3 | A | 3 | A | 1.3 | 1.48 | A | 0 | A | 0 | A | B | A | 25 | A | 39 | A | 0 | B | 0.5 |
| 4 | A | 4 | A | 1.3 | 1.35 | A | 0 | A | 0 | A | A | A | 30 | A | 55 | A | 0 | A | 0.4 |
| 5 | A | 5 | A | 1.3 | 1.55 | A | 0 | A | 0 | A | A | A | 28 | A | 48 | A | 0 | A | 0.4 |
| 6 | A | 6 | A | 1.3 | 1.55 | B | 2 | B | 4 | A | A | A | 25 | B | 65 | B | 1 | B | 0.7 |
| 7 | A | 7 | A | 1.3 | 1.42 | B | 1 | C | 11 | A | A | A | 32 | C | 158 | B | 1 | B | 0.9 |
| 8 | A | 8 | B | 1.5 | 1.48 | B | 1 | B | 3 | A | C | B | 51 | C | 188 | B | 1 | C | 1.4 |
| 9 | A | 9 | A | 1.3 | 1.55 | B | 3 | B | 5 | A | A | A | 28 | B | 52 | A | 0 | B | 0.8 |
| Comparative Example: | | | | | | | | | | | | | | | | | | | |
| 1 | A | 10 | A | 1.3 | 1.46 | B | 6 | C | 15 | C | C | B | 67 | C | 175 | B | 1 | D | 2.4 |
| 2 | A | 11 | C | 1.8 | 1.33 | A | 0 | C | 12 | A | A | C | 156 | C | 220 | C | 1 | D | 2.5 |
| 3 | A | 12 | C | 1.8 | 1.44 | C | 11 | C | 18 | C | C | B | 77 | C | 210 | B | 1 | D | 2.1 |
| 4 | A | 13 | D | 1.8 | 1.28 | D | 25 | D | 35 | D | D | B | 90 | D | 322 | C | 2 | D | 2.5 |
| 5 | A | 14 | D | 1.8 | 1.24 | C | 12 | D | 38 | D | D | C | 160 | D | 355 | C | 2 | D | 2.4 |
| 6 | A | 15 | C | 1.8 | 1.37 | D | 32 | D | 44 | D | D | C | 180 | D | 370 | B | 2 | D | 2.4 |
| 7 | B | 16 | C | 1.8 | 1.47 | C | 16 | D | 40 | A | A | A | 48 | C | 195 | B | 1 | C | 1.8 |
| 8 | C | 17 | D | 1.8 | 1.22 | A | 0 | D | 31 | C | D | C | 320 | D | 398 | D | 2 | D | 3.5 |

| | Carrier sticking Init. stg; number/cm$^2$ | | After 100k; no./cm$^2$ | | Running density variations Eval | Initial stg | After 100k | Density var. | Charge qty. variations; leaving 3 overnight | | Fog after leaving After 150k | |
|---|---|---|---|---|---|---|---|---|---|---|---|---|
| Example: | | | | | | | | | | | | |
| 1 | A | 0 | A | 1 | A | 1.55 | 1.53 | 0.02 | A | 2 | A | 0 |
| 2 | A | 3 | A | 3 | A | 1.5 | 1.52 | −0.02 | A | 1 | A | 0 |
| 3 | A | 1 | A | 2 | A | 1.48 | 1.45 | 0.03 | A | 2 | A | 0 |
| 4 | A | 3 | B | 4 | B | 1.35 | 1.29 | 0.06 | A | 4 | B | 1 |

TABLE 6-continued

| | | | | | | | | | | | | |
|---|---|---|---|---|---|---|---|---|---|---|---|---|
| 5 | A | 1 | B | 4 | B | 1.55 | 1.48 | 0.07 | A | 4 | A | 0 |
| 6 | A | 0 | B | 7 | A | 1.55 | 1.51 | 0.04 | A | 5 | A | 0 |
| 7 | B | 4 | C | 12 | B | 1.42 | 1.36 | 0.06 | B | 6 | B | 1 |
| 8 | B | 4 | C | 15 | B | 1.28 | 1.2 | 0.08 | B | 8 | B | 1 |
| 9 | A | 2 | B | 5 | C | 1.55 | 1.39 | 0.16 | A | 4 | A | 0 |
| Comparative Example: | | | | | | | | | | | | |
| 1 | C | 11 | C | 11 | C | 1.46 | 1.35 | 0.11 | C | 11 | B | 1 |
| 2 | C | 16 | C | 19 | C | 1.2 | 1.05 | 0.15 | C | 14 | C | 2 |
| 3 | C | 11 | C | 16 | C | 1.25 | 1.36 | −0.11 | B | 7 | C | 2 |
| 4 | C | 15 | D | 25 | D | 1.1 | 1.31 | −0.21 | B | 9 | D | 3 |
| 5 | D | 21 | D | 30 | D | 1.11 | 1.35 | −0.24 | D | 16 | D | 3 |
| 6 | D | 22 | D | 44 | D | 1.25 | 1.46 | −0.21 | C | 14 | D | 3 |
| 7 | B | 9 | D | 42 | D | 1.26 | 1.49 | −0.23 | D | 15 | D | 2 |
| 8 | C | 11 | D | 50 | D | 1.08 | 1.33 | −0.25 | C | 14 | C | 2 |

MagCar: Magnetic Carrier; Eval: Evaluation; Init: Initial; stg: stage; 100k: 100,000 sheets; 150k: 150,000 sheets Production Example of Porous Magnetic Core Particles 14

Step 1 (Weighing and Mixing Step):

| | |
|---|---|
| $Fe_2O_3$ | 61.1% by mass |
| $MnCO_3$ | 33.5% by mass |
| $Mg(OH)_2$ | 4.5% by mass |
| $SrCO_3$ | 0.9% by mass |

The above ferrite raw materials were weighed out. Thereafter, these were ground and mixed for 2 hours by means of a dry-process ball mill making use of zirconia balls (10 mm in diameter).

Step 2 (Provisional Baking Step):

After these were ground and mixed, the mixture obtained was baked at a temperature of 950° C. for 2 hours in the atmosphere by using a burner type baking furnace to produce provisionally baked ferrite.

Step 3 (Grinding Step):

The provisionally baked ferrite was ground to a size of about 0.5 mm by means of a crusher, and thereafter, with addition of 30 parts by mass of water based on 100 parts by mass of the provisionally baked ferrite, the ground product was further ground for 4 hours by means of a wet-process bead mill making use of zirconia beads of 1.0 mm in diameter to obtain ferrite slurry.

Step 4 (Granulation Step):

To the ferrite slurry, 2.0 parts by mass of polyvinyl alcohol based on 100 parts by mass of the provisionally baked ferrite was added as a binder, and this ferrite slurry was granulated into spherical particles of 36 μm in diameter by means of a spray dryer (manufactured by Ohkawara Kakohki Co., Ltd.).

Step 5 (Main Baking Step):

The granulated product was baked at a temperature of 1,050° C. for 4 hours while being kept in an atmosphere of nitrogen (oxygen concentration: 0.02% by volume) in an electric furnace in order to control baking atmosphere.

Step 6 (Screening Step):

Particles having come to agglomerate were disintegrated, followed by sifting with a sieve of 250 μm in mesh opening to remove coarse particles to obtain Porous Magnetic Core Particles 14. Physical properties of Porous Magnetic Core Particles 14 are shown in Table 7.

Production Example of Porous Magnetic Core Particles 15

Step 1 (Weighing and Mixing Step):

| | |
|---|---|
| $Fe_2O_3$ | 80.3% by mass |
| $MnCO_3$ | 28.3% by mass |
| $Mg(OH)_2$ | 1.4% by mass |

Porous Magnetic Core Particles 15 was obtained in the same way as in Production Example of Porous Magnetic Core Particles 14 except that the above ferrite raw materials were used instead. Physical properties of Porous Magnetic Core Particles 15 are shown in Table 7.

Production Example of Porous Magnetic Core Particles 16

Porous Magnetic Core Particles 16 was obtained in the same way as in Production Example of Porous Magnetic Core Particles 15 except that, of the baking conditions in the step 5, the atmosphere of nitrogen was changed to have an oxygen concentration of less than 0.01% by volume. Physical properties of Porous Magnetic Core Particles 16 are shown in Table 7.

Production Example of Porous Magnetic Core Particles 17

Porous Magnetic Core Particles 17 was obtained in the same way as in Production Example of Porous Magnetic Core Particles 14 except that the time for the grinding making use of zirconia beads of 1.0 mm in diameter in the step 3 of Production Example of Porous Magnetic Core Particles 14 was changed to 3 hours and that, of the baking conditions in the step 5, the atmosphere of nitrogen in the electric furnace was changed to have an oxygen concentration of less than 0.01% by volume and in addition thereto the baking was carried out at a temperature of 1,100° C. for 4 hours. Physical properties of Porous Magnetic Core Particles 17 are shown in Table 7.

Production Example of Porous Magnetic Core Particles 18

Porous Magnetic Core Particles 18 was obtained in the same way as in Production Example of Porous Magnetic Core Particles 17 except that, of the baking conditions in the step 5, the oxygen concentration in the atmosphere of nitrogen was changed to 0.30% by volume. Physical properties of Porous Magnetic Core Particles 18 are shown in Table 7.

Production Example of Porous Magnetic Core Particles 19

Porous Magnetic Core Particles 19 was obtained in the same way as in Production Example of Porous Magnetic Core Particles 17 except that the time for the grinding making use of zirconia beads of 1.0 mm in diameter in the step 3 was changed to 2 hours and that, of the baking conditions in the step 5, the oxygen concentration in the atmosphere of nitrogen was changed to 0.05% by volume. Physical properties of Porous Magnetic Core Particles 19 are shown in Table 7.

Production Example of Porous Magnetic Core Particles 20

Porous Magnetic Core Particles 20 was obtained in the same way as in Production Example of Porous Magnetic Core Particles 19 except that, of the baking conditions in the step 5, the oxygen concentration in the atmosphere of nitrogen was changed to 0.20% by volume. Physical properties of Porous Magnetic Core Particles 20 are shown in Table 7.

Production Example of Porous Magnetic Core Particles 21

Porous Magnetic Core Particles 21 was obtained in the same way as in Production Example of Porous Magnetic Core Particles 19 except that, of the baking conditions in the step 5, the atmosphere of nitrogen in the electric furnace was changed to have an oxygen concentration of less than 0.01% by volume and the baking was carried out at a temperature of 1,150° C. for 4 hours. Physical properties of Porous Magnetic Core Particles 21 are shown in Table 7.

Production Example of Porous Magnetic Core Particles 22

Porous Magnetic Core Particles 22 was obtained in the same way as in Production Example of Porous Magnetic Core Particles 21 except that, of the baking conditions in the step 5, the oxygen concentration in the atmosphere of nitrogen was changed to 0.30% by volume. Physical properties of Porous Magnetic Core Particles 22 are shown in Table 7.

Production Example of Porous Magnetic Core Particles 23

Porous Magnetic Core Particles 23 was obtained in the same way as in Production Example of Porous Magnetic Core Particles 21 except that, of the baking conditions in the step 5, the oxygen concentration in the atmosphere of nitrogen was changed to 0.50% by volume. Physical properties of Porous Magnetic Core Particles 23 are shown in Table 7.

Production Example of Porous Magnetic Core Particles 24

Step 1 (Weighing and Mixing Step):

| | |
|---|---|
| $Fe_2O_3$ | 61.6% by mass |
| $MnCO_3$ | 31.6% by mass |
| $Mg(OH)_2$ | 5.7% by mass |
| $SrCO_3$ | 0.7% by mass |

The above ferrite raw materials were weighed out. Thereafter, these were ground and mixed for 5 hours by means of a wet-process ball mill making use of zirconia balls (10 mm in diameter) to obtain spherical particles.

Step 2 (Provisional Baking Step):

The spherical particles obtained were baked at a temperature of 950° C. for 2 hours in the atmosphere by using a burner type baking furnace to produce provisionally baked ferrite.

Step 3 (Grinding Step):

The provisionally baked ferrite was ground to a size of about 0.5 mm by means of a crusher, and thereafter, with addition of 30 parts by mass of water based on 100 parts by mass of the provisionally baked ferrite, the ground product was further ground for 1 hour by means of a wet-process bead mill making use of stainless steel beads (3 mm in diameter). The slurry thus obtained was ground for 4 hour by means of a wet-process bead mill making use of stainless steel beads (1.0 mm in diameter) to obtain ferrite slurry.

Step 4 (Granulation Step):

To the ferrite slurry, 1.0 part by mass of polyvinyl alcohol based on 100 parts by mass of the provisionally baked ferrite was added as a binder, and this ferrite slurry was granulated into spherical particles of 35 μm in diameter by means of a spray dryer (manufactured by Ohkawara Kakohki Co., Ltd.).

Step 5 (Main Baking Step):

The granulated product was baked at a temperature of 1,100° C. for 4 hours while being kept at an oxygen concentration of 0.5% by volume in an electric furnace in order to control baking atmosphere.

Step 6 (Screening Step):

Particles having come to agglomerate were disintegrated, followed by sifting with a sieve of 250 μm in mesh opening to remove coarse particles to obtain Porous Magnetic Core Particles 24. Physical properties of Porous Magnetic Core Particles 24 are shown in Table 7.

Production Example of Magnetic Core Particles 25

Step 1:

| | |
|---|---|
| $Fe_2O_3$ | 70.8% by mass |
| CuO | 12.8% by mass |
| ZnO | 16.4% by mass |

The above ferrite raw materials were weighed out. Thereafter, these were ground and mixed for 2 hours by means of a dry-process ball mill making use of zirconia balls (10 mm in diameter).

Step 2:

After these were ground and mixed, the mixture obtained was baked at a temperature of 950° C. for 2 hours in the atmosphere to produce provisionally baked ferrite.

Step 3:

The provisionally baked ferrite was ground to a size of about 0.5 mm by means of a crusher, and thereafter, with addition of 30 parts by mass of water based on 100 parts by mass of the provisionally baked ferrite, the ground product was further ground for 2 hours by means of a wet-process ball mill making use of stainless steel balls (10 mm in diameter). The slurry obtained was further ground for 4 hours by means of a wet-process bead mill making use of stainless steel beads (1.0 mm in diameter) to obtain ferrite slurry.

Step 4:

To the ferrite slurry, 0.5 part by mass of polyvinyl alcohol based on 100 parts by mass of the provisionally baked ferrite was added as a binder, and this ferrite slurry was granulated into spherical particles of 75 μm in diameter by means of a spray dryer (manufactured by Ohkawara Kakohki Co., Ltd.).

Step 5:

The granulated product was baked at a temperature of 1,300° C. for 4 hours in the atmosphere.

Step 6:

Particles having come to agglomerate were disintegrated, followed by sifting with a sieve of 250 μm in mesh opening to remove coarse particles to obtain Magnetic Core Particles 25. Physical properties of Magnetic Core Particles 25 are shown in Table 7.

Production Example of Magnetic Core Particles 26

Magnetic Core Particles 26 was obtained in the same way as in Production Example of Magnetic Core Particles 25 except that, after the grinding to a size of about 0.5 mm by means of a crusher in the step 3, the ground product was further ground for 6 hours by means of a wet-process ball mill making use of stainless steel balls (10 mm in diameter) and further that, in the step 4, the ferrite slurry was granulated into spherical particles of 39 μm in diameter. Physical properties of Magnetic Core Particles 26 are shown in Table 7.

TABLE 7

Physical Properties of Core Particles

| Core particles (CP) | Core particle composition | D50 (μm) | Specific resistance at 300 V/cm (Ω · cm) | Electric-field intensity on the verge of breakdown (V/cm) | True density (g/cm$^3$) | Apparent specific gravity (g/cm$^3$) |
|---|---|---|---|---|---|---|
| Porous Magnetic CP 14 | $(MnO)_{0.39}(MgO)_{0.10}(SrO)_{0.01}(Fe_2O_3)_{0.50}$ | 34.5 | $6.0 \times 10^6$ | 669 | 4.8 | 1.2 |
| Porous Magnetic CP 15 | $(MnO)_{0.36}(MgO)_{0.05}(Fe_2O_3)_{0.59}$ | 36.5 | $6.2 \times 10^6$ | 322 | 4.8 | 1.3 |
| Porous Magnetic CP 16 | $(MnO)_{0.36}(MgO)_{0.05}(Fe_2O_3)_{0.59}$ | 35.6 | $1.1 \times 10^5$ | 288 | 4.8 | 1.3 |
| Porous Magnetic CP 17 | $(MnO)_{0.39}(MgO)_{0.10}(SrO)_{0.01}(Fe_2O_3)_{0.50}$ | 33.8 | $1.8 \times 10^6$ | 550 | 4.8 | 1.5 |
| Porous Magnetic CP 18 | $(MnO)_{0.39}(MgO)_{0.10}(SrO)_{0.01}(Fe_2O_3)_{0.50}$ | 34.7 | $6.8 \times 10^8$ | 1,667 | 4.8 | 1.3 |
| Porous Magnetic CP 19 | $(MnO)_{0.39}(MgO)_{0.10}(SrO)_{0.01}(Fe_2O_3)_{0.50}$ | 31.5 | $8.2 \times 10^6$ | 833 | 4.8 | 1.5 |
| Porous Magnetic CP 20 | $(MnO)_{0.39}(MgO)_{0.10}(SrO)_{0.01}(Fe_2O_3)_{0.50}$ | 32.1 | $9.3 \times 10^7$ | 1,330 | 4.8 | 1.5 |
| Porous Magnetic CP 21 | $(MnO)_{0.39}(MgO)_{0.10}(SrO)_{0.01}(Fe_2O_3)_{0.50}$ | 37.4 | $1.8 \times 10^6$ | 480 | 4.8 | 1.7 |
| Porous Magnetic CP 22 | $(MnO)_{0.39}(MgO)_{0.10}(SrO)_{0.01}(Fe_2O_3)_{0.50}$ | 36.6 | $4.8 \times 10^8$ | 1,388 | 4.8 | 1.6 |
| Porous Magnetic CP 23 | $(MnO)_{0.39}(MgO)_{0.10}(SrO)_{0.01}(Fe_2O_3)_{0.50}$ | 35.4 | $5.5 \times 10^8$ | 1,476 | 4.8 | 1.6 |
| Porous Magnetic CP 24 | $(MnO)_{0.36}(MgO)_{0.13}(SrO)_{0.01}(Fe_2O_3)_{0.49}$ | 34.0 | $5.7 \times 10^8$ | 1,552 | 4.9 | 1.6 |
| Magnetic CP 25 | $(CuO)_{0.20}(ZnO)_{0.25}(Fe_2O_3)_{0.55}$ | 75.0 | $1.8 \times 10^9$ | Not break down | 5.0 | 2.4 |
| Magnetic CP 26 | $(CuO)_{0.20}(ZnO)_{0.25}(Fe_2O_3)_{0.55}$ | 36.5 | $1.9 \times 10^9$ | Not break down | 5.0 | 2.6 |

Production Example of Filled Core Particles 10

100 parts by mass of Porous Magnetic Core Particles 14 was put into a mixing agitator (a universal agitating mixer NDMV MODEL, manufactured by Dulton Company Limited), and then heated to a temperature of 80° C. Resin Solution B was added thereto in an amount corresponding to 15 parts by mass as a filling resin component, based on 100 parts by mass of Porous Magnetic Core Particles 14, and these were agitated while discharging the vapor of organic solvent coming to volatilize. For 2 hours, these were continued to be heated and agitated at a temperature of 80° C. to remove the solvent. The material obtained was moved to Julia Mixer (manufactured by Tokuju Corporation) to carry out heat treatment at a temperature of 200° C. for 2 hours in an atmosphere of nitrogen, followed by classification with a mesh of 70 μm in opening to obtain Filled Core Particles 10 (resin fill level: 15.0 parts by mass).

Production Examples of Filled Core Particles 11, 12, 16 & 18

Filled Core Particles 11, 12, 16 and 18 were obtained in the same way as in Production Example of Filled Core Particles 10 except that the type of Magnetic Core Particles used, the type of the resin solution and the fill level of resin in each Magnetic Core Particles were changed as shown in Table 8.

Production Example of Filled Core Particles 13

100 parts by mass of Porous Magnetic Core Particles 17 was put into a mixing agitator (a universal agitating mixer NDMV MODEL, manufactured by Dulton Company Limited), and then heated to a temperature of 50° C. under reduced pressure. Resin Solution B was added thereto in an amount corresponding to 11 parts by mass as a filling resin component, based on 100 parts by mass of Porous Magnetic Core Particles 17, and these were continued to be agitated for 2 hours, keeping temperature at 50° C., to make the resin soak into the core particles. Thereafter, the temperature was raised to 80° C. to remove the solvent. The material obtained was moved to Julia Mixer (manufactured by Tokuju Corporation) to carry out heat treatment at a temperature of 200° C. for 2 hours in an atmosphere of nitrogen, followed by classification with a mesh of 70 μm in opening to obtain Filled Core Particles 13.

Production Examples of Filled Core Particles 14, 15, 17 & 20

Filled Core Particles 14, 15, 17 and 20 were obtained in the same way as in Production Example of Filled Core Particles 13 except that the type of Magnetic Core Particles used, the type of the resin solution and the fill level of resin in each Magnetic Core Particles were changed as shown in Table 8.

Production Example of Filled Core Particles 19

100 parts by mass of Porous Magnetic Core Particles 24 was put into a single-spindle indirect heat type dryer. Keeping temperature at 75° C. and with agitation, Resin Solution B was added by the drop thereto in an amount corresponding to 20 parts by mass as a filling resin component. Thereafter, the temperature was raised to 200° C., which was retained for 2 hours, followed by classification with a mesh of 70 μm in opening to obtain Filled Core Particles 19.

TABLE 8

| Filled cores | Core particles | Filling resin | |
|---|---|---|---|
| | | Resin solution | Fill level (pbm) |
| Filled Core Particles 10 | Porous Magnetic Core Particles 14 | B | 15 |
| Filled Core Particles 11 | Porous Magnetic Core Particles 19 | B | 12 |
| Filled Core Particles 12 | Porous Magnetic Core Particles 21 | A | 7 |
| Filled Core Particles 13 | Porous Magnetic Core Particles 17 | B | 11 |
| Filled Core Particles 14 | Porous Magnetic Core Particles 20 | B | 9 |
| Filled Core Particles 15 | Porous Magnetic Core Particles 21 | B | 8 |
| Filled Core Particles 16 | Porous Magnetic Core Particles 15 | B | 15 |
| Filled Core Particles 17 | Porous Magnetic Core Particles 22 | B | 8 |
| Filled Core Particles 18 | Porous Magnetic Core Particles 16 | C | 15 |
| Filled Core Particles 19 | Porous Magnetic Core Particles 24 | B | 20 |
| Filled Core Particles 20 | Porous Magnetic Core Particles 18 | B | 12 |

pbm: parts by mass

Production Example of Magnetic Carrier 18

100 parts by mass of Filled Core Particles 10 was put into a mixing machine (NAUTA MIXER VN MODEL, manufactured by Hosokawa Micron Corporation), which was then heated to a temperature of 70° C. under reduced pressure, with agitation under conditions of a speed of revolution of 100 $min^{-1}$ and a speed of rotation of 3.5 $min^{-1}$, of the screw. Subsequently, Resin Solution C was so diluted with toluene as to be in a solid-matter concentration of 10% by mass, and this resin solution was so put into the mixer as to be in an amount of 1.5 parts by mass as a coating resin component, based on 100 parts by mass of Filled Core Particles 10. The removal of solvent and the coating of core particles with resin were carried out over a period of 2 hours. Thereafter, the temperature was raised to 180° C., where the agitation was continued for 2 hours, and thereafter the temperature was dropped to 70° C. Further, using Resin Solution C, the resin solution was so put thereinto as to be in an amount of 1.0 part by mass as a coating resin component, based on 100 parts by mass of Filled Core Particles 10, where the removal of solvent and the coating of core particles with resin were carried out over a period of 2 hours. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 18. Production conditions for Magnetic Carrier 18 are shown in Table 9, and physical properties thereof, in Table 10.

Production Example of Magnetic Carrier 19

Magnetic Carrier 19 was obtained in the same way as Magnetic Carrier 18 except that Filled Core Particles 11 was used as the filled core particles and Resin Solution B was used in place of Resin Solution C. Production conditions for Magnetic Carrier 19 are shown in Table 9, and physical properties thereof, in Table 10.

Production Example of Magnetic Carrier 20

100 parts by mass of Filled Core Particles 12 was put into a mixing machine (NAUTA MIXER VN MODEL, manufactured by Hosokawa Micron Corporation), which was then heated to a temperature of 70° C. under reduced pressure, with agitation under conditions of a speed of rotation of 100 $min^{-1}$ and a speed of revolution of 3.5 $min^{-1}$, of the screw. Subsequently, Resin Solution B was so diluted with toluene as to be in a solid-matter concentration of 15% by mass, and this resin solution was so put into the mixer as to be in an amount of 1.0 part by mass as a coating resin component, based on 100 parts by mass of Filled Core Particles 12. The removal of solvent and the coating of core particles with resin were carried out over a period of 2 hours. Thereafter, the temperature was raised to 180° C., where the agitation was continued for 2 hours, and thereafter the temperature was dropped to 70° C. Further, changing the speed of rotation of the screw to 70 $min^{-1}$ and the speed of revolution to 2.0 $min^{-1}$, Resin Solution B was so put thereinto as to be in an amount of 0.5 part by mass as a coating resin component, based on 100 parts by mass of Filled Core Particles 12, where the removal of solvent and the coating of core particles with resin were carried out over a period of 2 hours. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 20. Production conditions for Magnetic Carrier 20 are shown in Table 9, and physical properties thereof, in Table 10.

Production Example of Magnetic Carrier 21

100 parts by mass of Filled Core Particles 13 was put into a mixing machine (NAUTA MIXER VN MODEL, manufactured by Hosokawa Micron Corporation), which was then heated to a temperature of 70° C. under reduced pressure, with agitation under conditions of a speed of rotation of 100 $min^{-1}$ and a speed of revolution of 3.5 $min^{-1}$, of the screw. Subsequently, Resin Solution B was so diluted with toluene as to be in a solid-matter concentration of 10% by mass, and this resin solution was so put into the mixer as to be in an amount of 0.5 part by mass as a coating resin component, based on 100 parts by mass of Filled Core Particles 13. The removal of solvent and the coating of core particles with resin were carried out over a period of 2 hours. Thereafter, the temperature was raised to 180° C., where the agitation was continued for 2 hours, and thereafter the temperature was dropped to 70° C. Further, Resin Solution B, having been so diluted as to be in a solid-matter concentration of 15% by mass, was put thereinto, where the removal of solvent and the coating of core particles with resin were so carried out over a period of 2 hours that the resin was in an amount of 1.0 part by mass as a coating resin component, based on 100 parts by mass of Filled Core Particles 13. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 21. Production conditions for Magnetic Carrier 21 are shown in Table 9, and physical properties thereof, in Table 10.

Production Example of Magnetic Carrier 22

100 parts by mass of Filled Core Particles 14 was put into a mixing machine (NAUTA MIXER VN MODEL, manufactured by Hosokawa Micron Corporation), which was then heated to a temperature of 70° C. under reduced pressure, with agitation under conditions of a speed of revolution of 100 $min^{-1}$ and a speed of rotation of 3.5 $min^{-1}$, of the screw. Subsequently, Resin Solution B was so diluted with toluene as to be in a solid-matter concentration of 15% by mass, and this resin solution was so put into the mixer as to be in an amount of 0.5 part by mass as a coating resin component, based on 100 parts by mass of Filled Core Particles 14. The removal of solvent and the coating of core particles with resin were carried out over a period of 2 hours. Thereafter, the temperature was raised to 180° C., where the agitation was continued for 2 hours. Further, the temperature was dropped to 70° C., and Resin Solution B, having been so diluted as to be in a solid-matter concentration of 15% by mass, was so put thereinto as to be in an amount of 0.5 part by mass as a coating resin component, based on 100 parts by mass of Filled Core Particles 14, where the removal of solvent and the coating of core particles with resin were carried out over a period of 2 hours. Thereafter, the temperature was raised to 180° C., where the agitation was continued for 2 hours, and thereafter the temperature was dropped to 70° C. Further, Resin Solution B, having been so diluted as to be in a solid-matter concentration of 10% by mass, was so put thereinto as to be in an amount of 0.5 part by mass as a coating resin component, based on 100 parts by mass of Filled Core Particles 14, where the removal of solvent and the coating of core particles with resin were carried out over a period of 2 hours. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 22. Production conditions for Magnetic Carrier 22 are shown in Table 9, and physical properties thereof, in Table 10.

Production Example of Magnetic Carrier 23

Filled Core Particles 15 was not subjected to the coating thereof with resin, and used for evaluation as it was, as Magnetic Carrier 23. Production conditions for Magnetic Carrier 23 are shown in Table 9, and physical properties thereof, in Table 10.

Production Example of Magnetic Carrier 24

Filled Core Particles 10 was not subjected to the coating thereof with resin, and used for evaluation as it was, as Magnetic Carrier 24. Production conditions for Magnetic Carrier 24 are shown in Table 9, and physical properties thereof, in Table 10.

Production Example of Magnetic Carrier 25

100 parts by mass of Filled Core Particles 16 was put into a mixing machine (NAUTA MIXER VN MODEL, manufactured by Hosokawa Micron Corporation), which was then heated to a temperature of 70° C. under reduced pressure, with agitation under conditions of a speed of revolution of 100 $min^{-1}$ and a speed of rotation of 3.5 $min^{-1}$, of the screw. Subsequently, Resin Solution C was so diluted with toluene as to be in a solid-matter concentration of 5% by mass, and this resin solution was so put into the mixer as to be in an amount of 0.5 parts by mass as a coating resin component, based on 100 parts by mass of Filled Core Particles 16. The removal of solvent and the coating of core particles with resin were carried out over a period of 6 hours. Thereafter, the temperature was raised to 180° C., where the agitation was continued for 2 hours, and thereafter the temperature was dropped to 70° C. Resin Solution C, having been so diluted as to be in a solid-matter concentration of 10% by mass, was so put thereinto as to be in an amount of 0.5 part by mass as a coating resin component, based on 100 parts by mass of Filled Core Particles 16, where the removal of solvent and the coating of core particles with resin were carried out over a period of 6 hours. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 25. Production conditions for Magnetic Carrier 25 are shown in Table 9, and physical properties thereof, in Table 10.

Production Example of Magnetic Carrier 26

Filled Core Particles 17 was not subjected to the coating thereof with resin, and used for evaluation as it was, as Magnetic Carrier 26. Production conditions for Magnetic Carrier 26 are shown in Table 9, and physical properties thereof, in Table 10.

Production Example of Magnetic Carrier 27

100 parts by mass of Porous Magnetic Core Particles 23 was put into a mixing machine (NAUTA MIXER VN MODEL, manufactured by Hosokawa Micron Corporation), which was then heated to a temperature of 70° C. under reduced pressure, with agitation under conditions of a speed of rotation of 50 $min^{-1}$ and a speed of revolution of 1.0 $min^{-1}$, of the screw. Subsequently, Resin Solution C was so put thereinto as to be in an amount of 1.5 parts by mass as a coating resin component, based on 100 parts by mass of Porous Magnetic Core Particles 23, and was agitated for 2 hours. Under reduced pressure, the removal of solvent and the coating of core particles with resin were carried out over a period of 2 hours. Thereafter, the temperature was raised to 180° C., where the agitation was continued for 2 hours, and thereafter the temperature was dropped to 70° C. Resin Solution C, having been so diluted as to be in a solid-matter concentration of 10% by mass, was so put thereinto as to be in an amount of 2.5 parts by mass as a coating resin component, based on 100 parts by mass of Porous Magnetic Core Particles 23, where the removal of solvent and the coating of core particles with resin were carried out over a period of 6 hours. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 27. Production conditions for Magnetic Carrier 27 are shown in Table 9, and physical properties thereof, in Table 10.

Production Example of Magnetic Carrier 28

100 parts by mass of Filled Core Particles 18 was put into a mixing machine (NAUTA MIXER VN MODEL, manufactured by Hosokawa Micron Corporation), which was then heated to a temperature of 70° C. under reduced pressure, with agitation under conditions of a speed of rotation of 100 $min^{-1}$ and a speed of revolution of 2.0 $min^{-1}$, of the screw. Subsequently, Resin Solution C was so put thereinto as to be in an amount of 0.7 part by mass as a coating resin component, based on 100 parts by mass of Filled Core Particles 18. The removal of solvent and the coating of core particles with resin were carried out over a period of 2 hours. Thereafter, the temperature was raised to 180° C., where the agitation was continued for 2 hours, and thereafter the temperature was dropped to 70° C. Resin Solution C, having been so diluted as to be in a solid-matter concentration of 10% by mass, was so put thereinto as to be in an amount of 0.3 part by mass as a coating resin component, based on 100 parts by mass of Filled Core Particles 18, where the removal of solvent and the coating of core particles with resin were carried out over a period of 6 hours. The material obtained was moved to a mixing machine having a spiral blade in a rotatable mixing container (a DRUM MIXER UD-AT MODEL, manufactured by Sugiyama Heavy Industrial Co., Ltd.) to carry out heat treatment at a temperature of 180° C. for 4 hours in an atmosphere of nitrogen, followed by classification with a mesh of 70 μm in opening to obtain Magnetic Carrier 28. Production conditions for Magnetic Carrier 28 are shown in Table 9, and physical properties thereof, in Table 10.

Production Example of Magnetic Carrier 29

Using Resin Solution D and with agitation by using a fluidized bed heated to a temperature of 80° C., the coating of core particles with resin and the removal of solvent were so carried out that the coating resin component was in an amount of 1.3 parts by mass as a coating resin component based on 100 parts by mass of Filled Core Particles 19. Thereafter, heat treatment was carried out at a temperature of 220° C. for 2 hours, followed by classification with a mesh of 70 μm in opening to obtain Magnetic Carrier 29. Production conditions for Magnetic Carrier 29 are shown in Table 9, and physical properties thereof, in Table 10.

Production Example of Magnetic Carrier 30

Using Resin Solution A, the coating of core particles with resin and the removal of solvent were so carried out in a fluidized bed heated to a temperature of 80° C. that the coating resin component was in an amount of 0.5 part by mass based on 100 parts by mass of Magnetic Core Particles 25. Thereafter, heat treatment was carried out at a temperature of 220° C. for 2 hours, followed by classification with a mesh of 70 μm in opening to obtain Magnetic Carrier 30. Production conditions for Magnetic Carrier 30 are shown in Table 9, and physical properties thereof, in Table 10.

Production Example of Magnetic Carrier 31

Filled Core Particles 20 was not subjected to the coating thereof with resin, and used for evaluation as it was, as Magnetic Carrier 31. Production conditions for Magnetic Carrier 31 are shown in Table 9, and physical properties thereof, in Table 10.

Production Example of Magnetic Carrier 32

Using Resin Solution B, the coating of core particles with resin and the removal of solvent were so carried out in a fluidized bed heated to a temperature of 80° C. that the coating resin component was in an amount of 1.0 part by mass based on 100 parts by mass of Magnetic Core Particles 26. After the removal of coating solvent, agitation was continued at a temperature of 80° C. for 2 hours. Further, using Resin Solution B, the coating of core particles with resin and the removal of solvent were so carried out in a fluidized bed that the coating resin component was in an amount of 1.5 parts by mass based on 100 parts by mass of Magnetic Core Particles 26. Heat treatment was carried out at a temperature of 200° C. for 2 hours, followed by classification with a mesh of 70 μm in opening to obtain Magnetic Carrier 32. Production conditions for Magnetic Carrier 32 are shown in Table 9, and physical properties thereof, in Table 10.

TABLE 9

| | | Coating steps | | | | | | | |
|---|---|---|---|---|---|---|---|---|---|
| | | Total | | Details of each stage | | | | | |
| Magnetic Carrier No. | Core particles (CP) | Coat level (pbm) | Resin solution | Coating 1st stage | Solid = matter conc. (ms. %) | Coating 2nd stage | Solid = matter conc. (ms. %) | Coating 3rd stage | Solid = matter conc. (ms. %) |
| 18 | Filled CP 10 | 2.5 | C | 1.5 | 10 | 1.0 | 20 | — | — |
| 19 | Filled CP 11 | 2.5 | B | 1.5 | 10 | 1.0 | 20 | — | — |
| 20 | Filled CP 12 | 1.5 | B | 1.0 | 10 | 0.5 | 20 | — | — |
| 21 | Filled CP 13 | 1.5 | B | 0.5 | 10 | 1.0 | 15 | — | — |
| 22 | Filled CP 14 | 1.5 | B | 0.5 | 15 | 0.5 | 15 | 0.5 | 10 |
| 23 | Filled CP 15 | No resin coating | | — | — | — | — | — | — |
| 24 | Filled CP 10 | No resin coating | | — | — | — | — | — | — |
| 25 | Filled CP 16 | 1.0 | C | 0.5 | 5 | 0.5 | 10 | — | — |
| 26 | Filled CP 17 | No resin coating | | — | — | — | — | — | — |
| 27 | Porous Magnetic CP 23 | 4.0 | C | 1.5 | 5 | 2.5 | 10 | — | — |
| 28 | Filled CP 18 | 1.0 | C | 0.7 | 20 | 0.3 | 10 | — | — |
| 29 | Filled CP 19 | 1.3 | D | 1.3 | 10 | — | — | — | — |
| 30 | Magnetic CP 25 | 0.5 | A | 0.5 | 20 | — | — | — | — |
| 31 | Filled CP 20 | No resin coating | | — | — | — | — | — | — |
| 32 | Magnetic CP 26 | 2.5 | B | 1 | 20 | 1.5 | 20 | — | — |

TABLE 10

| Magnetic Carrier No. | Propn. of particles where portions coming from metal oxide are in proportion of 0.5-8.0 area % (no. %) | Based on magnetic carrier particles: Area proportion $Av_1$ of portions coming from metal oxide, measured at accelerating voltage 2.0 kV (area %) | $Av_4/Av_1$ | Based on portions coming from metal oxide: Area proportion $Av_2$ of portions coming from metal oxide of 6.672 $\mu m^2$ or more (area %) | Based on portions coming from metal oxide: Area proportion $Av_3$ of portions coming from metal oxide of 2.780 $\mu m^2$ or less (area %) | Area av. value of domains for portions having high luminance which come from metal oxide ($\mu m^2$) |
|---|---|---|---|---|---|---|
| 18 | 97.1 | 3.5 | 1.00 | 2.4 | 82.5 | 1.00 |
| 19 | 95.4 | 2.1 | 0.95 | 1.8 | 90.1 | 0.95 |
| 20 | 96.7 | 5.4 | 1.01 | 2.7 | 71.6 | 1.01 |
| 21 | 97.5 | 3.2 | 0.82 | 2.2 | 85 | 0.82 |
| 22 | 97.9 | 3.8 | 0.58 | 2.7 | 78.6 | 0.58 |
| 23 | 93.1 | 4.3 | 1.18 | 2.7 | 75 | 1.18 |
| 24 | 93.0 | 6.8 | 1.24 | 3.8 | 72 | 1.24 |
| 25 | 97.8 | 1.4 | 0.48 | 0.7 | 88.7 | 0.48 |
| 26 | 95.4 | 6.4 | 1.38 | 4.0 | 61.8 | 1.38 |
| 27 | 95.5 | 7.8 | 1.30 | 8.9 | 65 | 1.30 |
| 28 | 95.5 | 0.7 | 0.63 | 0.2 | 96.8 | 0.63 |
| 29 | 97.5 | 0.4 | 0.58 | 0.4 | 97.8 | 0.58 |
| 30 | 91.2 | 0 | 0.00 | 15.2 | 51 | 0.00 |
| 31 | 88.4 | 8.1 | 1.32 | 6.0 | 65.5 | 1.32 |
| 32 | 98.8 | 0 | 0.42 | 0.0 | 100 | 0.42 |

Production Example of Toner D

| | |
|---|---|
| Resin A | 88.3 parts by mass |
| Purified paraffin wax (maximum endothermic peak: 70° C.) | 5.0 parts by mass |
| Above magenta master batch (colorant content: 40% by mass) | 19.5 parts by mass |
| Aluminum compound of 3,5-di-tert-butylsalicylic acid (negative charge control agent) | 0.9 part by mass |

Materials formulated as above were mixed using HENSCHEL-MIXER(FM-75 MODEL, manufactured by Mitsui Miike Engineering Corporation). Thereafter, the mixture obtained was kneaded by means of a twin-screw kneader (PCM-30 MODEL, manufactured by Ikegai Corp.) set to a temperature of 150° C. The kneaded product obtained was cooled, and then crushed by means of a hammer mill to a size of 1 mm or less to obtain a crushed product. The crushed product obtained was then finely pulverized by means of a mechanical grinding machine (T-250 MODEL, manufactured by Turbo Kogyo Co., Ltd.). The finely pulverized product obtained was classified by using a particle designing apparatus (trade name: FACULTY) manufactured by Hosokawa Micron Corporation, and was so controlled that the particles having a circle-equivalent diameter of from 0.500 μm or more to less than 1.985 μm (small particles) were in a proportion of 5% by number to obtain toner particles having a weight average particle diameter (D4) of 6.2 μm.

To 100 parts by mass of the toner particles obtained, 1.0 part by mass of Inorganic Fine Particles A and 1.0 part by mass of hydrophobic fine silica powder having a number average primary particle diameter of 16 nm, having been surface-treated with 20% by mass of hexamethyldisilazane, were added and these were mixed using HENSCHEL-MIXER (FM-75 MODEL, manufactured by Mitsui Miike Engineering Corporation), to obtain Toner D. Formulation and physical properties of Toner D obtained are shown in Table 11.

Production Examples of Toners E to G

Toners E to G were obtained in the same way as in Production Example of Toner D except that Inorganic Fine Particles A to be externally added was changed for Inorganic Fine Particles C to E, respectively. Formulation and physical properties of the toners obtained are shown in Table 11.

Production Example of Toner H

Toner particles were obtained in the same way as in Production Example of Toner D except that the classification making use of the particle designing apparatus (trade name: FACULTY) manufactured by Hosokawa Micron Corporation was carried out to make control in such a way that the particles having a circle-equivalent diameter of from 0.500 μm or more to less than 1.985 μm (small particles) were in a proportion of 28% by number. The toner particles obtained had a weight average particle diameter (D4) of 5.6 μm. The external addition was also carried out in the same way as in Production Example of Toner D except that Inorganic Fine Particles B was used in place of Inorganic Fine Particles A to obtain Toner H. Formulation and physical properties of the toner obtained are shown in Table 11.

Production Example of Toner I

Toner particles were obtained in the same way as in Production Example of Toner D except that the classification making use of the particle designing apparatus (trade name: FACULTY) manufactured by Hosokawa Micron Corporation was carried out to make control in such a way that the particles having a circle-equivalent diameter of from 0.500 μm or more to less than 1.985 μm (small particles) were in a proportion of 32% by number. The toner particles obtained had a weight average particle diameter (D4) of 5.4 μm. The external addition was also carried out in the same way as in Production Example of Toner D except that Inorganic Fine Particles A was not added, to obtain Toner I. Formulation and physical properties of the toner obtained are shown in Table 11.

TABLE 11

| | Weight average particle diameter D4 (μm) | Proportion of particles of 0.500 μm to 1.985 μm in circle-equivalent diameter (no. %) | Sol-gel fine silica particles: Type | Sol-gel fine silica particles: Number base particle diameter of inorganic fine particles | Sol-gel fine silica particles: Amount (pbm) | Hydrophobic silica Amount (pbm) |
|---|---|---|---|---|---|---|
| Toner D | 6.2 | 5 | Inorganic fine particles (sol-gel fine silica particles) A | 110 | 1.0 | 1.0 |
| Toner E | 6.2 | 5 | Inorganic fine particles (sol-gel fine silica particles) C | 50 | 1.0 | 1.0 |
| Toner F | 6.2 | 5 | Inorganic fine particles (sol-gel fine silica particles) D | 280 | 1.0 | 1.0 |
| Toner G | 6.2 | 5 | Inorganic fine particles (sol-gel fine silica particles) E | 330 | 1.0 | 1.0 |
| Toner H | 5.6 | 28 | Inorganic fine particles (sol-gel fine silica particles) B | 43 | 1.0 | 1.0 |
| Toner I | 5.4 | 35 | — | — | — | 1.0 |

Example 10

To 92 parts by mass of Magnetic Carrier 18, 8 parts by mass of Toner D was added, and these were put to shaking for 10 minutes by means of a V-type mixing machine to prepare a two-component developer. Using this two-component developer, the following evaluations were made.

The results of evaluations are shown in Table 12. A conversion machine of a digital printer for business use IMAGEPRESS C7000VP, manufactured by CANON INC., was used as an image forming apparatus. The above developer was put into its developing assembly at the cyan position, and images were formed in a normal-temperature and normal-humidity (temperature 23° C./humidity 50% RH) environment. As conversion points, the developing sleeve was so converted that its peripheral speed was 1.5 times that of the photosensitive member and also a discharge opening of the replenishing developer was closed so that only the toner was replenished. Then, an AC voltage of 2.0 kHz in frequency and 1.3 kV in Vpp and a DC voltage $V_{DC}$ were applied to the developing sleeve. In this image reproduction test, the DC voltage $V_{Dc}$ was controlled at intervals of 50 V under such a condition that the $V_{back}$ was set at 150 V so that the toner laid-on level on Color Laser Copier Paper (A4, 81.4 g/m$^2$) was 0.5 mg/cm$^2$. Evaluations were made on (1) developing performance, (2) evaluation on image defects (blank areas), (3) image quality (coarse images), (4) fog, (5) carrier sticking, (6) leak test (white dots), (7) image density variations, and so forth. Evaluation methods and evaluation criteria are as described previously. Results of the evaluations are shown in Table 13.

Examples 11 to 19 & Comparative Examples 9 to 16

In combination of the magnetic carriers and the toners as shown in Table 12, two-component developers were respectively prepared. Using the two-component developers prepared, evaluations were made in the same way as in Example 10. Results of the respective evaluations are shown in Table 13.

TABLE 12

| | Toner No. | Carrier No. |
|---|---|---|
| Example 10 | Toner D | Magnetic Carrier 18 |
| Example 11 | Toner D | Magnetic Carrier 19 |
| Example 12 | Toner D | Magnetic Carrier 20 |
| Example 13 | Toner D | Magnetic Carrier 21 |
| Example 14 | Toner D | Magnetic Carrier 22 |
| Example 15 | Toner D | Magnetic Carrier 23 |
| Example 16 | Toner D | Magnetic Carrier 24 |
| Example 17 | Toner D | Magnetic Carrier 25 |
| Example 18 | Toner D | Magnetic Carrier 26 |
| Example 19 | Toner D | Magnetic Carrier 27 |
| Comp. Example 9 | Toner D | Magnetic Carrier 28 |
| Comp. Example 10 | Toner D | Magnetic Carrier 29 |
| Comp. Example 11 | Toner D | Magnetic Carrier 30 |
| Comp. Example 12 | Toner E | Magnetic Carrier 31 |
| Comp. Example 13 | Toner F | Magnetic Carrier 32 |
| Comp. Example 14 | Toner G | Magnetic Carrier 32 |
| Comp. Example 15 | Toner H | Magnetic Carrier 32 |
| Comp. Example 16 | Toner I | Magnetic Carrier 32 |

TABLE 13

| | Developing performance | | | Leak test | | | | Coarse images | | Blank areas | | | | Fog | | | |
|---|---|---|---|---|---|---|---|---|---|---|---|---|---|---|---|---|---|
| | Eval | Vpp | Ref. density | Initial stage (number) | | After 100k (number) | | Init | After 100k | Initial stage | | After 100k | | Initial stg | | After 100k | |
| Example: | | | | | | | | | | | | | | | | | |
| 10 | A | 1.3 | 1.52 | A | 0 | A | 0 | A | A | A | 30 | A | 38 | A | 0.1 | A | 0.2 |
| 11 | A | 1.3 | 1.50 | A | 0 | A | 0 | A | A | A | 25 | A | 42 | A | 0.2 | A | 0.2 |
| 12 | A | 1.3 | 1.55 | A | 0 | B | 2 | A | A | A | 43 | A | 50 | A | 0.2 | A | 0.3 |

TABLE 13-continued

| | | | | | | | | | | | | | | | | | |
|---|---|---|---|---|---|---|---|---|---|---|---|---|---|---|---|---|---|
| 13 | A | 1.3 | 1.43 | A | 0 | B | 1 | A | B | B | 60 | B | 77 | A | 0.3 | A | 0.4 |
| 14 | B | 1.5 | 1.52 | A | 0 | B | 3 | A | B | B | 115 | B | 149 | A | 0.2 | B | 0.5 |
| 15 | A | 1.3 | 1.55 | B | 2 | C | 11 | B | C | B | 80 | B | 140 | A | 0.3 | B | 0.8 |
| 16 | A | 1.3 | 1.58 | B | 5 | B | 8 | B | B | A | 49 | B | 122 | B | 0.5 | B | 0.9 |
| 17 | B | 1.5 | 1.38 | B | 1 | B | 5 | A | B | C | 155 | C | 180 | A | 0.1 | B | 0.5 |
| 18 | A | 1.3 | 1.59 | B | 5 | C | 16 | B | C | A | 43 | C | 155 | B | 0.7 | C | 1.2 |
| 19 | A | 1.3 | 1.56 | B | 6 | C | 18 | C | C | B | 140 | C | 280 | B | 0.8 | C | 1 |
| Comparative Example: | | | | | | | | | | | | | | | | | |
| 9 | C | 1.8 | 1.50 | A | 0 | D | 26 | D | D | B | 65 | B | 144 | B | 0.6 | C | 1.4 |
| 10 | D | 1.8 | 1.10 | B | 5 | C | 11 | B | D | D | 340 | D | 380 | C | 1.8 | D | 2.1 |
| 11 | C | 1.8 | 1.31 | B | 1 | D | 22 | D | D | D | 380 | D | 350 | D | 2.2 | D | 3.8 |
| 12 | B | 1.5 | 1.45 | B | 3 | D | 21 | D | D | C | 170 | C | 260 | B | 0.6 | D | 2.1 |
| 13 | D | 1.8 | 1.20 | B | 1 | B | 2 | C | D | D | 320 | D | 340 | B | 0.8 | D | 2.5 |
| 14 | D | 1.8 | 1.18 | B | 2 | B | 5 | C | D | D | 328 | D | 350 | B | 0.8 | D | 2.9 |
| 15 | D | 1.8 | 1.15 | B | 2 | B | 3 | D | D | D | 325 | D | 383 | B | 0.7 | C | 1.4 |
| 16 | D | 1.8 | 1.08 | B | 2 | B | 1 | D | D | D | 330 | D | 412 | B | 0.8 | D | 2.1 |

| | Carrier sticking | | | | Running density variations | | | | High-temp. high humidity environment | | | |
|---|---|---|---|---|---|---|---|---|---|---|---|---|
| | Init. stg; number/cm$^2$ | | After 100k; no./cm$^2$ | | Eval | Initial stg | After 100k | Density var. | Charge qty. var.; leaving 3 overnight | | Fog after leaving After 150k | |
| Example: | | | | | | | | | | | | |
| 10 | A | 3 | A | 3 | A | 1.52 | 1.54 | −0.02 | A | 2.00 | A | 0.30 |
| 11 | A | 1 | A | 3 | A | 1.50 | 1.52 | −0.02 | A | 2.00 | A | 0.30 |
| 12 | A | 0 | A | 1 | A | 1.55 | 1.58 | −0.03 | A | 3.00 | B | 0.50 |
| 13 | A | 2 | B | 4 | A | 1.43 | 1.47 | −0.04 | A | 2.00 | B | 0.50 |
| 14 | B | 4 | B | 5 | A | 1.28 | 1.32 | −0.04 | A | 2.00 | B | 0.50 |
| 15 | A | 2 | B | 5 | B | 1.55 | 1.64 | −0.09 | A | 4.00 | B | 0.90 |
| 16 | B | 7 | C | 11 | C | 1.58 | 1.68 | −0.10 | A | 3.00 | B | 0.90 |
| 17 | B | 9 | B | 10 | B | 1.20 | 1.26 | −0.06 | A | 3.00 | A | 0.60 |
| 18 | A | 2 | A | 2 | C | 1.59 | 1.69 | −0.10 | A | 4.00 | C | 1.40 |
| 19 | C | 12 | C | 18 | C | 1.56 | 1.66 | −0.10 | B | 7.00 | C | 1.50 |
| Comparative Example: | | | | | | | | | | | | |
| 9 | B | 8 | C | 15 | C | 1.15 | 1.27 | −0.12 | D | 17.00 | C | 1.90 |
| 10 | D | 22 | D | 25 | D | 1.05 | 1.26 | −0.21 | B | 9.00 | D | 2.50 |
| 11 | B | 8 | C | 15 | D | 1.11 | 1.35 | −0.24 | C | 11.00 | D | 4.00 |
| 12 | B | 7 | D | 21 | D | 1.28 | 1.48 | −0.20 | B | 6.00 | D | 2.80 |
| 13 | B | 8 | C | 19 | C | 1.08 | 1.24 | −0.16 | B | 8.00 | D | 2.50 |
| 14 | B | 8 | C | 16 | D | 1.06 | 1.27 | −0.21 | — | — | — | — |
| 15 | B | 6 | C | 18 | B | 1.08 | 1.00 | 0.08 | — | — | — | — |
| 16 | C | 11 | D | 21 | C | 1.00 | 0.89 | 0.11 | — | — | — | — |

MagCar: Magnetic Carrier; Eval: Evaluation; Init: Initial; stg: stage; 100k: 100,000 sheets; 150k: 150,000 sheets This application claims the benefit of Japanese Patent Application No. 2008-201074, filed Aug. 4, 2008, which is hereby incorporated by reference herein its entirety.

What is claimed is:

1. A magnetic carrier comprising magnetic carrier particles, each magnetic carrier particle having at least a porous magnetic core particle and a resin, wherein;

in a backscattered electron image of the magnetic carrier particles, photographed with a scanning electron microscope as taken at an accelerating voltage of 2.0 kV;

magnetic carrier particles having area proportion $S_1$ of from 0.5 area % or more to 8.0 area % or less are in a proportion of 80% by number or more in the magnetic carrier; the area proportion $S_1$ being found from the following expression (1):

$S_1$=(the total area of portions having a high luminance which come from a metal oxide on one particle of the magnetic carrier particles/the total projected area of that particle)×100 (1);

in the magnetic carrier, an average proportion $Av_1$ of the total area of portions having a high luminance which come from the metal oxide on the magnetic carrier particles to the total projected area of the magnetic carrier particles is from 0.5 area % or more to 8.0 area % or less; and in the magnetic carrier, an average proportion $Av_2$ found from the following expression (2) is 10.0 area % or less:

$Av_2$=(the total area of portions having a high luminance which come from the metal oxide on the magnetic carrier particles and being domains each of which has an area of 6.672 $\mu m^2$ or more/the total area of portions having a high luminance which come from the metal oxide of the magnetic carrier particles)×100 (2).

2. The magnetic carrier according to claim 1, wherein an average proportion $Av_3$ found from the following expression (3) is 60.0 area % or more:

$Av_3$=(the total area of portions having a high luminance which come from the metal oxide on the magnetic carrier particles and being domains each of which has an area of 2.780 $\mu m^2$ or less/the total area of portions having a high luminance which come from the metal oxide of the magnetic carrier particles)×100 (3).

3. The magnetic carrier according to claim 1, wherein, in the magnetic carrier particles, the portions having a high luminance which come from the metal oxide have an average area value of from 0.45 $\mu m^2$ or more to 1.40 $\mu m^2$ or less as that of the domains.

4. The magnetic carrier according to claim 1, wherein the average proportion $Av_1$ of the total area of the portions having a high luminance which come from the metal oxide on the magnetic carrier particles to the total projected area of the magnetic carrier particles in the backscattered electron image as photographed with the scanning electron microscope at an accelerating voltage of 2.0 kV, and an average proportion $Av_4$ of the total area of the portions having a high luminance which come from the metal oxide on the magnetic carrier particles to the total projected area of the magnetic carrier particles in the backscattered electron image as photographed with the scanning electron microscope at an accelerating voltage of 4.0 kV satisfy the relationship of the following expression (4):

$$1.00 \leqq Av_4/Av_1 \leqq 1.30 \quad (4).$$

5. The magnetic carrier according to claim 1, wherein the porous magnetic core particle has a specific resistance of from $1.0\times10^8$ Ω·cm or more to $5.0\times10^8$ Ω·cm or less at an electric-field intensity of 300 V/cm.

6. The magnetic carrier according to claim 1, wherein the pores of the porous magnetic core particle are filled with a resin.

7. The magnetic carrier according to claim 6, wherein the magnetic carrier particles are coated on surfaces thereof with a resin.

8. A two-component developer comprising a magnetic carrier and a toner; the magnetic carrier being the magnetic carrier according to a claim 1.

9. The two-component developer according to claim 8, wherein the toner has an average circularity of from 0.940 or more to 1.000 or less.

10. The two-component developer according to claim 8, wherein, in the toner, particles having a circle-equivalent diameter of from 0.500 μm or more to less than 1.985 μm are in a proportion of 30% by number or less.

11. The two-component developer according to claim 8 wherein the toner comprises toner particles and inorganic fine particles having at least one maximum value of particle size distribution in the range of from 50 nm or more to 300 nm or less in number distribution base particle size distribution.

* * * * *